US007912711B2

(12) United States Patent
Kondo et al.

(10) Patent No.: US 7,912,711 B2
(45) Date of Patent: Mar. 22, 2011

(54) METHOD AND APPARATUS FOR SPEECH DATA

(75) Inventors: Tetsujiro Kondo, Tokyo (JP); Tsutomu Watanabe, Kanagawa (JP); Masaaki Hattori, Chiba (JP); Hiroto Kimura, Tokyo (JP); Yasuhiro Fujimori, Kanagawa (JP)

(73) Assignee: Sony Corporation, Tokyo (JP)

( * ) Notice: Subject to any disclaimer, the term of this patent is extended or adjusted under 35 U.S.C. 154(b) by 772 days.

(21) Appl. No.: 11/903,550

(22) Filed: Sep. 21, 2007

(65) Prior Publication Data

US 2008/0027720 A1 Jan. 31, 2008

Related U.S. Application Data

(63) Continuation of application No. 10/089,925, filed as application No. PCT/JP01/06708 on Aug. 3, 2001, now Pat. No. 7,283,961.

(30) Foreign Application Priority Data

Aug. 9, 2000 (JP) ..... P2000-241062
Aug. 23, 2000 (JP) ..... P2000-251969
Nov. 14, 2000 (JP) ..... P2000-346675

(51) Int. Cl.
*G10L 19/10* (2006.01)

(52) U.S. Cl. ..... 704/219; 704/223; 704/220; 704/229; 704/230; 704/207

(58) Field of Classification Search ..... 704/219, 704/223, 207, 262, 263, 264, 265, 222, 229, 704/220, 230

See application file for complete search history.

(56) References Cited

U.S. PATENT DOCUMENTS 4,610,022 A 9/1986 Kitayama et al.
(Continued)

FOREIGN PATENT DOCUMENTS

EP 0 911 807 4/1999
(Continued)

*Primary Examiner* — Vijay B Chawan
(74) *Attorney, Agent, or Firm* — Frommer Lawrence & Haug LLP; William S. Frommer; Thomas F. Presson

(57) ABSTRACT

There is disclosed a speech processing device in which prediction taps for finding prediction values of the speech of high sound quality are extracted from the synthesized sound obtained on affording linear prediction coefficients and residual signals, generated from a preset code, to a speech synthesis filter, speech of high sound quality being higher in sound quality than the synthesized sound, and in which the prediction taps are used along with preset tap coefficients to perform preset predictive calculations to find the prediction values of the speech of high sound quality. The speech of high sound quality is higher in sound quality than the synthesized sound. The device includes a prediction tap extracting unit (45) for extracting, from the synthesized sound, the prediction taps used for predicting the speech of high sound quality, as target speech, the prediction values of which are to be found, and a class tap extraction unit (46) for extracting class taps, used for classifying the target speech to one of a plurality of classes, from the above code. The device also includes a classification unit (47) for finding the class of the target speech based on the class taps, acquisition unit for acquiring the tap coefficients associated with the class of the target speech from among the tap coefficients as found on learning from class to class, and a prediction unit (49) for finding the prediction values of the target speech using the prediction taps and the tap coefficients associated with the class of the target speech.

34 Claims, 34 Drawing Sheets

U.S. PATENT DOCUMENTS

| | | | | | |
|---|---|---|---|---|---|
| 5,261,027 | A | * | 11/1993 | Taniguchi et al. | 704/200 |
| 5,293,448 | A | * | 3/1994 | Honda | 704/208 |
| 5,371,853 | A | * | 12/1994 | Kao et al. | 704/200.1 |
| 5,414,796 | A | * | 5/1995 | Jacobs et al. | 704/221 |
| 5,455,888 | A | * | 10/1995 | Iyengar et al. | 704/203 |
| 5,491,771 | A | * | 2/1996 | Gupta et al. | 704/223 |
| 5,506,934 | A | * | 4/1996 | Kawama | 704/258 |
| 5,581,652 | A | * | 12/1996 | Abe et al. | 704/222 |
| 5,717,823 | A | * | 2/1998 | Kleijn | 704/220 |
| 5,822,732 | A | * | 10/1998 | Tasaki | 704/268 |
| 5,946,651 | A | * | 8/1999 | Jarvinen et al. | 704/223 |
| 5,978,759 | A | | 11/1999 | Tsushima et al. | |
| 5,995,923 | A | | 11/1999 | Mermelstein et al. | |
| 6,012,024 | A | * | 1/2000 | Hofmann | 704/219 |
| 6,014,618 | A | * | 1/2000 | Patel et al. | 704/207 |
| 6,014,622 | A | * | 1/2000 | Su et al. | 704/223 |
| 6,260,009 | B1 | | 7/2001 | Dejaco | |
| 6,434,519 | B1 | * | 8/2002 | Manjunath et al. | 704/205 |
| 6,539,355 | B1 | | 3/2003 | Omori et al. | |
| 7,283,961 | B2 | * | 10/2007 | Kondo et al. | 704/262 |
| 7,515,661 | B2 | * | 4/2009 | Kondo et al. | 375/346 |

FOREIGN PATENT DOCUMENTS

| | | |
|---|---|---|
| EP | 1 282 236 | 2/2003 |
| JP | 2 146100 | 6/1990 |
| JP | 3 293700 | 12/1991 |
| JP | 4 75100 | 3/1992 |
| JP | 5 158495 | 6/1993 |
| JP | 6-83400 | 3/1994 |
| JP | 7-50586 | 2/1995 |
| JP | 8-248996 | 9/1996 |
| JP | 8-328591 | 12/1996 |
| JP | 9-90997 | 4/1997 |
| JP | 9-258795 | 10/1997 |
| JP | 10-242867 | 9/1998 |
| JP | 10 313251 | 11/1998 |
| JP | 2000-66700 | 3/2000 |
| JP | 2000-134162 | 5/2000 |
| JP | 2001 320277 | 11/2001 |
| JP | 2001 320587 | 11/2001 |

* cited by examiner

METHOD AND APPARATUS FOR SPEECH DATA

This is a continuation of application Ser. No. 10/089,925, filed Aug. 9, 2002 now U.S. Pat. No. 7,283,961 pursuant to 35 USC 371 and based on International Application PCT/JP01/06708 filed Aug. 3, 2001, entitled to the priority filing dates of Japanese applications 2000-241062, 2000-251969, 2000-346675 filed in Japan on Aug. 9, Aug. 23 and Nov. 14, 2000, respectively, the entirety of which are incorporated herein by reference.

TECHNICAL FIELD

This invention relates to a method and an apparatus for processing data, a method and an apparatus for learning and a recording medium. More particularly, it relates to a method and an apparatus for processing data, a method and an apparatus for learning and a recording medium according to which the speech coded in accordance with the CELP (code excited linear prediction coding) system can be decoded to the speech of high sound quality.

BACKGROUND ART

First, an instance of a conventional portable telephone set is explained with reference to FIGS. 1 and 2.

This portable telephone set is adapted for performing transmission processing of coding the speech into a preset code in accordance with the CELP system and transmitting the resulting code, and for performing the receipt processing of receiving the code transmitted from other portable telephone sets and decoding the received code into speech. FIGS. 1 and 2 show a transmitter for performing transmission processing and a receiver for performing receipt processing, respectively.

In the transmitter, shown in FIG. 1, the speech uttered by a user is input to a microphone 1 where the speech is transformed into speech signals as electrical signals, which are routed to an A/D (analog/digital) converter 2. The A/D converter 2 samples the analog speech signals from the microphone 1 with, for example, the sampling frequency of 8 kHz, for A/D conversion to digital speech signals, and further quantizes the resulting digital signals with a preset number of bits to route the resulting quantized signals to an operating unit 3 and to an LPC (linear prediction coding) unit 4.

The LPC unit 4 performs LPC analysis of speech signals from the A/D converter 2, in terms of a frame corresponding to e.g., 160 samples as a unit, to find p-dimensional linear prediction coefficients $\alpha_1, \alpha_2, \ldots, \alpha_P$. The LPC analysis unit 4 sends a vector, having these P-dimensional linear prediction coefficients $\alpha_P$, where P=1, 2, . . . , P, as components, to a vector quantizer 5, as a feature vector $\alpha$ of the speech.

The vector quantizer 5 holds a codebook, associating the code vector, having the linear prediction coefficients as components, with the code, and quantizes the feature vector $\alpha$ from the LPC analysis unit 4, based on this codebook, to send the code resulting from the vector quantization, sometimes referred to below as A code (A_code), to a code decision unit 15.

The vector quantizer 5 sends the linear prediction coefficients $\alpha_1, \alpha_2, \ldots, \alpha_P'$, as components forming the code vector $\alpha'$ corresponding to the A code, to a speech synthesis filter 6.

The speech synthesis filter 6 is e.g., a digital filter of the IIR (infinite impulse response) type, and executes speech synthesis, with the linear prediction coefficients $\alpha_P'$, where p=1, 2, . . . , P, from the vector quantizer 5 as tap coefficients of the IIR filter and with the residual signals e from an operating unit 14 as an input signal.

That is, in the LPC analysis, executed by the LPC unit 4, it is assumed that a one-dimensional linear combination represented by the equation (1):

$$s_n+\alpha_1 s_{n-1}+\alpha_2 s_{n-2}+\ldots+\alpha_p s_{n-p}=e_n \quad (1)$$

holds, where $s_n$ is the (sampled value of) the speech signal at the current time n and $s_{n-1}, s_{n-2}, \ldots, s_{n-p}$ are past P sample values neighboring thereto, and the linear prediction coefficients $\alpha_p$, which will minimize the square error between the actual sample value $s_n$ and a value of linear prediction $s_n'$ thereof in case the predicted value (linear prediction value) $s_n'$ of the sampled value of the speech signal $s_n$ at the current time is linear-predicted from the n past sample values $s_{n-1}, s_{n-2}, \ldots, s_{n-P}$ in accordance with the following equation (2):

$$s_n'=-(\alpha_1 s_{n-1}+\alpha_2 s_{n-2}+\ldots+\alpha_p s_{n-p}) \quad (2)$$

is found.

In the above equation (1), $\{e_n\}$ $(\ldots, e_{n-1}, e_n, e_{n+1}, \ldots)$ are reciprocally non-correlated probability variables with an average value equal to 0 and with a variance equal to a preset value of $\beta^2$.

From the equation (1), the sample value $s_n$ may be represented by the following equation (3):

$$s_n=e_n-(\alpha_1 s_{n-1}+\alpha_2 s_{n-2}+\ldots+\alpha_p s_{n-p}) \quad (3)$$

This may be Z-transformed to give the following equation (4):

$$S=E/(1+\alpha_1 z^{-1}+\alpha_2 z^{-2}+\ldots+\alpha_p z^{-P}) \quad (4)$$

where S and E denote Z-transforms of $s_n$ and $e_n$ in the equation (3), respectively.

From the equations (1) and (2), $e_n$ can be represented by the following equation (5):

$$e_n=s_n-s_n' \quad (5)$$

and is termed a residual signal between the real sample value $s_n$ and linear predicted value $s_n'$ thereof.

Thus, the speech signal $s_n$ may be found from the equation (4), using the linear prediction coefficients $\alpha_P$ as tap coefficients of the IIR filter and also using the residual signal $e_n$ as an input signal to the IIR filter.

The speech synthesis filter 6 calculates the equation (4), using the linear prediction coefficients $\alpha_p'$ from the vector quantizer 5 as tap coefficients and also using the residual signal e from the operating unit 14 as an input signal, as described above, to find speech signals (synthesized speech signals) ss.

Meanwhile, since the speech synthesis filter 6 uses not the linear prediction coefficients $\alpha_p$, obtained as the result of the LPC by the LPC unit 4, but the linear prediction coefficients $\alpha_p'$ as a code vector corresponding to the code obtained by its vector quantization. So, the synthesized speech signal output by the speech synthesis filter 6 is not the same as the speech signal output by the A/D converter 2.

The synthesized sound signal ss, output by the speech synthesis filter 6, is sent to the operating unit 3, which subtracts the speech signal s, output from the A/D converter 2, from the synthesized speech signal ss from the speech synthesis filter 6, to send the resulting difference value to a square error operating unit 7. The square error operating unit 7 finds the square sum of the difference values from the operating unit 3 (square sum of the sample values of the k'th frame) to send the resulting square sum to a minimum square sum decision unit 8.

The minimum square sum decision unit 8 holds an L-code (L_code) as a code representing the lag, a G-code (G_code) as a code representing the gain and an I-code (I_code) as the code representing the codeword, in association with the square error output by the square error operating unit 7, and outputs the I-code, G-code and the L-code corresponding to the square error output from the square error operating unit 7. The L-code, G-code and the I-code are sent to an adaptive codebook storage unit 9, a gain decoder 10 and to an excitation codebook storage unit 11, respectively. The L-code, G-code and the I-code are also sent to a code decision unit 15.

The adaptive codebook storage unit 9 holds an adaptive codebook, which associates e.g., a 7-bit L-code with a preset delay time (lag), and delays the residual signal e supplied from the operating unit 14 by a delay time associated with the L-code supplied from the minimum square error decision unit 8 to output the resulting delayed signal to an operating unit 12.

Since the adaptive codebook storage unit 9 outputs the residual signal e with a delay corresponding to the L-code, the output signal may be said to be a signal close to a periodic signal having the delay time as a period. This signal mainly becomes a driving signal for generating a synthesized sound of the voiced sound in the speech synthesis employing linear prediction coefficients.

The gain decoder 10 holds a table which associates the G-code with the preset gains β and γ, and outputs gain values β and γ associated with the G-code supplied from the minimum square error decision unit 8. The gain values β and γ are supplied to the operating units 12 and 13.

An excitation codebook storage unit 11 holds an excitation codebook, which associates e.g., a 9-bit I-code with a preset excitation signal, and outputs the excitation signal, associated with the I-code output from the minimum square error decision unit 8, to the operating unit 13.

The excitation signal stored in the excitation codebook is a signal close e.g., to the white noise and becomes a driving signal mainly used for generating the synthesized sound of the unvoiced sound in the speech synthesis employing linear prediction coefficients.

The operating unit 12 multiplies an output signal of the adaptive codebook storage unit 9 with the gain value β output by the gain decoder 10 and routes a product value 1 to the operating unit 14. The operating unit 13 multiplies the output signal of the excitation codebook storage unit 11 with the gain value γ output by the gain decoder 10 to send the resulting product n to the operating unit 14. The operating unit 14 sums the product value 1 from the operating unit 12 with the product value n from the operating unit 13 to send the resulting sum as the residual signal e to the speech synthesis filter 6.

In the speech synthesis filter 6, the input signal, which is the residual signal e, supplied from the operating unit 14, is filtered by the IIR filter, having the linear prediction coefficients $\alpha_p'$ supplied from the vector quantizer 5 as tap coefficients, and the resulting synthesized signal is sent to the operating unit 3. In the operating unit 3 and the square error operating unit 7, operations similar to those described above are carried out and the resulting square errors are sent to the minimum square error decision unit 8.

The minimum square error decision unit 8 verifies whether or not the square error from the square error operating unit 7 has becomes smallest (locally minimum). If it is verified that the square error is not locally minimum, the minimum square error decision unit 8 outputs the L code, G code and the I code, corresponding to the square error, and subsequently repeats a similar sequence of operations.

If it is found that the square error has become smallest, the minimum square error decision unit 8 outputs a definite signal to the code decision unit 15. The code decision unit 15 is adapted for latching the A code, supplied from the vector quantizer 5, and for sequentially latching the L code, G code and the I code, sent from the minimum square error decision unit 8. On receipt of the definite signal from the minimum square error decision unit 8, the code decision unit 15 sends the A code, L code, G code and the I code, then latched, to a channel encoder 16. The channel encoder 16 then multiplexes the A code, L code, G code and the I code, sent from the code decision unit 15, to output the resulting multiplexed data as code data, which code data is transmitted over a transmission channel.

For simplicity in explanation, the A code, L code, G code and the I code are assumed to be found from frame to frame. It is however possible to divide e.g., one frame into four sub-frames and to find the L code, G code and the I code on the sub-frame basis.

It should be noted that, in FIG. 1, as in FIGS. 2, 11 and 12, explained later on, an array variable [k] is formed by affixing [k] to each variable. In the present specification, explanation on this k, representing the number of frames, is sometimes omitted.

The code data, sent from a transmitter of another portable telephone set, is received by a channel decoder 21 of a receiver shown in FIG. 2. The channel decoder 21 decodes the L code, G code, I code and the A code from the cod data to send the so separated respective codes to an adaptive codebook storage unit 22, a gain decoder 23, an excitation codebook storage unit 24 and to a filter coefficient decoder 25.

The adaptive codebook storage unit 22, gain decoder 23, excitation codebook storage unit 24 and the operating units 26 to 28 are configured similarly to the adaptive codebook storage unit 9, gain decoder 10, excitation codebook storage unit 11 and the operating units 12 to 14, respectively, and perform the processing similar to that explained with reference to FIG. 1 to decode the L code, G code and the I code into the residual signal e. This residual signal e is sent as an input signal to a speech synthesis filter 29.

A filter coefficient decoder 25 holds the same codebook as that stored in the vector quantizer 5 of FIG. 1 and decodes the A code to the linear prediction coefficient $\alpha_p'$ which is then routed to the speech synthesis filter 29.

The speech synthesis filter 29 is configured similarly to the speech synthesis filter 6 of FIG. 1, and solves the equation (4), with the linear prediction coefficient $\alpha_p'$ from the filter coefficient decoder 25 as a tap coefficient and with the residual signal e from the operating unit 28 as an input signal, to generate a synthesized speech signal when the square error has been found to be minimum by the minimum square error decision unit 8 of FIG. 1. This synthesized speech signal is sent to a D/A (digital/analog) converter 30. The D/A converter 30 D/A converts the synthesized speech signal from the speech synthesis filter 29 to send the resulting analog signal to a loudspeaker 31 as output.

The transmitter of the portable telephone set transmits an encoded version of the residual signal and the linear prediction coefficients, as filter data supplied to the speech synthesis filter 29 of the receiver, as described above. Thus, the receiver decodes the codes into the residual signal and the linear prediction coefficients. The so decoded residual signal and linear prediction coefficients are corrupted with errors, such as quantization errors. Thus, the so decoded residual signals and so decoded linear prediction coefficients, sometimes referred to below as decoded residual signals and decoded linear prediction coefficients, respectively, are not the same as the residual signal and linear prediction coefficients obtained on LPC analysis of the speech, so that the synthesized speech signals, output by the receiver's speech synthesis filter 29, are distorted and therefore are deteriorated in sound quality.

DISCLOSURE OF THE INVENTION

In view of the above-described status of the art, it is an object of the present invention to provide a method and an apparatus for processing data, a method and an apparatus for learning and a recording medium, whereby th synthesized sound of high sound quality may be achieved.

For accomplishing the above object, the present invention provides a speech processing device including a class tap extraction unit for extracting class taps, used for classifying the target speech to one of a plurality of classes, from the code, a classification unit for finding the class of the target speech based on the class taps, an acquisition unit for acquiring the tap coefficients associated with the class of the target speech from among the tap coefficients as found on learning from class to class, and a prediction unit for finding the prediction values of the target speech using the prediction taps and the tap coefficients associated with the class of the target speech. With the speech of high sound quality, the prediction values of which are to be found, as the target speech, the prediction taps used for predicting the target speech are extracted from the synthesized sound. The class taps, used for sorting the target speech into one of plural classes, are extracted from the code, and the tap coefficients, associated with the class of the target speech, are acquired from the tap class-based coefficients as found on learning. The prediction values of the target speech are found using the prediction taps and the tap coefficients associated with the class of the target speech.

The learning device according to the present invention includes a class tap extraction unit for extracting class taps from the code, the class taps being used for classifying the speech of high sound quality, as target speech, the prediction values of which are to be found, a classification unit for finding a class of the target speech based on the class taps, and a learning unit for carrying out learning so that the prediction errors of the prediction values of the speech of high sound quality obtained on carrying out predictive calculations using the tap coefficients and the synthesized sound will be statistically minimum, to find the tap coefficients from class to class. With the speech of high sound quality, the prediction values of which are to be found, as the target speech, the class taps used for sorting the target speech to one of plural classes are extracted from the code, and the class of the target speech is found based on the class taps, by way of classification. The learning then is carried out so that the prediction errors of the prediction values of the speech of high sound quality, as obtained in carrying out predictive calculations using the tap coefficients and the synthesized sound, will be statistically smallest to find the class-based tap coefficients.

The data processing device according to the present invention includes a code decoding unit for decoding the code to output decoded filter data, an acquisition unit for acquiring preset tap coefficients as found by carrying out learning, and a prediction unit for carrying out preset predictive calculations, using the tap coefficients and the decoded filter data, to find prediction values of the filter data, to send the so found prediction values to the speech synthesis filter. The code is decoded, and the decoded filter data is output. The preset tap coefficients, as found on effecting the learning, are acquired, and preset predictive calculations are carried out using the tap coefficients and the decoded filter data to find predicted values of the filter data, which then is output to the speech synthesis filter.

The learning device according to the present invention includes a code decoding unit for decoding the code corresponding to filter data to output decoded filter data, and a learning unit for carrying out learning so that the prediction errors of prediction values of the filter data obtained on carrying out predictive calculations using the tap coefficients and decoded filter data will be statistically smallest to find the tap coefficients. The code associated with the filter data is decoded and the decoded filter data is output in a code decoding step. Then, learning is carried out so that prediction errors of the prediction values of the filter data obtained on carrying out predictive calculations using the tap coefficients and the decoded filter data will be statistically minimum.

The speech processing device according to the present invention includes a prediction tap extraction unit for extracting prediction taps usable for predicting the speech of high sound quality, as target speech, the prediction values of which are to be found, a class tap extraction unit for extracting class taps, usable for sorting the target speech to one of a plurality of classes, by way of classification, from the synthesized sound, the code or the information derived from the code, an acquisition unit for acquiring the tap coefficients associated with the class of the target speech from the tap coefficients as found on learning from one class to another, and a prediction unit for finding the prediction values of the target speech using the prediction taps and the tap coefficients associated with the class of the target speech. With the speech of high sound quality, the prediction values of which are to be found, as the target speech, the prediction taps, used for predicting the target speech, are extracted from the synthesized sound and the code or the information derived from the code, and the class taps, used for sorting the target speech to one of plural classes, are extracted from the synthesized sound, code or the information derived from the code. Based on the class taps, classification is carried out for finding the class of the target speech. From the class-based tap coefficients, as found on learning, the tap coefficient associated with the class of the target speech are acquired. The prediction values of the target speech are found using the prediction taps and the tap coefficients associated with the class of the target speech.

The learning device according to the present invention includes a prediction tap extraction unit for extracting prediction taps usable in predicting the speech of high sound quality, as target speech, the prediction values of which are to be found, from the synthesized sound, the code or from the information derived from the code, a class tap extraction unit for extracting class taps usable for sorting the target speech to one of a plurality of classes, by way of classification, from the synthesized sound, the code or from the information derived from the code, a classification unit for finding the class of the target speech based on the class taps, and a learning unit for carrying out learning so that the prediction errors of prediction values of the speech of high sound quality, obtained on carrying out predictive calculations using the tap coefficients and the prediction taps, will be statistically smallest. With the speech of the high sound quality, the prediction values of which are to be found, as the target speech, the prediction taps, used for predicting the target speech, are extracted from the synthesized sound and the code or from the information derived from the code. The class of the target speech is found, based on the class taps, by way of classification. Then, learning is carried out so that the prediction errors of the prediction values of the target speech acquired on carrying out the predictive calculations using the tap coefficients and the prediction taps will be statistically smallest to find the tap coefficients on the class basis.

Other objects, features and advantages of the present invention will become more apparent from reading the embodiments of the present invention as shown in the drawings.

BEST MODE FOR CARRYING OUT THE INVENTION

Figure 1:
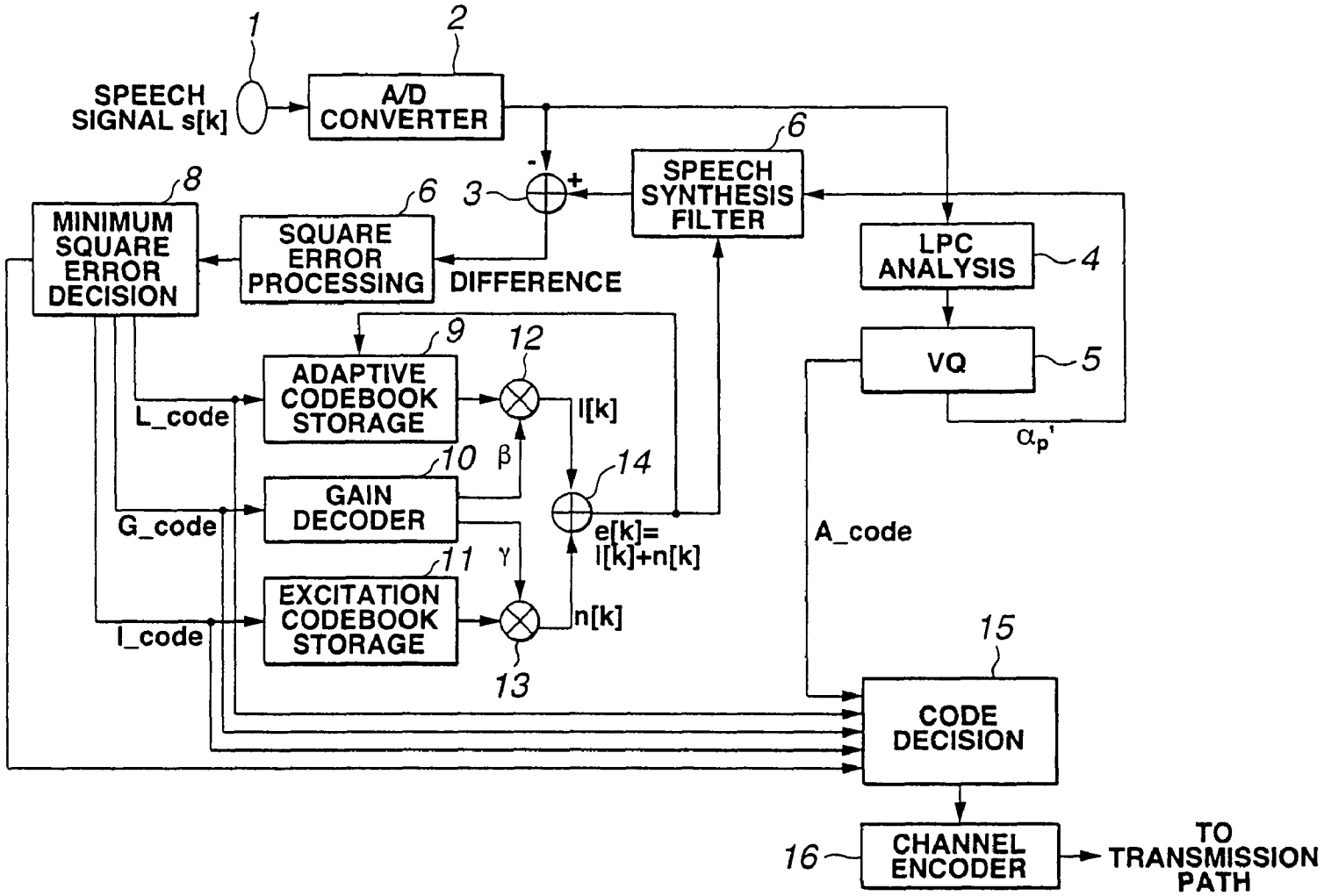
FIG. 1 is a block diagram showing a typical transmitter forming a conventional portable telephone receiver.

Referring to the drawings, certain preferred embodiments of the present invention will be explained in detail.

Figure 3:
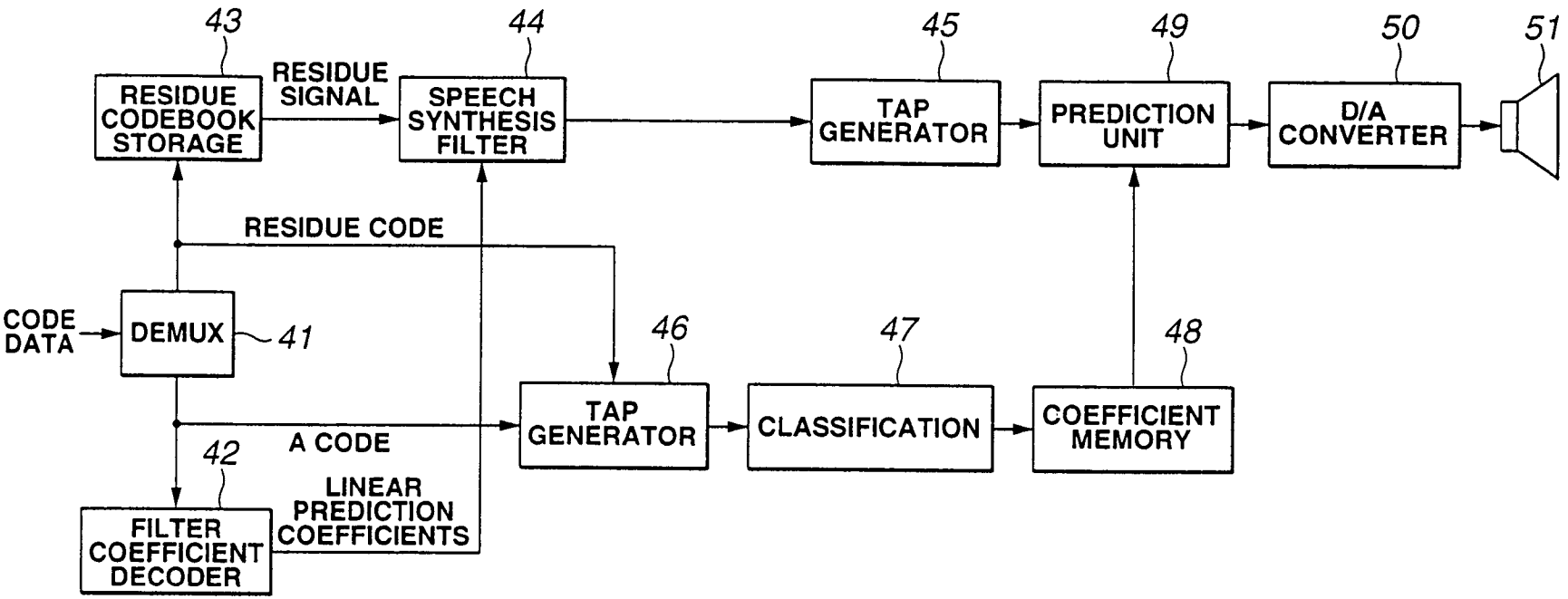
FIG. 3 is a block diagram showing a speech synthesis device embodying the present invention.

The speech synthesis device, embodying the present invention, is configured as shown in FIG. 3, and is fed with code data obtained on multiplexing the residual code and the A code obtained in turn respectively on coding residual signals and linear prediction coefficients, to be supplied to a speech synthesis filter 44, by vector quantization. From the residual code and the A code, the residual signals and linear prediction coefficients are decoded, respectively, and fed to the speech synthesis filter 44, to generate the synthesized sound. The speech synthesis device executes predictive calculations, using the synthesized sound produced by the speech synthesis filter 44 and also using tap coefficients as found on learning, to find the high quality synthesized speech, that is the synthesized sound with improved sound quality.

With the speech synthesis device of the present invention, shown in FIG. 3, classification adaptive processing is used to decode the synthesized speech to high quality true speech, more precisely predicted values thereof.

The classification adaptive processing is comprised of classification and adaptive and processing. By the classification, the data is classified depending on its characteristics and subjected to class-based adaptive processing. The adaptive processing uses the following technique:

That is, the adaptive processing finds predicted values of the true speech of high sound quality by, for example, the linear combination of the synthesized speech and preset tap coefficients.

Specifically, it is now contemplated to find predicted values E[y] of the high quality speech as teacher data, using, as teacher data, the speech of the true speech of high quality, more precisely the samples values thereof, and also using, as pupil data, the synthesized speech obtained on coding the true speech of high quality into the L code, G code, I code and the A code, in accordance with the CELP system, and subsequently on decoding these codes by the receiver shown in FIG. 2, by a model of one-dimensional linear combination defined by a set of synthesized sounds, more precisely sample values thereof, that is $x_1, x_2, \ldots$, and a linear combination of preset tap coefficients $w_1, w_2, \ldots$. It is noted that the prediction value E[y] may be represented by the following equation:

$$E[y]=w_1x_1+w_2x_2+\ldots \quad (6).$$

If, for generalizing the equation (6), a matrix W formed by a set of tap coefficients $w_j$, a matrix X formed by a set of pupil data $x_{ij}$ and a matrix Y' formed by a set of prediction values $E[y_i]$ are defined as:

$$X = \begin{bmatrix} x_{11} & x_{12} & \cdots & x_{iJ} \\ x_{21} & x_{22} & \cdots & x_{2J} \\ \cdots & \cdots & \cdots & \cdots \\ x_{I1} & x_{I2} & \cdots & x_{IJ} \end{bmatrix}$$

$$W = \begin{bmatrix} w_1 \\ w_2 \\ \cdots \\ w_J \end{bmatrix}, Y' = \begin{bmatrix} E[y_1] \\ E[y_2] \\ \cdots \\ E[y_1] \end{bmatrix}$$

the following observation equation:

$$XW=Y' \tag{7}$$

holds.

It is noted that the component $x_{ij}$ of the matrix X denotes the column number j of pupil data in the set of the number i row of pupil data (set of pupil data used in predicting teacher data $y_i$ of the number i row of teacher data) and that the component $w_j$ of the matrix W denotes the tap coefficient a product of which with the number j column of pupil data in the set of pupil data is to be found. It is also noted that $y_i$ denotes the number i row of teacher data and hence $E[y_i]$ denotes the predicted value of the number i row of teacher data. It is also noted that a suffix i of the component $y_i$ of the matrix Y is omitted from y on the left side of the equation (6) and that a suffix i is similarly omitted from the component $x_{ij}$ of the matrix X.

It is now contemplated to apply the least square method to this observation equation to find a predicted value E[y] close to the true sound y of high quality. If the matrix Y formed by a set of speech y of high sound quality as teacher data and the matrix E formed by a set of residual signals e of the prediction values E[y] for the speech y of high sound quality are defined by:

$$E = \begin{bmatrix} e_1 \\ e_2 \\ \cdots \\ e_T \end{bmatrix}, Y = \begin{bmatrix} y_1 \\ y_2 \\ \cdots \\ y_T \end{bmatrix}$$

the following residual equation:

$$XW=Y+E \tag{8}$$

holds from the equation (7).

In this case, the tap coefficients $w_j$ for finding the prediction value E[y] close to the true speech of high sound quality y may be found by minimizing the square error $$\sum_{i=I}^{I} e_i^2$$

The tap coefficients for the case when the above square error, differentiated with the tap coefficient $w_j$, is equal to zero, that is the tap coefficient $w_j$ satisfying the following equation:

$$e_1 \frac{\partial e_1}{\partial w_j} + e_2 \frac{\partial e_2}{\partial w_j} + \cdots + e_I \frac{\partial e_I}{\partial w_J} = 0 (j = 1, 2, \cdots J)$$

represents an optimum value for finding the predicted value E[y] close to the true speech y of high sound quality.

First, the equation (8) is differentiated with respect to the tap coefficient $w_j$ to obtain the following equation:

$$\frac{\partial e_i}{\partial w_1} = xi_1, \frac{\partial e_2}{\partial w_2} = x_{i2}, \cdots, \frac{\partial e_i}{\partial w_J} = x_{iJ} (i = 1, 2 \cdots I). \tag{10}$$

From the equations (9) and (10), the following equation (11):

$$\sum_{i=1}^{I} e_i x_{i1} = 0, \sum_{i=1}^{I} e_i x_{i2} = 0, \cdots, \sum_{i=1}^{In} e_i x_{ij} = 0 \tag{11}$$

is obtained.

Taking into account the relationships among pupil data $x_{ij}$, tap coefficients $w_j$, teacher data $y_i$ and errors $e_i$, in the residual equation (8), the following normal equations:

$$\begin{cases} \left(\sum_{i=1}^{I} X_{iJ} X_{i1}\right) W_1 + \left(\sum_{i=1}^{I} X_{i1} X_{i2}\right) W_2 + \cdots + \\ \quad \left(\sum_{i=1}^{I} X_{i1} X_{iJ}\right) W_J = \left(\sum_{i=1}^{I} X_{i1} Y_i\right) \\ \left(\sum_{i=1}^{I} X_{i2} X_{i1}\right) W_1 + \left(\sum_{i=1}^{I} X_{i2} X_{i2}\right) W_2 + \cdots + \\ \quad \left(\sum_{i=1}^{I} X_{i2} X_{iJ}\right) W_J = \left(\sum_{i=1}^{I} X_{i2} Y_i\right) \\ \cdots \\ \left(\sum_{i=1}^{I} X_{iJ} X_{i1}\right) W_1 + \left(\sum_{i=1}^{I} X_{iJ} X_{i2}\right) W_2 + \cdots + \\ \quad \left(\sum_{i=1}^{I} X_{iJ} X_{iJ}\right) W_J = \left(\sum_{i=1}^{I} X_{iJ} Y_i\right) \end{cases} \tag{12}$$

is obtained.

If the matrix (co-variance matrix) A and the vector v are defined by:

$$A = \begin{bmatrix} \sum_{i=1}^{I} X_{i1} X_{i1} & \sum_{i=1}^{I} X_{i1} X_{i2} & \cdots & \sum_{i=1}^{I} X_{i1} X_{iJ} \\ \sum_{i=1}^{I} X_{i2} X_{i1} & \sum_{i=1}^{I} X_{i2} X_{i2} & \cdots & \sum_{i=1}^{I} X_{i2} X_{iJ} \\ \sum_{i=1}^{I} X_{iJ} X_{i1} & \sum_{i=1}^{I} X_{iJ} X_{i2} & \cdots & \sum_{i=1}^{I} X_{iJ} X_{iJ} \end{bmatrix}$$

-continued $$v = \begin{pmatrix} \sum_{i=1}^{I} X_{i1} Y_i \\ \sum_{i=1}^{I} X_{i2} Y_i \\ \vdots \\ \sum_{i=1}^{I} X_{iJ} Y_i \end{pmatrix}$$

and the vector W is defined as shown in the equation 1, the normal equation shown by the equation (12) may be expressed as:

$$AW=v \quad (13)$$

A number the normal equations equal to the number J of the tap coefficients $w_j$ to be found may be established as the normal equations of (12) by providing a certain number of sets of the pupil data $x_{ij}$ and teacher data $y_i$. Consequently, optimum tap coefficients, herein the tap coefficients that minimize the square error, may be found by solving the equation (13) with respect to the vector W. However, it is noted that, for solving the equation (13), the matrix A in the equation (13) needs to be regular, and that e.g., a sweep-out method (Gauss-Jordan's erasure method) may be used in the process for the solution.

It is the adaptive processing that finds the optimum tap coefficients $w_j$ and uses the so found optimum tap coefficients $w_j$ to find the prediction value E[y] close to the true speech of the high quality y using the equation (6).

If the speech signal sampled at a high sampling frequency, or speech signals employing a larger number of allocated bits, are used as teacher data, while the synthesized sound, obtained on decoding an encoded version by the CELP system of speech signals, obtained in turn on decimation or re-quantization employing a smaller number of bits of speech signals as the teacher data, is used as pupil data, such tap coefficients are used which will give the speech of high sound quality which statistically minimizes the prediction error in generating the speech signals sampled at a high sampling frequency, or speech signals employing a larger number of allocated bits. In this case, the synthesized speech of high sound quality may be produced.

In the speech synthesis device, shown in FIG. 3, code data, comprised of the A code and the residual code, may be decoded to the high sound quality speech by the above-described classification adaptive processing.

That is, a demultiplexer (DEMUX) 41, supplied with code data, separates frame-based A code and the residual code from code data supplied thereto. The demultiplexer 41 routes the A code to a filter coefficient decoder 42 and to a tap generator 46, while supplying the residual code to a residual codebook storage unit 43 and to a tap generator 46.

It is noted that the A code and the residual code, contained in the code data in FIG. 3, are the codes obtained on vector quantization, with a preset codebook, of the linear prediction coefficients and the residual signals obtained on LPC speech analysis.

The filter coefficient decoder 42 decodes the frame-based A code, supplied thereto from the demultiplexer 41, into linear prediction coefficients, based on the same codebook as that used in obtaining the A code, to supply the so decoded signals to a speech synthesis filter 44.

The residual codebook storage unit 43 decodes the frame-based residual code, supplied from the demultiplexer 41, into residual signals, based on the same codebook as that used in obtaining the residual code, to send the so decoded signals to a speech synthesis filter 44.

Similarly to, for example, the speech synthesis filter 29 shown in FIG. 1, the speech synthesis filter 44 is an IIR type digital filter, and proceeds to filtering the residual signals from the residual codebook storage unit 43, as input signals, using the linear prediction coefficients from the filter coefficient decoder 42 as tap coefficients of the IIR filter, to generate the synthesized sound, which then is routed to a tap generator 45.

From sampled values of the synthesized speech, supplied from the speech synthesis filter 44, the tap generator 45 extracts what is to be prediction taps used in prediction calculations in a prediction unit 49 which will be explained subsequently. That is, the tap generator 45 uses, as prediction taps, the totality of sampled values of the synthesized sound of a frame of interest, that is a frame the prediction values of the high quality speech of which are being found. The tap generator 45 routes the prediction taps to a prediction unit 49.

The tap generator 46 extracts what are to become class taps from the frame- or subframe-based A code and residual code, supplied from the demultiplexer 41. That is, the tap generator 46 renders the totality of the A code and the residual code the class taps, and routes the class taps to a classification unit 47.

The pattern for constituting the prediction tap or class tap is not limited to the aforementioned pattern.

Meanwhile, the tap generator 46 is able to extract the class taps not only from the A and residual codes, but also from the linear prediction coefficients, output by the filter coefficient decoder 42, residual signals output by the residual codebook storage unit 43 and from the synthesized sound output by the speech synthesis filter 44.

Based on the class taps from the tap generator 46, the classification unit 47 classifies the speech, more precisely sampled values of the speech, of the frame of interest, and outputs the resulting class code corresponding to the so obtained class to a coefficient memory 48.

It is possible for the classification unit 47 to output a bit string itself forming the A code and the residual code of the frame of interest as the class tap.

The coefficient memory 48 holds class-based tap coefficients, obtained on carrying out the learning in the learning device of FIG. 6, which will be explained subsequently. The coefficient memory 48 outputs the tap coefficients stored in an address associated with the class code output by the classification unit 47 to the prediction unit 49.

If N samples of high sound quality are found for each frame, N sets of tap coefficients are required in order to find N speech samples for the frame of interest by the predictive calculations of the equation (6). Thus, in the present case, N sets of tap coefficients are stored in the coefficient memory 48 for the address associated with one class code.

The prediction unit 49 acquires the prediction taps output by the tap generator 45 and the tap coefficients output by the coefficient memory 48 and, using the prediction taps and tap coefficients, performs linear predictive calculations (sum of product calculations) shown in the equation (6) to find predicted values of the high sound quality speech of the frame of interest to output the resulting values to a D/A converter 50.

The coefficient memory 48 outputs N sets of tap coefficients for finding N samples of the speech of the frame of interest, as described above. Using the prediction taps of the respective samples and the set of tap coefficients corresponding to the sampled values, the prediction unit 49 carries out the sum-of-product processing of the equation (6).

The D/A converter 50 D/A converts the speech, more precisely predicted values of the speech, from the prediction unit 49, from digital signals into corresponding analog signals, to send the resulting signals to the loudspeaker 51 as output.

Figure 4:
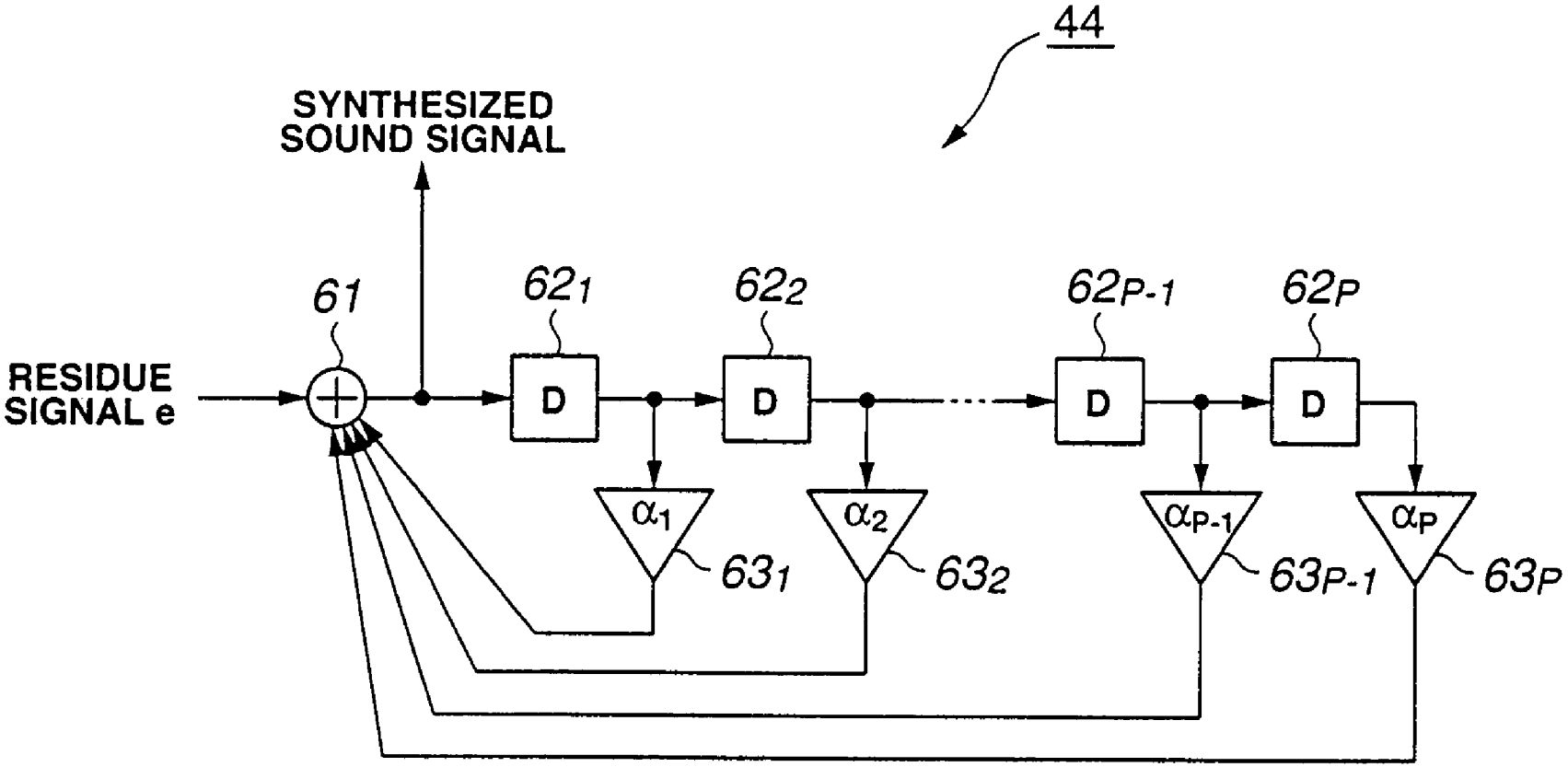
FIG. 4 is a block diagram showing a speech synthesis filter forming the speech synthesis device.

FIG. 4 shows an illustrative structure of the speech synthesis filter 44 shown in FIG. 3.

In FIG. 4, the speech synthesis filter 44 uses p-dimensional linear prediction coefficients and is made up of a sole adder 61, P delay circuits (D) $\mathbf{62}_1$ to $\mathbf{62}_P$ and P multipliers $\mathbf{63}_1$ to $\mathbf{63}_P$.

In the multipliers $\mathbf{63}_1$ to $\mathbf{63}_P$ are set P-dimensional linear prediction coefficients $\alpha_1, \alpha_2, \ldots, \alpha_p$, sent from the filter coefficient decoder 42, respectively, whereby the speech synthesis filter 44 carries out the calculations in accordance with the equation (4) to generate the synthesized sound.

That is, the residual signals e, output by the residual codebook storage unit 43, are sent via adder 61 to the delay circuit 62*p*, which delay circuit 62*p* delays the input signal thereto by one sample of the residual signals to output the delayed signal to a downstream side delay circuit $\mathbf{62}_{p+1}$ and to the multiplier 63*p*. This multiplier 63*p* multiplies the output of the delay circuit 62*p* with the linear prediction coefficients $\alpha_p$ stored therein to output the resulting product to the adder 61.

The adder 61 adds all outputs of the multipliers $\mathbf{63}_1$ to $\mathbf{63}_p$ and the residual signals e and sums the result of the addition to the delay circuit $\mathbf{62}_1$ while outputting it as being the result of speech synthesis (synthesized sound).

Figure 5:
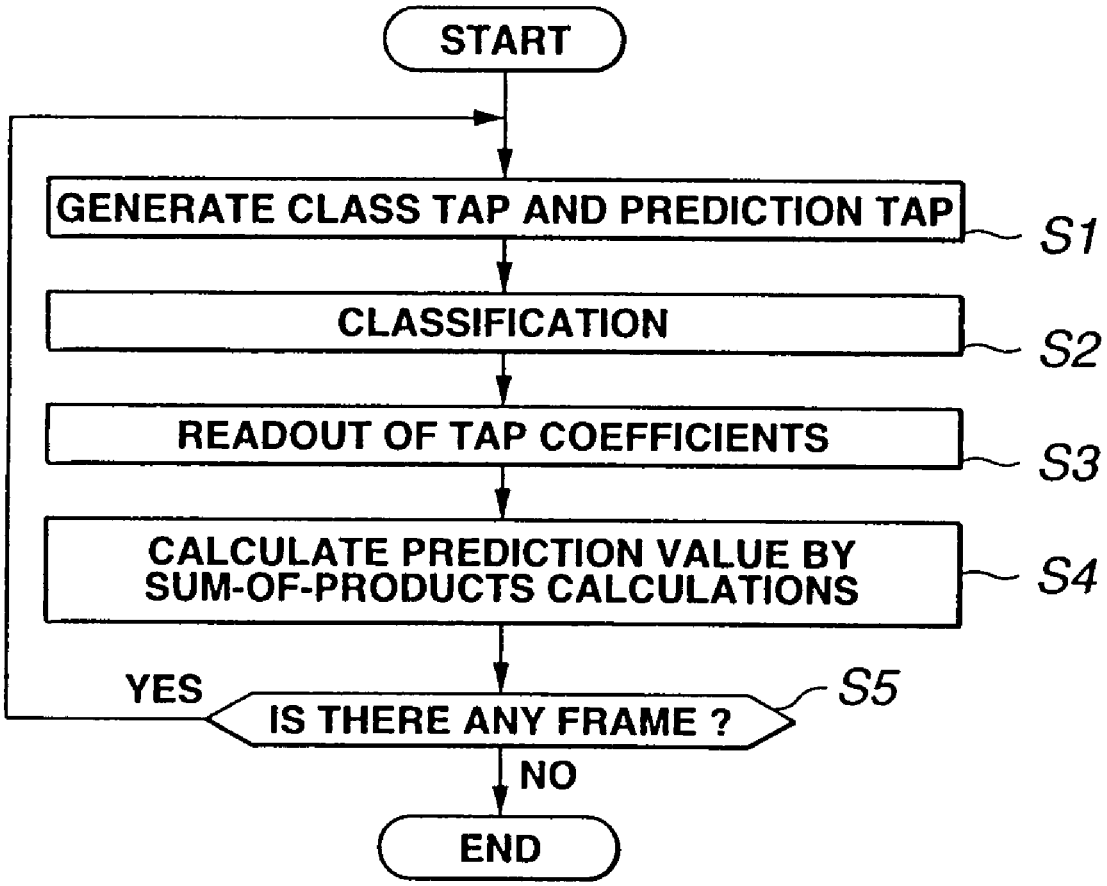
FIG. 5 is a flowchart for illustrating the processing of a speech synthesis device shown in FIG. 3.

Referring to the flowchart of FIG. 5, the speech synthesis of the speech synthesis device of FIG. 3 is now explained.

The demultiplexer 41 sequentially separates frame-based A code and residual code to send the separated codes to the filter coefficient decoder 42 and to the residual codebook storage unit 43. The demultiplexer 41 sends the A code and the residual code to the tap generator 46.

The filter coefficient decoder 42 sequentially decodes the frame-based A code, supplied thereto from the demultiplexer 41, to send the resulting decoded coefficients to the speech synthesis filter 44. The residual codebook storage unit 43 sequentially decodes the frame-based residual codes, supplied from the demultiplexer 41, into residual signals, which are then sent to the speech synthesis filter 44.

Using the residual signal and the linear prediction coefficients, supplied thereto, the speech synthesis filter 44 carries out the processing in accordance with the equation (4) to generate the synthesized speech of the frame of interest. This synthesized sound is sent to the tap generator 45.

The tap generator 45 sequentially renders the frame of the synthesized sound, sent thereto, a frame of interest and, at step S1, generates prediction taps from sample values of the synthesized sound supplied from the speech synthesis filter 44, to output the so generated prediction taps to the prediction unit 49. At step S1, the tap generator 46 generates the class taps from the A code and the class taps from the A code and the residual code supplied from the demultiplexer 41 to output the so generated class taps to the classification unit 47.

At step S2, the classification unit 47 carries out the classification, based on the class taps, supplied from the tap generator 46, to send the resulting class codes to the coefficient memory 48. The program the moves to step S3.

At step S3, the coefficient memory 48 reads out the tap coefficients, supplied from the address corresponding to the class codes supplied from the classification unit 47, to send the resulting tap coefficients to the prediction unit 49.

The program then moves to step S4 where the prediction unit 49 acquires tap coefficients output by the coefficient memory 48 and, using the tap coefficients and the prediction taps from the tap generator 45, carries out the sum-of-product processing shown in the equation (6) to produce predicted values of the high sound quality speech of the frame of interest. The high sound quality speech is sent to and output from the loudspeaker 51 via prediction unit 49 and D/A converter 50.

If the speech of the high sound quality of the frame of interest has been acquired at the prediction unit 49, the program moves to step S5 where it is verified whether or not there is any frame to be processed as the frame of interest. If it is verified that there is still a frame to be processed as the frame of interest, the program reverts to step S1 and repeats similar processing with the frame to be the next frame of interest as a new frame of interest. If it is verified at step S5 that there is no frame to be processed as the frame of interest, the speech synthesis processing is terminated.

Figure 6:
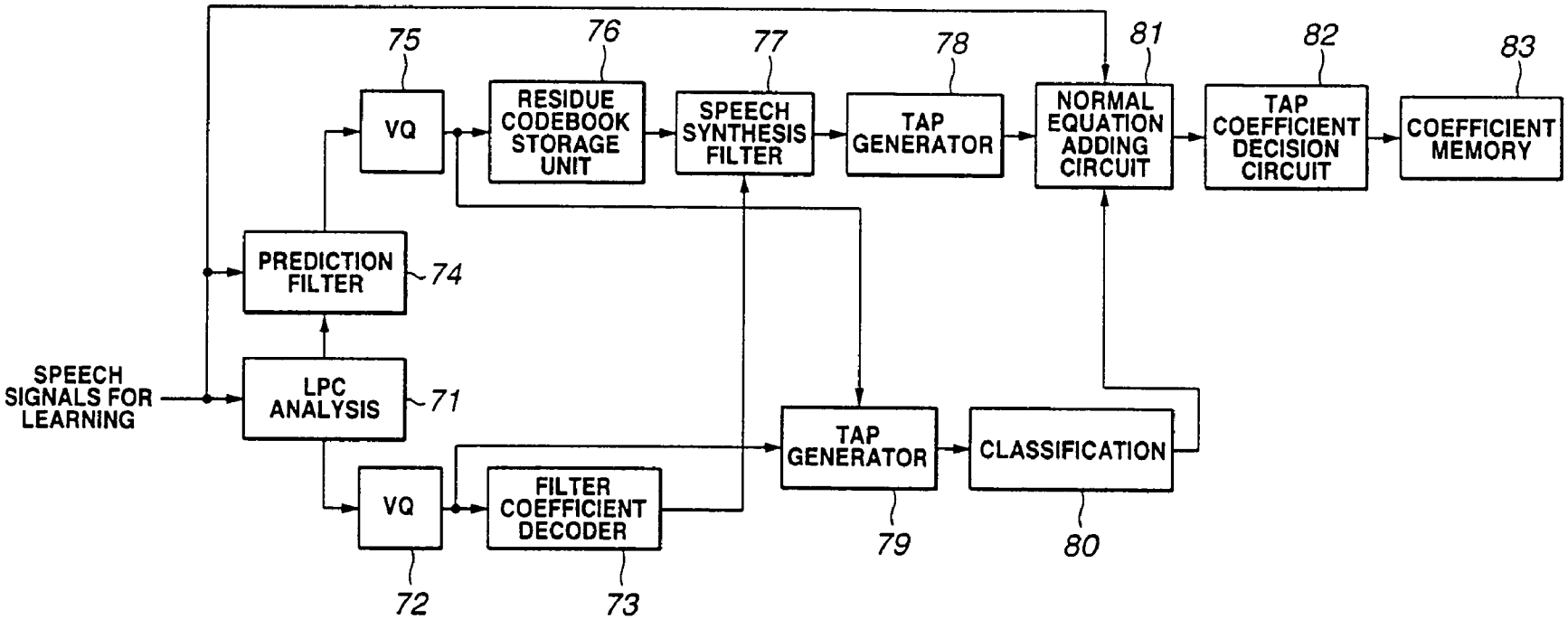
FIG. 6 is a block diagram showing a learning device embodying the present invention

Referring to FIG. 6, an instance of a learning device for effecting the learning processing of the tap coefficients to be stored in the coefficient memory 48 of FIG. 3 is now explained.

The learning device shown in FIG. 6 is supplied with digital speech signals for learning, from one preset frame to another. These digital speech signals for learning are sent to an LPC analysis unit 71 and to a prediction filter 74. The digital speech signals for learning are also supplied as teacher data to a normal equation addition circuit 81.

The LPC analysis unit 71 sequentially renders the frame of the speech signals, supplied thereto, a frame of interest, and LPC-analyzes the speech signals of the frame of interest to find p-dimensional linear prediction coefficients which are then sent to the prediction filter 74 and to a vector quantizer 72.

The vector quantizer 72 holds a codebook, associating the code vectors, having linear prediction coefficients as components, with the codes Based on the codebook, the vector quantizer 72 vector-quantizes the feature vectors, constituted by the linear prediction coefficients of the frame of interest from the LPC analysis unit 71, and sends the A code, obtained as a result of the vector quantization, to a filter coefficient decoder 73 and to a tap generator 79.

The filter coefficient decoder 73 holds the same codebook as that held by the vector quantizer 72 and, based on the codebook, decodes the A code from the vector quantizer 72 into linear prediction coefficients which are routed to a speech synthesis filter 77. The filter coefficient decoder 42 of FIG. 3 is constructed similarly to the filter coefficient decoder 73 of FIG. 6.

The prediction filter 74 carries out the processing, in accordance with the aforementioned equation (1), using the speech signals of the frame of interest, supplied thereto, and the linear prediction coefficients from the LPC analysis unit 71, to find the residual signals of the frame of interest, which then are sent to vector quantizer 75.

If the Z-transforms of $s_n$ and $e_n$ in the equation (1) are expressed as S and E, respectively, the equation (1) may be represented by the following equation:

$$E=(1+\alpha_1 z^{-1}+\alpha_2 z^{-2}+\ldots+\alpha_P z^{-P})S. \tag{14}$$

The prediction filter 74 for finding the residual signal e from the equation (14) may be constructed as a digital filter of the FIR (finite impulse response) type.

Figure 7:
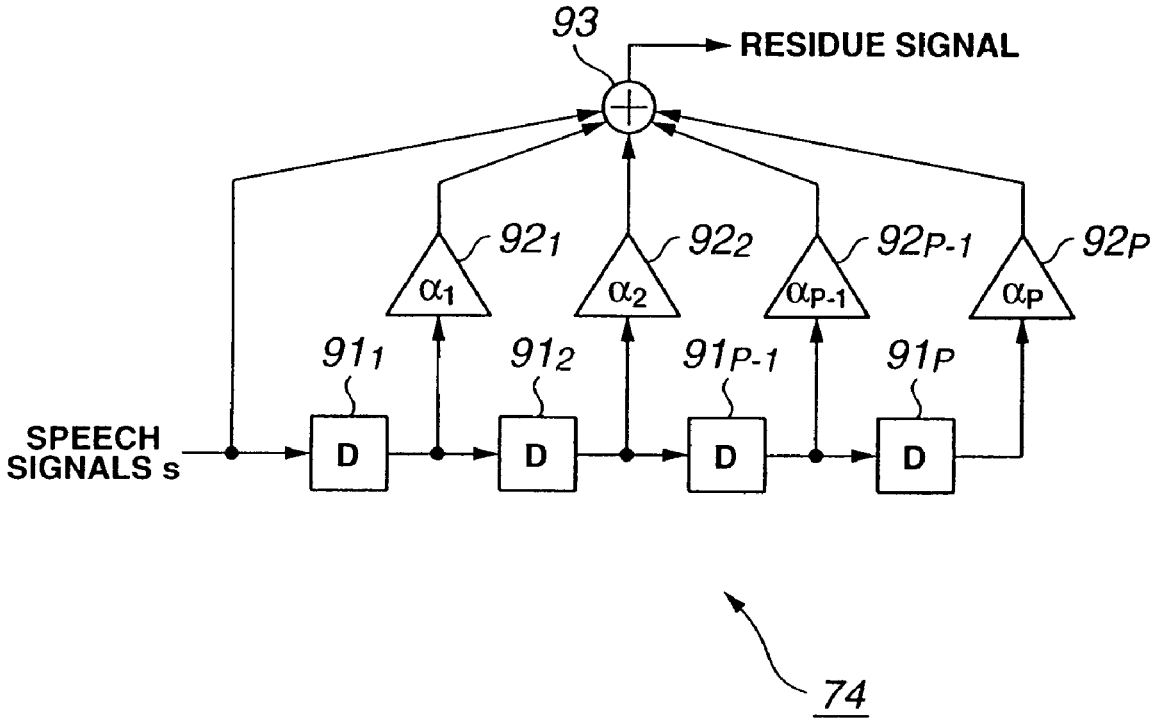
FIG. 7 is a block diagram showing a prediction filter forming the learning device according to the present invention.

FIG. 7 shows an illustrative structure of the prediction filter 74.

The prediction filter 74 is fed with p-dimensional linear prediction coefficients from the LPC analysis unit 71, so that the prediction filter 74 is made up of p delay circuits D $\mathbf{91}_1$ to $\mathbf{91}_p$, p multipliers $\mathbf{92}_1$ to $\mathbf{92}_p$ and one adder 93.

In the multipliers $\mathbf{92}_1$ to $\mathbf{92}_p$ are set p-dimensional linear prediction coefficients $\alpha_1, \alpha_2, \ldots, \alpha_p$ supplied from the LPC analysis unit 71.

On the other hand, the speech signals s of the frame of interest are sent to a delay circuit $\mathbf{91}_1$ and to an adder 93. The delay circuit $\mathbf{91}_p$ delays the input signal thereto by one sample of the residual signals to output the delayed signal to the downstream side delay circuit $\mathbf{91}_{p+1}$ and to the operating unit $\mathbf{92}_p$. The multiplier $\mathbf{92}_p$ multiplies the output of the delay circuit $\mathbf{91}_p$ with the linear prediction coefficients, stored therein, to send the resulting product value to the adder 93.

The adder 93 sums all of the outputs of the multipliers $\mathbf{92}_1$ to $\mathbf{92}_p$ to the speech signals s to send the results of addition as the residual signals e.

Returning to FIG. 6, the vector quantizer 75 holds a codebook, associating sample values of the residual signals as components, with the codes. Based on this codebook, residual vectors formed by the sample values of the residual signals of the frame of interest, from the prediction filter 74, are vector quantized, and the residual codes, obtained as a result of the vector quantization, are sent to a residual codebook storage unit 76 and to the tap generator 79.

The residual codebook storage unit 76 holds the same codebook as that held by the vector quantizer 75 and, based on the codebook, decodes the residual code from the vector quantizer 75 into residual signals which are routed to the speech synthesis filter 77. The residual codebook storage unit 43 of FIG. 3 is constructed similarly to the residual codebook storage unit 76 of FIG. 6.

A speech synthesis filter 77 is an IIR filter constructed similarly to the speech synthesis filter 44 of FIG. 3, and filters the residual signal from the residual signal storage unit 75 as an input signal, with the linear prediction coefficients from the filter coefficient decoder 73 as tap coefficients of the IIR filter, to generate the synthesized sound, which then is routed to a tap generator 78.

Similarly to the tap generator 45 of FIG. 3, the tap generator 78 forms prediction taps from the linear prediction coefficients, supplied from the speech synthesis filter 77 to send the so formed prediction taps to the normal equation addition circuit 81. Similarly to the tap generator 46 of FIG. 3, the tap generator 79 forms class taps from the A code and the residual code, sent from the vector quantizers 72 to 75, to send the class taps to a classification unit 80.

Similarly to the classification unit 47 of FIG. 3, the classification unit 80 carries out the classification, based on the class taps, supplied thereto, to send the resulting class codes to the normal equation addition circuit 81.

The normal equation addition circuit 81 sums the speech for learning, which is the high sound quality speech of the frame of interest, as teacher data, to an output of the synthesized sound from the speech synthesis filter 77 forming the prediction taps as pupil data from the tap generator 78.

Using the prediction taps (pupil data), supplied from the classification unit 80, the normal equation addition circuit 81 carries out the reciprocal multiplication of the pupil data, as components in a matrix A of the equation (13) ($x_{in}x_{im}$), and operations equivalent to summation ($\Sigma$).

Using the pupil data, that is sampled values of the synthesized sound output from the speech synthesis filter 77, and teacher data, that is sampled values of the high sound quality speech of the frame of interest, the normal equation addition circuit 81 carries out the processing equivalent to multiplication ($x_{in}y_i$), and summation ($\Sigma$) of the pupil data and the teacher data, as components in the vector v of the equation (13), for each class corresponding to the class code supplied from the classification unit 80.

Figure 13:
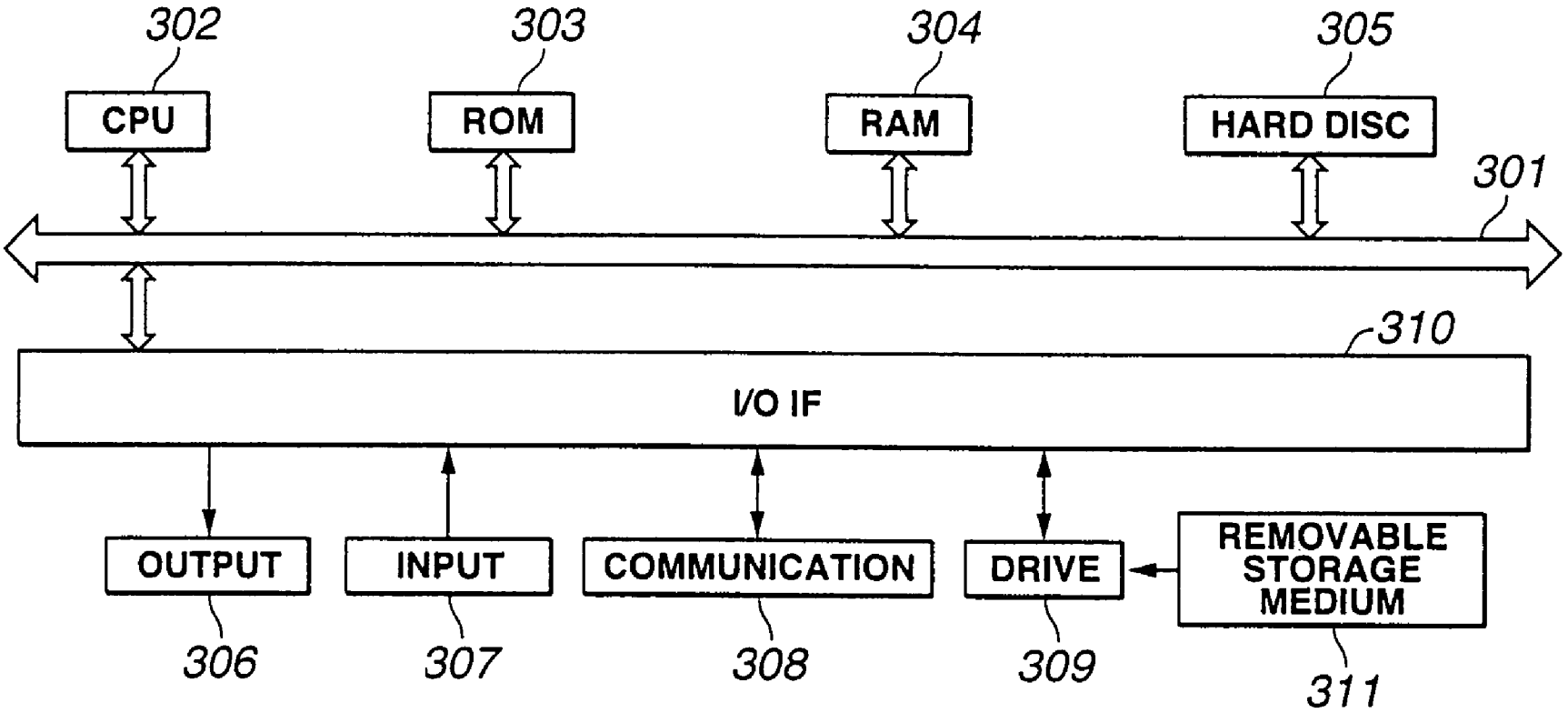
FIG. 13 is a block diagram showing a typical structure of a computer embodying the present invention.

The normal equation addition circuit 81 carries out the above summation, using all of the speech frames for learning, supplied thereto, to establish the normal equation, shown in FIG. 13, for each class.

A tap coefficient decision circuit 82 solves the normal equation, generated in the normal equation addition circuit 81, from class to class, to find tap coefficients for the respective classes. The tap coefficients, thus found, are sent to the address associated with each class of the memory 83.

Depending on the speech signals, provided as speech signals for learning, there are occasions wherein, in a class or classes, a number of the normal equations required to find tap coefficients cannot be produced in the normal equation addition circuit 81. For such class(es), the tap coefficient decision circuit 82 outputs default tap coefficients.

The coefficient memory 83 memorizes the class-based tap coefficients, supplied from the tap coefficient decision circuit 82, in an address associated with the class.

Figure 8:
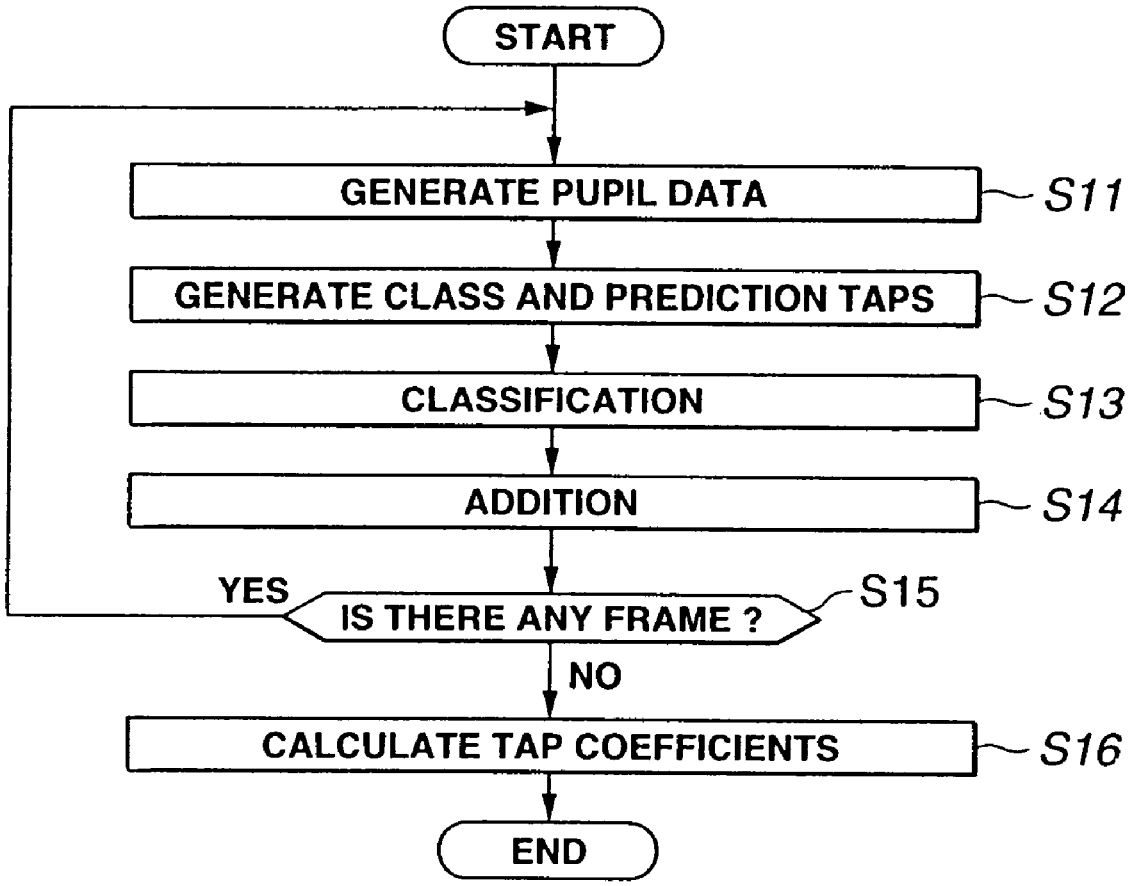
FIG. 8 is a flowchart for illustrating the processing by the learning device of FIG. 6.

Referring to the flowchart of FIG. 8, the learning processing by the learning device of FIG. 6 is now explained.

The learning device is fed with speech signals for learning, which are sent to both the LPC analysis unit 71 and to the prediction filter 74, while being sent as teacher data to the normal equation addition circuit 81. At step S11, pupil data are generated from the speech signals for learning.

That is, the LPC analysis unit 71 sequentially renders the frames of the speech signals for learning the frames of interest and LPC-analyzes the speech signals of the frames of interest to find p-dimensional linear prediction coefficients which are sent to the vector quantizer 72. The vector quantizer 72 vector-quantizes the feature vectors formed by the linear prediction coefficients of the frame of interest, from the LPC analysis unit 71, and sends the A code resulting from the vector quantization to the filter coefficient decoder 73 and to the tap generator 79. The filter coefficient decoder 73 decodes the A code from the vector quantizer 72 into linear prediction coefficients which are sent to the speech synthesis filter 77.

On the other hand, the prediction filter 74, which has received the linear prediction coefficients of the frame of interest from the LPC analysis unit 71, carries out the processing of the equation (1), using the linear prediction coefficients and the speech signals for learning of the frame of interest, to find the residual signals of the frame of interest to send the so found residual signals to the vector quantizer 75. The vector quantizer 75 vector-quantizes the residual vector formed by the sample values of the residual signals of the frame of interest from the prediction filter 74 to send the residual code obtained on vector quantization to the residual codebook storage unit 76 and to the tap generator 79. The residual codebook storage unit 76 decodes the A code from the vector quantizer 75 into linear prediction coefficients which are then supplied to the speech synthesis filter 77.

On receipt of the linear prediction coefficients and the residual signals, the speech synthesis filter 77 performs speech synthesis, using the linear prediction coefficients and the residual signals, to output the resulting synthesized signals as pupil data to the tap generator 78.

The program then moves to step S12 where the tap generator 78 generates prediction taps from the synthesized sound supplied from the speech synthesis filter 77, while the tap generator 79 generates class taps from the code A from the vector quantizer 72 and from the residual code from the vector quantizer 75. The prediction taps are sent to the normal equation addition circuit 81, whilst the class taps are routed to the classification unit 80.

At step S13, the classification unit 80 then performs classification based on the class taps from the tap generator 79 to route the resulting class code to the normal equation addition circuit 81.

The program then moves to step S14 where the normal equation addition circuit 81 carries out the aforementioned addition to the matrix A and the vector v of the equation (13), for the sample values of the speech of the high sound quality of the frame of interest as teacher data supplied thereto, and the prediction taps, more precisely the sampled values of the synthesized sound making up the prediction taps, as pupil data from the tap generator 78 for the class supplied from the classification unit 80. The program then moves to step S15.

At step S15, it is verified whether or not there are any speech signals for learning to be processed as the frame of interest. If it is verified at step S15 that there are any speech signals for learning to be processed as the frame of interest, the program reverts to step S11 to repeat the similar processing, with the sequentially next frames as the new frame of interest.

If it is found at step S15 that there is no speech signal for learning of the frame to be processed as the frame of interest, that is if a normal equation has been obtained for each class in the normal equation addition circuit 81, the program moves to step S16 where the tap coefficient decision circuit 82 solves the normal equation generated from class to class to find the tap coefficients for each class. The so found tap coefficients are sent to the address associated with each class in a coefficient memory 83 for storage therein to terminate the processing.

The class-based tap coefficients, thus stored in the coefficient memory 83, are stored in this manner in the coefficient memory 48 of FIG. 3.

Thus, since the tap coefficients stored in the coefficient memory 48 of FIG. 3 are found in this manner by carrying out the learning in such a manner that the prediction error of the prediction values of the speech of the high sound quality, that is the square error, will be statistically minimum, the speech output by the prediction unit 49 of FIG. 3 is of high sound quality in which the distortion of the synthesized sound output by the speech synthesis filter 44 has been reduced or eliminated.

Meanwhile, if, in the speech synthesis device of FIG. 3, the class taps are to be extracted by e.g., the tap generator 46 from the linear prediction coefficients or the residual signals, it is necessary to have the tap generator 79 of FIG. 6 extract the similar class taps from the linear prediction coefficients output by the filter coefficient decoder 73 and from the residual signals output by the residual codebook storage unit 76. However, if class taps are extracted even from e.g., the linear prediction coefficients, the number of the taps is increased. So, the classification preferably is to be carried out by compressing the class taps by, for example, the vector quantization. Meanwhile, if the classification is to be performed solely by the residual code and the A code, the load needed in classification processing may be relieved because the array of bit strings of the residual code and the A code can directly be used as the class code.

An instance of the transmission system embodying the present invention is explained with reference to FIG. 9. The system herein means a set of logically arrayed plural devices, while it does not matter whether or not the respective devices are in the same casing.

Figure 9:
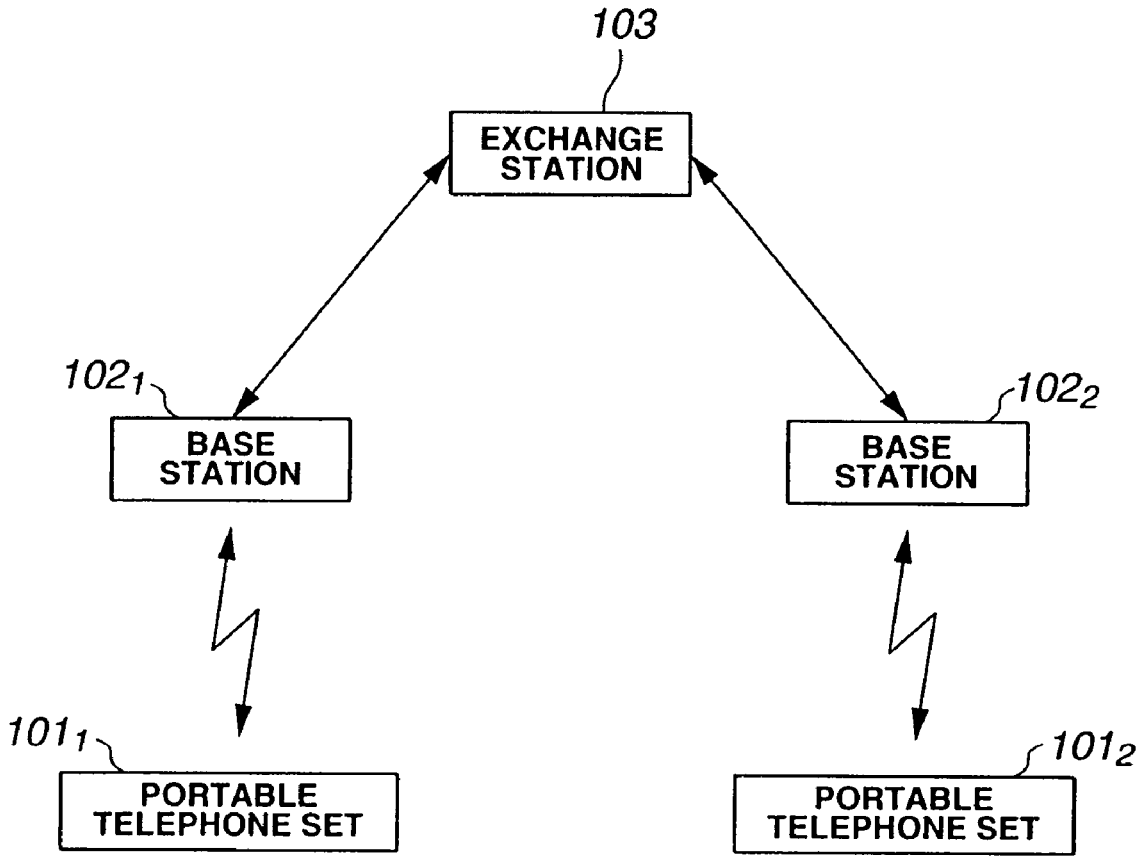
FIG. 9 is a block diagram showing a transmission system embodying the present invention.

In the transmission system shown in FIG. 9, the portable telephone sets $\mathbf{101}_1$, $\mathbf{101}_2$ perform radio transmission and receipt with base stations $\mathbf{102}_1$, $\mathbf{102}_2$, respectively, while the base stations $\mathbf{102}_1$, $\mathbf{102}_2$ perform transmission and receipt with an exchange station 103 to enable speech transmission and receipt of speech between the portable telephone sets $\mathbf{101}_1$, $\mathbf{101}_2$ with the aid of the base stations $\mathbf{102}_1$, $\mathbf{102}_2$ and the exchange station 103. The base stations $\mathbf{102}_1$, $\mathbf{102}_2$ may be the same as or different from each other.

The portable telephone sets $\mathbf{101}_1$, $\mathbf{101}_2$ are referred to below as a portable telephone set 101, unless there is specified necessity for making distinction between the sets.

Figure 10:
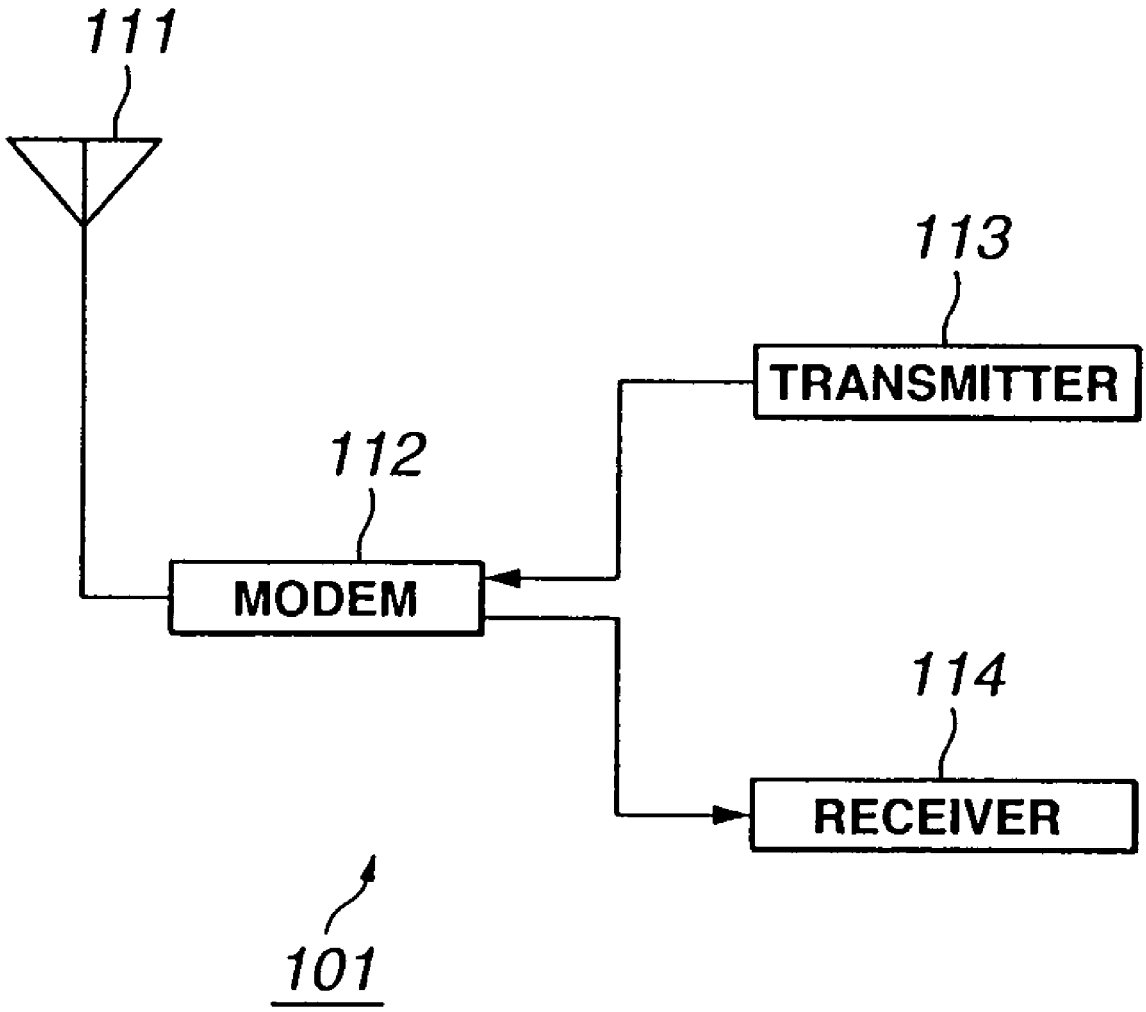
FIG. 10 is a block diagram showing a portable telephone set embodying the present invention.

FIG. 10 shows an illustrative structure of the portable telephone set 101 shown in FIG. 9.

An antenna 111 receives electrical waves from the base stations $\mathbf{102}_1$, $\mathbf{102}_2$ to send the received signals to a modem 112 as well as to send the signals from the modem 112 to the base stations $\mathbf{102}_1$, $\mathbf{102}_2$ as electrical waves. The modem 112 demodulates the signals from the antenna 111 to send the resulting code data explained with reference to FIG. 1 to a receipt unit 114. The modem 112 also is configured for modulating the code data from the transmitter 113 as shown in FIG. 1 and sends the resulting modulated signal to the antenna 111. The transmitter 113 is configured similarly to the transmitter shown in FIG. 1 and codes the user's speech input thereto into code data which is supplied to the modem 112. The receipt unit 114 receives the code data from the modem 112 to decode and output the speech of high sound quality similar to that obtained in the speech synthesis device of FIG. 3.

Figure 11:
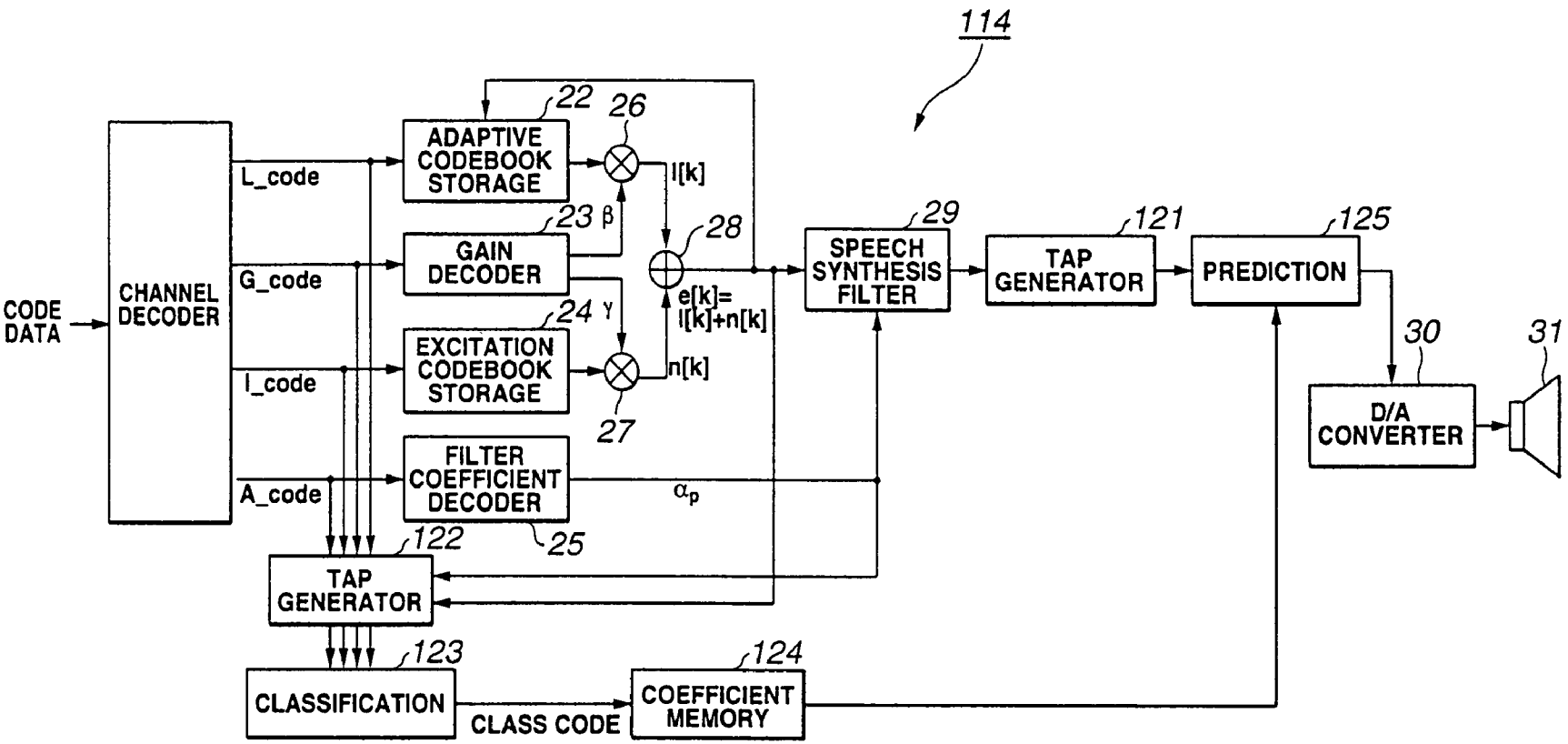
FIG. 11 is a block diagram showing a receiver forming the portable telephone set.

That is, FIG. 11 shows an illustrative structure of the receipt unit 114 of FIG. 10. In the drawing, parts or components corresponding to those shown in FIG. 2 are depicted by the same reference numerals and are not explained specifically.

A tap generator 121 is fed with the synthesized sound output by a speech synthesis unit 29. From the synthesized sound, the tap generator 121 extracts what are to be prediction taps (sampled values), which are then routed to a prediction unit 125.

A tap generator 122 is fed with frame-based or subframe-based L, G and A codes, output by a channel decoder 21. The tap generator 122 is also fed with residual signals from the operating unit 28, while also being fed with linear prediction coefficients from a filter coefficient decoder 25. The tap generator 122 generates what are to be class taps, from the L, G, I and A codes, residual signals and the linear prediction coefficients, supplied thereto, to route the extracted class taps to a classification unit 123.

The classification unit 123 carries out classification, based on the class taps supplied from the tap generator 122, to route the class codes as the being the results of the classification to a coefficient memory 124.

If the class taps are formed from the L, G, I and A codes, residual signals and the linear prediction coefficients, and classification is carried out based on these class taps, the number of the classes obtained on classification tends to be enormous. Thus, it is also possible for the classification unit 123 to output the codes, obtained on vector quantization of the vectors having the L, G, I and A codes, residual signals and the linear prediction coefficients, as components, as being the results of the classification.

The coefficient memory 124 memorizes the class-based tap coefficients, obtained on learning by the learning device of FIG. 12, as later explained, and routes the tap coefficients, stored in the address associated with the class code output by the classification unit 123, to the prediction unit 125.

Similarly to the prediction unit 49 of FIG. 3 the prediction unit 125 acquires the prediction taps, output by the tap generator 121, and tap coefficients, output by the coefficient memory 124, and performs the linear predictive calculations of the equation (6), using the prediction taps and the tap coefficients. The prediction unit 125 finds the speech of high sound quality of the frame of interest, more precisely, prediction values thereof, and performs the linear predictive calculations shown in the equation (6). In this manner, the prediction unit 125 finds the speech of high sound quality of the frame of interest, more precisely, prediction values thereof, and sends the so found out values as being the result of speech decoding to a D/A converter 30.

The receipt unit 114, designed as described above, performs the processing basically the same as the processing complying with the flowchart of FIG. 5 to output the synthesized sound of high sound quality as being the result of speech decoding.

That is, the channel decoder 21 separates the L, G, I and A codes, from the code data, supplied thereto, to send the so separated codes to the adaptive codebook storage unit 22, gain decoder 23, excitation codebook storage unit 24 and to the filter coefficient decoder 25, respectively. The L, G, I and A codes are also sent to the tap generator 122.

The adaptive codebook storage unit 22, gain decoder 23, excitation codebook storage unit 24 and the operating units 26 to 28 perform the processing similar to that performed in the adaptive codebook storage unit 9, gain decoder 10, excitation codebook storage unit 11 and in the operating units 12 to 14 of FIG. 1 to decode the L, G and I codes to residual signals e. These residual signals are routes to the speech synthesis unit 29 and to the tap generator 122.

As explained with reference to FIG. 1, the filter coefficient decoder 25 decodes the A codes, supplied thereto, into linear prediction coefficients, which are routed to the speech synthesis unit 29 an to the tap generator 122. Using the residual signals from the operating unit 28 and the linear prediction coefficients supplied from the filter coefficient decoder 25, the speech synthesis unit 29 synthesizes the speech, and sends the resulting synthesized sound to the tap generator 121.

Using a frame of the synthesized sound, output from the speech synthesis unit 29, as the frame of interest, the tap generator 121 at step S1 generates prediction taps, from the synthesized sound of the frame of interest, and sends the so generated prediction taps to the prediction unit 125. At step S1, the tap generator 122 generates class taps, from the L, G, I and A codes, residual signals and the linear prediction coefficients, supplied thereto, and sends these to the classification unit 123.

The program then moves to step S2 where the classification unit 123 carries out the classification based on the class taps sent from the tap generator 122 to send the resulting class codes to the classification unit 124. The program then moves to step S3.

At step S3, the coefficient memory 124 reads out tap coefficients, corresponding to the class codes, supplied form the classification unit 123, to send the so read out tap coefficients to the prediction unit 125.

The program moves to step S4 where the prediction unit 125 acquires tap coefficients for the residual signals output by the coefficient memory coefficient memory 124, and carries out sum-of-products processing in accordance with the equation (6), using the tap coefficients and the prediction taps from the tap generator 121, to acquire prediction values of the speech of high sound quality of the frame of interest.

The speech of high sound quality, obtained as described above, is sent from the prediction unit 125 through the D/A converter 30 to the loudspeaker 31 which then outputs the speech of the high sound quality.

After the processing at step S4, the program moves to step S5 where it is verified whether or not there is any frame to be processed as the frame of interest. If it is found that there is any such frame, the program reverts to step S1, where the similar processing is repeated with the frame to be the next frame of interest as being the new frame of interest. If it is found at step S5 that there is no frame to be processed as being the frame of interest, the processing is terminated.

Figure 12:
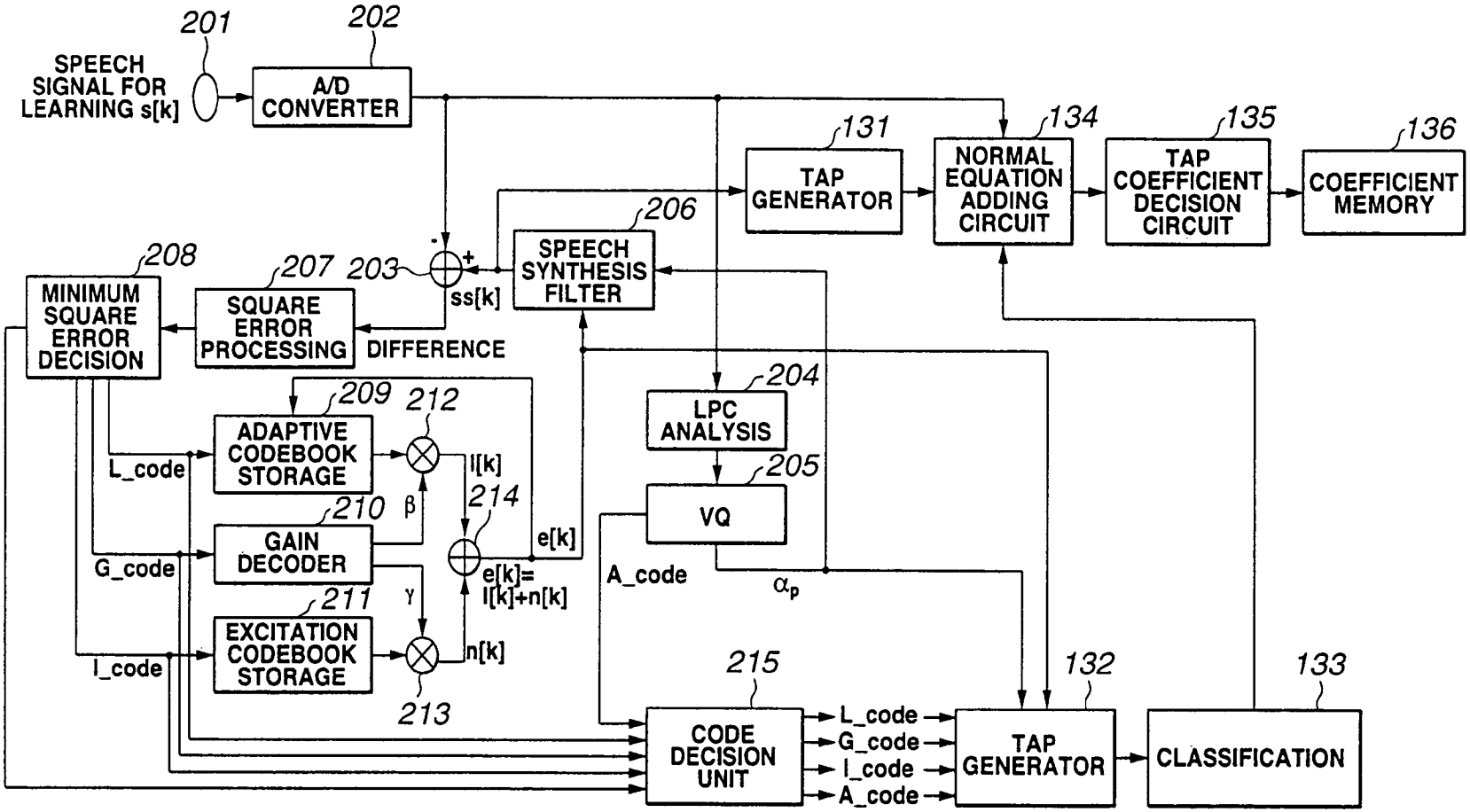
FIG. 12 is a block diagram showing a modification of the learning device embodying the present invention.

FIG. 12 shows an instance of a learning device adapted for carrying out the processing of learning tap coefficients memorized in the coefficient memory 124 of FIG. 11.

In the learning device of FIG. 12, the components from a microphone 201 to a code decision unit 215 are constructed similarly to the microphone 1 to the code decision unit 15 of FIG. 1. The microphone 1 is fed with speech signals for learning. So, the components from a microphone 201 to a code decision unit 215 perform the same processing on the speech signals for learning as that in FIG. 1.

A tap generator 131 is fed with the synthesized sound output by a speech synthesis filter 206 when a minimum square error decision unit 208 has verified the square error to be smallest. Meanwhile, a tap generator 132 is fed with the L, G, I and A codes output when the definite signal has been received by the code decision unit 215 from the minimum square error decision unit 208. The tap generator 132 is also fed with the linear prediction coefficients, as components of code vectors (centroid vectors) corresponding to the A code as the results of vector quantization of the linear prediction coefficients obtained at an LPC analysis unit 204, output by the vector quantizer 205, and with residual signals output by the operating unit 214, that prevail when the square error in the minimum square error decision unit 208 has become minimum. A normal equation summation circuit 134 is fed with speech output by an A/D converter 202 as teacher data.

From the synthesized sound, output by a speech synthesis filter 206, the tap generator 131 generates the same prediction taps as those of the tap generator 121 of FIG. 1, and routes the so generated prediction taps as pupil data to the normal equation summation circuit 134.

From the L, G, I sans A codes from the code decision unit 215, linear prediction coefficients, issued by the vector quantizer 205, from the residual signals and from the operating unit 214, the tap generator 132 forms the same class taps as those of the tap generator 122 of FIG. 11 to send the so formed class taps to the classification unit 133.

Based on the class taps from the tap generator 132, a classification unit 133 carries out the same classification as that performed by the classification unit 123 and routes the resulting class code to the normal equation summation circuit 134.

The normal equation summation circuit 134 receives the speech from the A/D converter 202 as teacher data, while receiving the prediction taps from the tap generator 131 as pupil data. The normal equation summation circuit 134 then performs the similar summation to that performed by the normal equation addition circuit 81 of FIG. 6 to establish the normal equation shown as in the equation (13) for each class.

A tap coefficient decision circuit 135 solves the normal equation, generated in the normal equation addition circuit 134 from class to class, to find tap coefficients for the respective classes. The tap coefficients, thus found, are sent to the address associated with each class of a coefficient memory 136.

Depending on the speech signals, provided as speech signals for learning, there are occasions wherein, in a class or classes, a number of the normal equations required to find tap coefficients cannot be produced in the normal equation addition circuit 134. For such class(es), the tap coefficient decision circuit 135 outputs default tap coefficients.

The coefficient memory 136 memorizes the class-based linear prediction coefficients and residual signals, supplied from the tap coefficient decision circuit 135.

The above-described learning device basically performs the processing similar to that conforming to the flowchart shown in FIG. 8 to find tap coefficients for producing the synthesized sound of high sound quality.

The learning device is fed with speech signals for learning. At step S11, teacher data and pupil data are generated from the speech signals for learning.

That is, the speech signals for learning are fed to the microphone 201. The components from the microphone 201 to the code decision unit 215 perform the processing similar to that performed by the components from the microphone 1 to the code decision unit 15 of FIG. 1.

The result is that the speech of the digital signals, obtained by the A/D converter 202, are sent as teacher data to the normal equation summation circuit 134. If it is verified that the square error has become smallest in the minimum square error decision unit 208, the synthesized sound, output by the speech synthesis filter 206, is sent as pupil data to the tap generator 131.

When the linear prediction coefficients output by the vector quantizer 205 are such that the square error as found by the minimum square error decision unit 208 is minimum, the L, G, I and A codes, output by the code decision unit 215, and the residual signals output by the operating unit 214, are sent to the tap generator 132.

The program then moves to step S12 where the tap generator 131 generates prediction taps from the synthesized sound of the frame of interest, with the frame of the synthesized sound supplied as pupil data from the speech synthesis filter 206 to send the so generated prediction taps to the normal equation summation circuit 134. At step S12, the tap generator 132 generates class taps from the L, G, I and A codes, linear prediction coefficients and the residual signals, supplied thereto, to send the so generated class taps to the classification unit 133.

After the processing at step S12, the program moves to step S13 where the classification unit 133 performs classification based on the class taps from the tap generator 132 to send the resulting class codes to the normal equation summation circuit 134.

The program then moves to step S14 where the normal equation summation circuit 134 performs the aforementioned summation of the matrix A and the vector v of the equation (13), for the speech signals for learning, as the speech of the high sound quality of the frame of interest from the A/D converter 202, as teacher data and for prediction taps from the tap generator 132, as pupil data, from one class code from the classification unit 133 to another. The program then moves to step S15.

At step S15, it is verified whether or not there is any frame to be processed as the frame of interest. If it is found at step S15 that there is still a frame to be processed as the frame of interest, the program reverts to step S11 where the processing similar to that described above is repeated with the sequentially next frame as being new frames of interest.

If it is found at step S15 that there is no frame to be processed as being the frame of interest, that is if the normal equation has been obtained for each class in the normal equation summation circuit 134, the program moves to step S16 where the tap coefficient decision circuit 135 solves the normal equation generated for each class to find the tap coefficients from class to class to send the so found tap coefficients to the address associated with each class to terminate the processing.

The class-based tap coefficients stored in the coefficient memory 136 are stored in the coefficient memory coefficient memory 124 of FIG. 11.

Consequently, the tap coefficients stored in the coefficient memory 124 of FIG. 11 have been found by carrying out the learning such that the prediction errors (square errors) of the predicted speech values of high sound quality obtained on linear predictive calculations will be statistically minimum, so that the speech output by the prediction unit 125 of FIG. 11 is of high sound quality.

The above-described sequence of operations may be carried out by handwave or by software. If the sequence of operations is carried out by software, the program forming the software is installed on e.g., general-purpose computer.

FIG. 13 shows an illustrative structure of an embodiment of a computer on which to install the program adapted for executing the above-described sequence of operations.

It is possible for the program to be pre-recorded on a hard disc 305 or a ROM 303 as a recording medium enclosed in a computer.

Alternatively, the program may be transiently or permanently stored in a removable recording medium 311, such as CD-ROM (Compact Disc Read Only memory), MO (magneto-optical) disc, DVD (Digital Versatile Disc), magnetic disc or a semiconductor memory. Such removable recording medium 311 may be furnished as a so-called package software.

Meanwhile, the program may not only be installed from the above-described removable recording medium 311 on a computer but also transferred over a radio route to the computer from a downloading site, over a network, such as LAN (Local Area network) or Internet. The so transferred program on a communication unit 308 may be received by the communication unit 308 so as to be installed on an enclosed hard disc 305.

The computer has enclosed therein a CPU (central processing unit) 302. To this CPU 302 is connected an input/output interface 310 over a bus 301. When a command is input to the CPU 302 over the input/output interface 310 by a user acting on an input unit 307, such as a keyboard, mouse or microphone, the program loaded on the ROM (Read Only Memory) is executed. Alternatively, the CPU 302 loads a program, stored in the hard disc 305, a program transmitted over the satellite or network, received by a communication unit 308 and installed on the hard disc 305, or a program read out from the removable recording medium 311 loaded on the hard disc 305, on a RAM (Random Access memory) 304 for execution. The CPU 302 now executes the processing in accordance with the above-described flowchart or the processing conforming to the above-described block diagram. The CPU 302 causes the processing results to be output over e.g., the input/output interface 310 from an output unit 306 formed by LCD (liquid crystal display) or a loudspeaker, transmitted from the communication unit 308 or recorded on the hard disc 305.

The processing step for stating the program for executing the various processing operations by a computer need not be carried out chronologically in the order stated in the flowchart, but may be processed in parallel or batch-wise, such as parallel processing or object-wise processing.

The program may be processed by a sole computer or by plural computers in a distributed fashion. Moreover, the program may be transmitted to a remotely located computer for execution.

Although no particular reference has been made in the present invention as to which sort of the speech signals for learning is to be used, the speech signals for learning may not only be the speech uttered by a speaker or a musical number (music). With the above-described learning, such tap coefficients which will improve the sound quality of the speech are obtained if the speech uttered by a speaker is used, whereas, if the speech signals for learning are music numbers, such tap coefficients which will improve the sound quality of the speech are obtained which will improve the sound quality of the musical number.

In an embodiment shown in FIG. 11, the tap coefficients are pre-stored in the coefficient memory 124. Alternatively, the tap coefficients to be stored in the coefficient memory 124 may also be downloaded in the portable telephone set 101 from the base station 102 or the exchange station 103 of FIG. 9 or from a WWW (World Wide Web) server, not shown. That is, the tap coefficients suited to a sort of speech signals, such as those for the human speech or music, may be obtained on learning. Depending on the teacher or pupil data used for learning, such tap coefficients which will produce a difference in the sound quality of the synthesized sound may be acquired. So, these various tap coefficients may be stored in e.g., the base station 102 for the user to download the tap coefficients the or she desires. Such service of downloading the tap coefficients may be payable or charge-free. If the service of downloading the tap coefficients is to be payable, the fee as remuneration for the downloaded tap coefficients may be charged along with the call toll of the portable telephone set 101.

The coefficient memory coefficient memory 124 may be formed by e.g., a memory card that can be mounted on or dismounted from the portable telephone set 101. If, in this case, variable memory cards having stored thereon the above-described various tap coefficients are furnished, the memory cards holding the desired tap coefficients may be loaded and used on the portable telephone set 101.

The present invention may be broadly applied in generating the synthesized sound from the code obtained on encoding by the CELP system, such as VSELP (Vector Sum Excited linear Prediction), PSI-CELP (Pitch Synchronous Innovation CELP), CS-ACELP (Conjugate Structure Algebraic CELP).

The present invention also is broadly applicable not only to such a case where the synthesized sound is generated from the code obtained on encoding by CELP system but also to such a case where residual signals and linear prediction coefficients are obtained from a given code to generate the synthesized sound.

In the above-described embodiment, the prediction values of residual signals and linear prediction coefficients are found by one-dimensional linear predictive calculations. Alternatively, these prediction values may be found by two- or higher dimensional predictive calculations.

Also, in the receipt unit shown in FIG. 11 and in the learning device shown in FIG. 12, the class taps are generated based not only on the L, G, I and A codes, but also on linear prediction coefficients derived from the A codes and residual signals derived from the L, G and I codes. The class codes may also be generated from only one or a plural number of the L, G, I and A codes, such as, for example, from only the A code. If, for example, the class taps are formed only from the I code, the I code it self may be used as the class code. Since the VSELP system allocates 9 bits to the I code, the number of the classes is 512 ($=2^9$) if the I code is directly used as the class code. Meanwhile, each bit of the 9-bit I code has two sorts of signs, namely 1 and −1, it is sufficient if a bit which is −1 is deemed to be 0 if this I code is used as the class code.

In the CELP system, software interpolation bits or the frame energy may sometimes be included in the code data. In this case, the class taps may be formed by using software interpolation bits or the frame energy.

In Japanese Laying-Open Patent Publication H-8-202399, there is disclosed a method of passing the synthesized sound through a high range emphasizing filter to improve its sound quality. The present invention differs from the invention disclosed in the Japanese Laying-Open Patent Publication H-8-202399 e.g., in that the tap coefficients are obtained on learning and in that the tap coefficients used are determined from the results of the code-based classification.

Referring to the drawings, a modification of the present invention is explained in detail.

Figure 14:
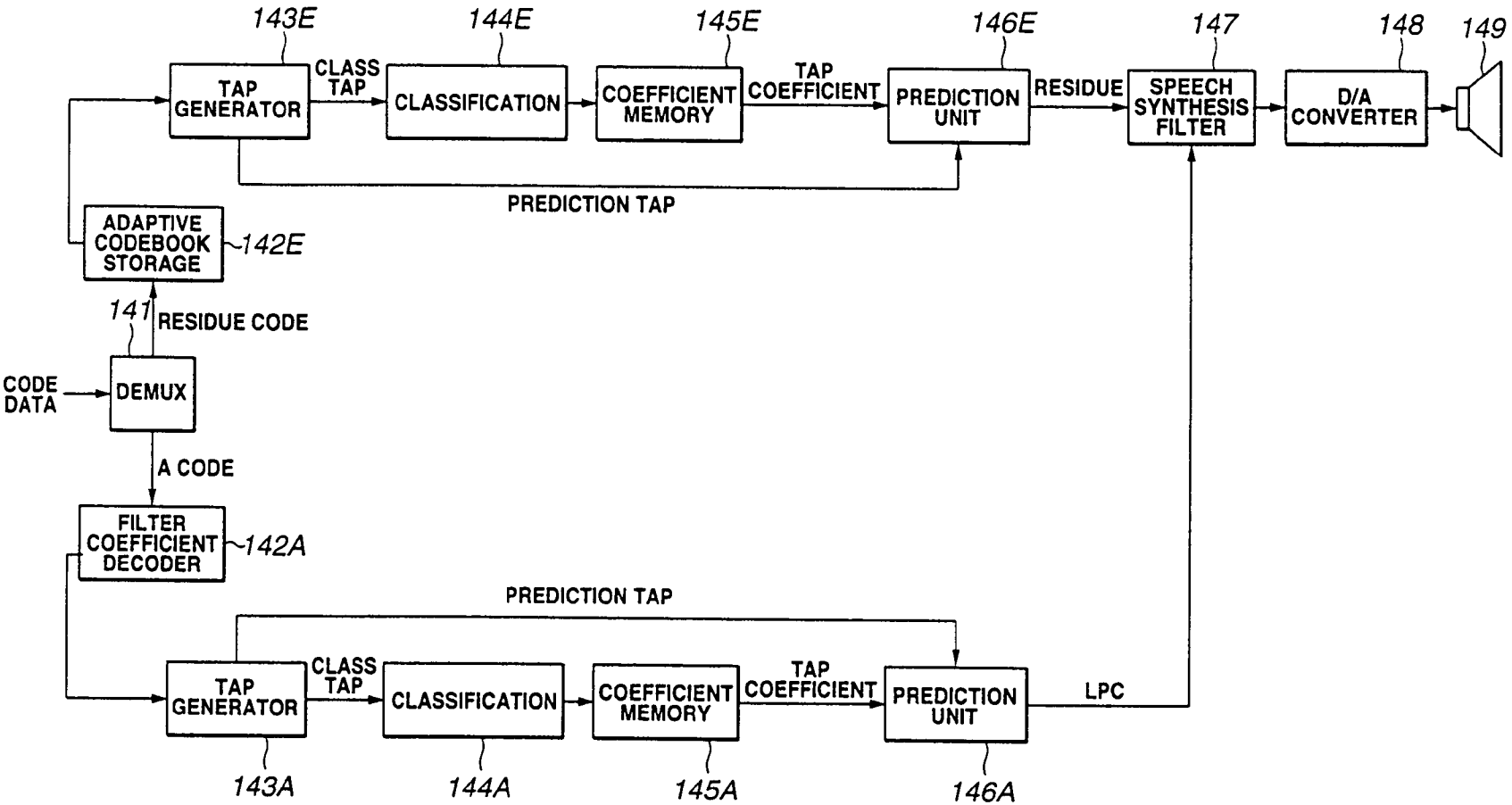
FIG. 14 is a block diagram showing another typical structure of a speech synthesis device embodying the present invention.

FIG. 14 shows a structure of a speech synthesis device embodying the present invention. This speech synthesis device is fed with code data multiplexed from the residual code and the A code obtained respectively on coding the residual signal and the linear prediction coefficients A sent to a speech synthesis filter 147. The residual signals and the linear prediction coefficients are found from the residual and A codes, respectively, and routed to the speech synthesis filter 147 to generate the synthesized sound.

If the residual code is decoded into the residual signals based on the codebook which associates the residual signals with the residual code, the residual signals, obtained on decoding, are corrupted with errors, with the result that the synthesized sound is deteriorated in sound quality. Similarly, if the A code is decoded into linear prediction coefficients based on the codebook which associates the linear prediction coefficients with the A code, the decoded linear prediction coefficients are again corrupted with errors, thus deteriorating the sound quality of the synthesized sound.

So, in the speech synthesis device of FIG. 14, the predictive calculations are carried out using tap coefficients as found on learning to find prediction values for true residual signals and linear prediction coefficients and the synthesized sound of high sound quality is produced using these prediction values.

That is, in the speech synthesis device of FIG. 14, the linear prediction coefficients decoded are decoded to prediction values of true linear prediction coefficients using e.g., the classification adaptive processing.

The classification adaptive processing is made up by classification processing and adaptive processing. By the classification processing, the data is classified depending on data properties and adaptive processing is carried out from class to class, while the adaptive processing is carried out by a technique which is the same as that described above. So, reference may be had to the foregoing description, and detailed description is not made here for simplicity.

In the speech synthesis device, shown in FIG. 14, the decoded linear prediction coefficients are decoded into true linear prediction coefficients, more precisely prediction values thereof, whilst decoded residual signals are also decoded into true residual signals, more precisely prediction values thereof.

That is, a demultiplexer (DEMUX) 141 is fed with code data and separates the code data supplied into frame-based A code and residual code, which are routed to a filter coefficient decoder 142A and a residual codebook storage unit 142E, respectively. It should be noted that the A code and the residual code, included in the code data in FIG. 14, are obtained on vector quantization of linear prediction coefficients and residual signals, obtained in turn on LPC analysis of the speech in terms of a preset frame as unit, using a preset codebook.

The filter coefficient decoder 142A decodes the frame-based A code, supplied from the demultiplexer 141, into decoded linear prediction coefficients, based on the same codebook as that used in obtaining the A code, to route the resulting decoded linear prediction coefficients to the tap generator 143A.

The residual codebook storage unit 142E memorizes the same codebook as that used in obtaining the frame-based residual code, supplied from the demultiplexer 141, and decodes the residual code from the demultiplexer into the decoded residual signals, based on the codebook, to route the so produced decoded residual signals to the tap generator 143E.

From the frame-based decoded linear prediction coefficients, supplied from the filter coefficient decoder 142A, the tap generator 143A extracts what are to be class taps used in classification in a classification unit 144A, and what are to be prediction taps used in predictive calculations in a prediction unit 146, as later explained. That is, the tap generator 143A sets the totality of the decoded linear prediction coefficients as prediction taps and class taps for the linear prediction coefficients. The tap generator 143A sends the class taps pertinent to the linear prediction coefficients and the prediction taps to the classification unit 144A and to the prediction unit 146A, respectively.

From the frame-based decoded residual signals, the tap generator 143E extracts what are to be class taps and what are to be prediction taps from the frame-based decoded residual signals supplied from the residual codebook storage unit 142E. That is, the tap generator 143E makes all sample values of the decoded residual signals of a frame being processed into class taps and prediction taps for the residual signals. The tap generator 143E sends class taps pertinent to the residual signals and prediction taps to the classification unit 144E and to the prediction unit 146E, respectively.

The constituent pattern of the prediction taps and class taps are not limited to the above-mentioned patterns.

It should be noted that the may be designed to extract class taps and prediction taps of the linear prediction coefficients from both the decoded linear prediction coefficients and the decoded residual signals. The class taps and prediction patterns pertinent to the linear prediction coefficients may also be extracted by the tap generator 143A from the A code and the residual code. The class taps and prediction patterns of the linear prediction coefficients may also be extracted from signals already output from the downstream side prediction units 146A or 146E or from the synthesized speech signals already output by the speech synthesis filter 147. It is also possible for the tap generator 143E to extract class and prediction taps pertinent to the residual signals in similar manner.

Based on the class taps pertinent to the linear prediction coefficients from the tap generator 143A, the classification unit 144A classifies the linear prediction coefficients of the frame, which is a frame of interest, and the prediction values of true linear prediction coefficients of which are to be found, and outputs the class code, corresponding to the resulting class, to a coefficient memory 145A.

As the method for classification, ADRC (Adaptive Dynamic Range Coding), for example, may be employed.

In a method employing the ADRC, the decoded linear prediction coefficients forming class taps, are ADRC processed and, based on the resulting ADRC code, the class of the linear prediction coefficients of the frame of interest is determined.

In a K-bit ADRC, the maximum value MAX and the minimum value MIN of decoded linear prediction coefficients, forming class taps, are detected based on a local dynamic range of a set DR=MAX−MIN, and the decoded linear prediction coefficients, forming the class taps, are re-quantized into K bits. That is, the minimum value MIN is subtracted from the decoded linear prediction coefficients, forming the class taps, and the resulting difference value is divided by DR/2K. The respective decoded linear prediction coefficients, forming the class taps, obtained as described above, are arrayed in a preset sequence to form a bit string, which is output as an ADRC code. Thus, if the class taps are processed with e.g., one-bit ADRC, the minimum value MIN is subtracted from the respective decoded linear prediction coefficients, forming the class taps, and the resulting difference value is divided by the average value of the maximum value MAX and the minimum value MIN, whereby the respective decoded linear prediction coefficients are of one-bit values, by way of binary coding. The bit string, obtained on arraying the one-bit decoded linear prediction coefficients, is output as the ADRC code.

The string of values of decoded linear prediction coefficients, forming class taps, may directly be output as the class code to the classification unit 144A. If the class taps are formed as p-dimensional linear prediction coefficients, and K bits are allocated to the respective decoded linear prediction coefficients, the number of different class codes, output by the classification unit 144A, is $(2^K)^k$ which is an extremely large value exponentially proportionate to the number of bits K of the decoded linear prediction coefficients.

Thus, classification in the classification unit 144A is preferably carried out after compressing the information volume of the class taps by e.g., the ADRC processing or vector quantization.

Similarly to the classification unit 144A, the classification unit 144E carries out classification of the frame of interest, based on the class taps supplied from the tap generator 143E, to output the resulting class codes to the coefficient memory 145E.

The coefficient memory 145E holds tap coefficients pertinent to the class-based linear prediction coefficients, obtained on performing the learning in a learning device of FIG. 17 as later explained, and outputs the tap coefficients, stored in an address associated with the class code output by the classification unit 144A, to the prediction unit 146A.

Figure 17:
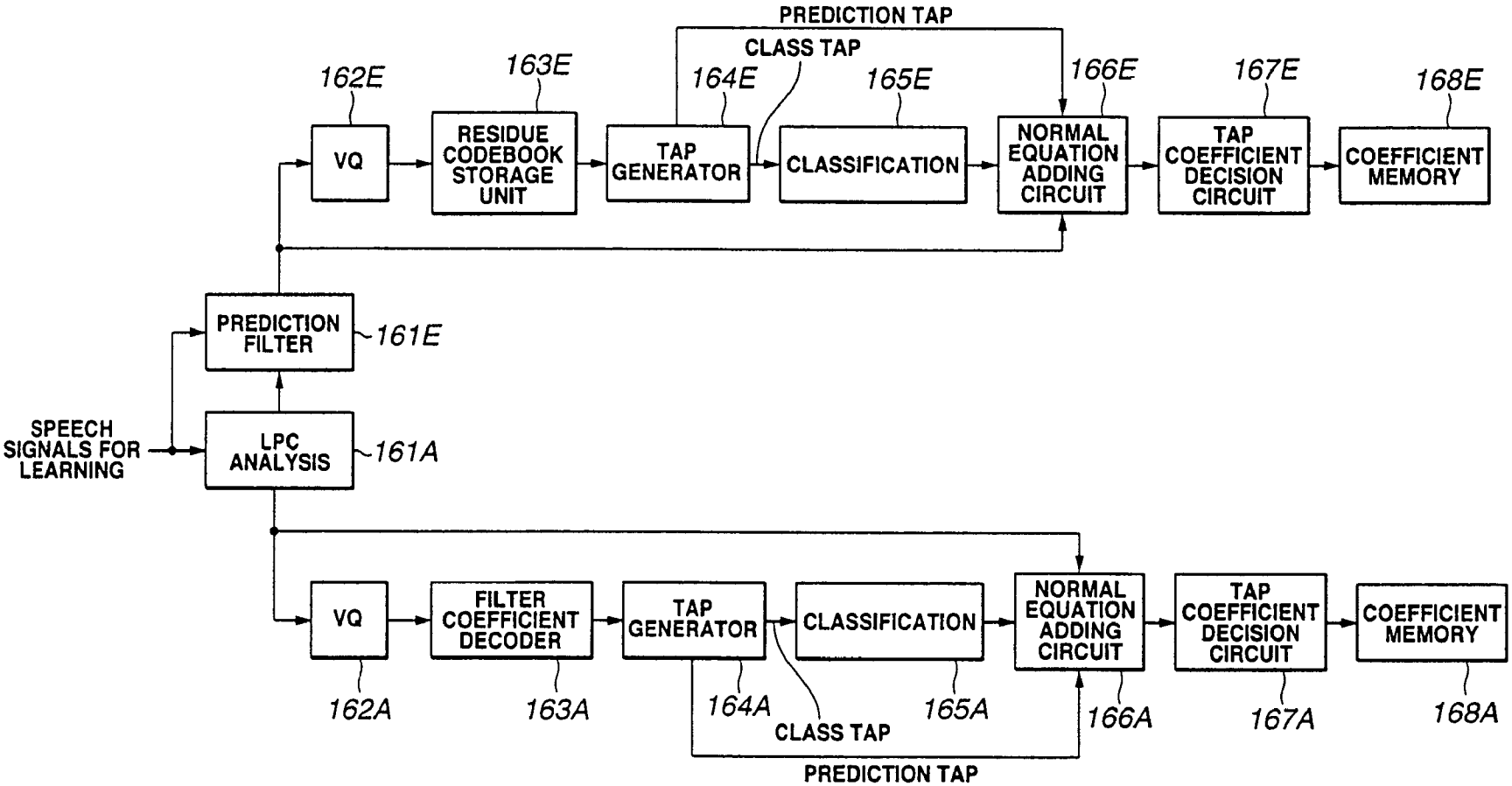
FIG. 17 is a block diagram showing another modification of the learning device embodying the present invention.

The coefficient memory 145E holds tap coefficients pertinent to the class-based linear prediction coefficients, as obtained by carrying out the learning in the learning device of FIG. 17, and outputs the tap coefficients, stored in the address corresponding to the class code output by the classification unit 144E, to the prediction unit 146E.

If, in case p-dimensional linear prediction coefficients are to be found in each frame, the p-dimensional linear prediction coefficients are to be found by predictive calculations of the aforementioned equation (6), p sets of the tap coefficients are needed. Thus, in the coefficient memory 145A, p sets of the tap coefficients are stored in an address associated with one class code. For the same reason, the same number of sets as that of the sample points of the residual signals in each frame is stored in the coefficient memory 145E.

The prediction unit 146A acquires prediction taps output by the tap generator 143A and the tap coefficients output by the coefficient memory 145A and, using these prediction and tap coefficients, performs the linear prediction calculations (sum-of-product processing), shown by the equation (6), to find the p-dimensional linear prediction coefficients of the frame of interest, more precisely the predicted values thereof, to send the so found out values to the speech synthesis filter 147.

The prediction unit 146E acquires the prediction taps, output by the tap generator 143E, and the tap coefficients output by the coefficient memory 145E. Using the so acquired prediction and tap coefficients, the prediction unit 146E carries out the linear prediction calculations, shown by the equation (6), to find predicted values of the residual signals of the frame of interest to output the so found out values to the speech synthesis filter 147.

The coefficient memory 145A outputs P sets of tap coefficients for finding predicted values of the p-dimensional linear prediction coefficients forming the frame of interest. On the other hand, the prediction unit 146A executes the sum-of-products processing of the equation (6), using the prediction taps, and the sets of the tap coefficients corresponding to the number of the dimensions, in order to find the linear prediction coefficients of the respective dimensions. The same holds for the prediction unit 146E.

Similarly to the speech synthesis unit 29, explained with reference to FIG. 1, the speech synthesis filter 147 is an IIR type digital filter, and carries out the filtering of the residual signals from the prediction unit 146E as input signal, with the linear prediction coefficients from the prediction unit 146A as tap coefficients of the IIR filter, to generate the synthesized sound, which is input to a D/A converter 148. The D/A converter 148 D/A converts the synthesized sound from the speech synthesis filter 147 from the digital signals into the analog signals, which are sent to and output at a loudspeaker 149.

In FIG. 14, class taps are generated in the tap generators 143A, 143E, classification based on these class taps is carried out in the classification units 144A, 144E and tap coefficients for the linear prediction coefficients and the residual signals corresponding to the class codes as being the results of the classification are acquired from the coefficient memories 145A, 145E. Alternatively, the tap coefficients of the linear prediction coefficients and the residual signals can be acquired as follows:

That is, the tap generators 143A, 143E, classification units 144A, 144E and the coefficient memories 145A, 145E are constructed as respective integral units. If the tap generators, classification units and the coefficient memories, constructed as respective integral units, are named a tap generator 143, a classification unit 144 and a coefficient memory 145, respectively, the tap generator 143 is caused to form class taps from the decoded linear prediction coefficients and decoded residual signals, while the classification unit 144 is caused to perform classification based on the class taps to output one class code. The coefficient memory 145 is caused to hold sets of tap coefficients for the decoded linear prediction coefficients and tap coefficients for the residual signals, and is caused to output sets of the tap coefficients for each of the linear prediction coefficients and the residual signals stored in the address associated with the class code output by the classification unit 144. The prediction units 146A, 146E may be caused to carry out the processing based on the tap coefficients pertinent to the linear prediction coefficients output as sets from the coefficient memory 145 and on the tap coefficients for the residual signals.

If the tap generators 143A, 143E, classification units 144A, 144E and the coefficient memories 145A, 145E are constructed as respective separate units, the number of classes for the linear prediction coefficients is not necessarily the same as the number of classes for the residual signals. In case of construction as the integral units, the number of the classes of the linear prediction coefficients is the same as that of the residual signals.

Figure 15:
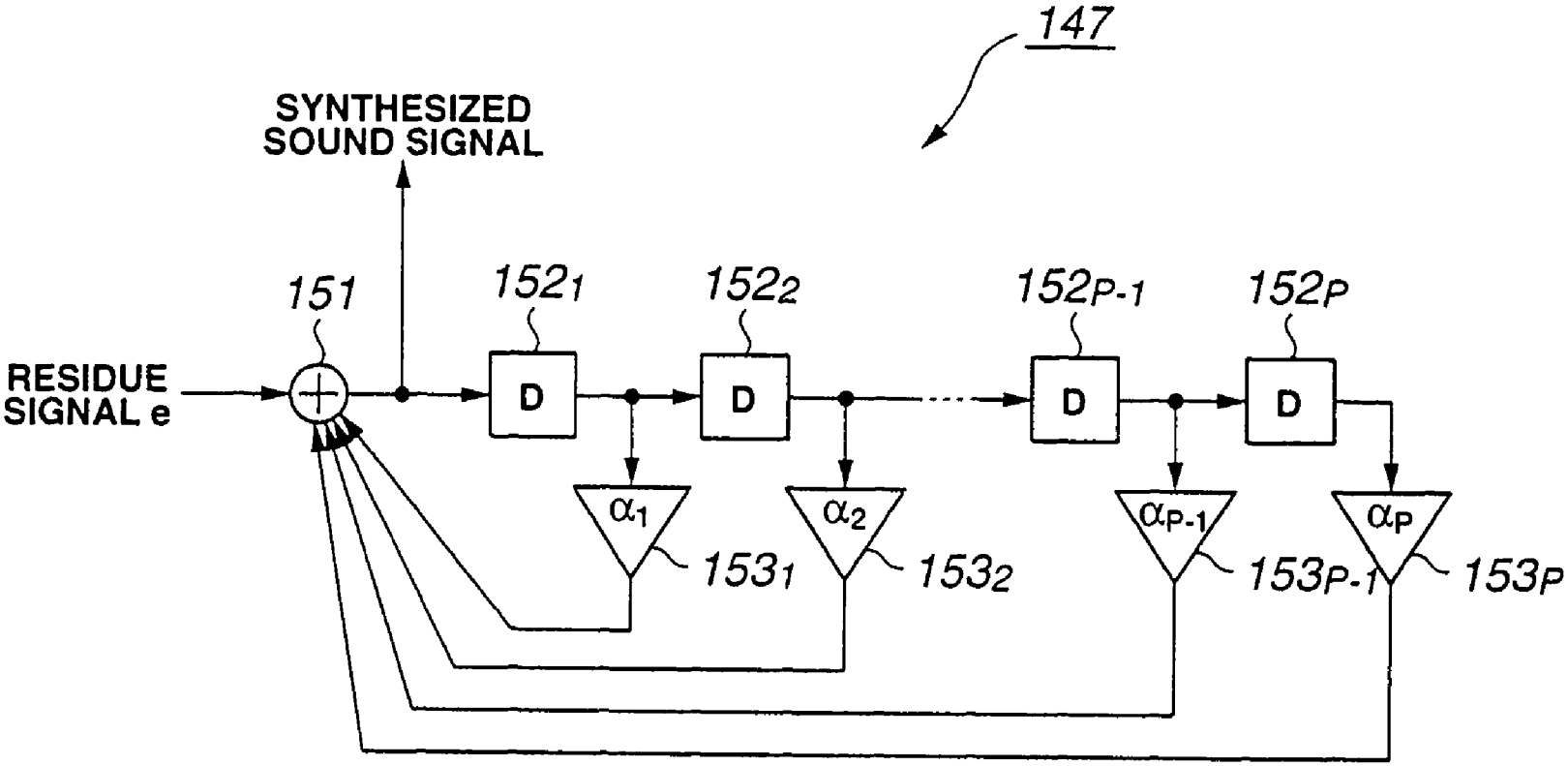
FIG. 15 is a block diagram showing a speech synthesis filter forming the speech synthesis device.

FIG. 15 shows a specified structure of the speech synthesis filter 147 making up the speech synthesis device shown in FIG. 14.

The speech synthesis filter 147 uses the p-dimensional linear prediction coefficients, as shown in FIG. 15, and hence is made up by a sole adder 151, p delay circuits (D) $\mathbf{152}_1$ to $\mathbf{152}_p$ and p multipliers $\mathbf{153}_1$ to $\mathbf{153}_p$.

In the multipliers $\mathbf{153}_1$ to $\mathbf{153}_p$ are set p-dimensional linear prediction coefficients $\alpha_1, \alpha_2, \ldots, \alpha_p$, supplied from the prediction unit 146A, whereby the speech synthesis filter 147 performs calculations in accordance with the equation (4) to generate the synthesized sound.

That is, the residual signals, output by the prediction unit 146E, are sent to a delay circuit $\mathbf{152}_1$ through adder 151. The delay circuit $\mathbf{152}_p$ delays the input signal by one sample of the residual signals to output the delayed signal to the downstream side delay circuit $\mathbf{152}_{p+1}$ and to the multiplier $\mathbf{153}_p$. The multiplier $\mathbf{153}_p$ multiplies the output of the delay circuit $\mathbf{12}_p$ with the linear prediction coefficient $\alpha_p$ set thereat to send the resulting product value to the adder 151.

The adder 151 sums all outputs of the multipliers $\mathbf{153}_1$ to $\mathbf{153}_p$ and the residual signals e to send the resulting sum to the delay circuit $\mathbf{12}_1$ and to output the sum as the result of speech synthesis (resulting sound signal).

Figure 16:
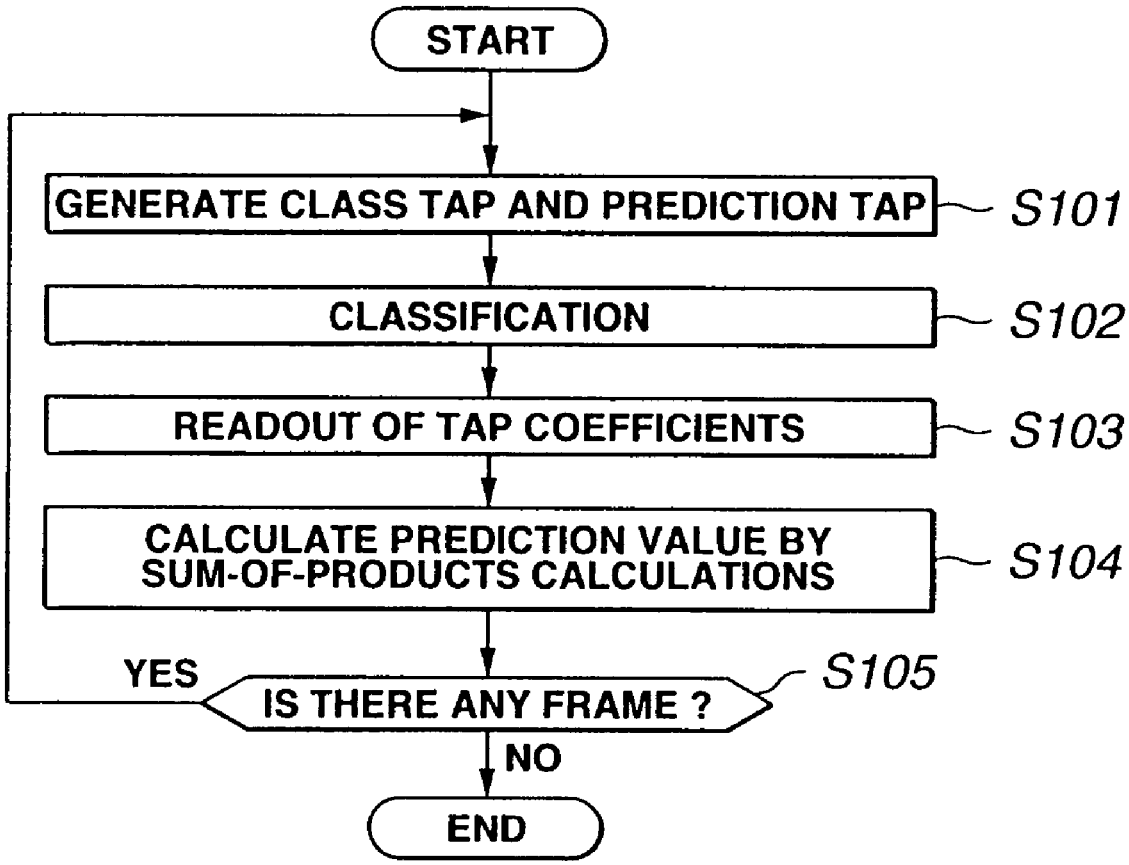
FIG. 16 is a flowchart for illustrating the processing of the speech synthesis device shown in FIG. 14.

Referring to the flowchart of FIG. 16, the speech synthesis processing of FIG. 14 is explained.

The demultiplexer 141 sequentially separates frame-based A code and residua code, from the code data, supplied thereto, to send the separated codes to the filter coefficient decoder 142A and to the residual codebook storage unit 142E.

The filter coefficient decoder 142A sequentially decodes the frame-based A code, supplied from the demultiplexer 141, into decoded linear prediction coefficients, which are supplied to the tap generator 143A. The residual codebook storage unit 142E sequentially decodes the frame-based residual codes, supplied from the demultiplexer 141, into decoded residual signals, which are sent to the tap generator 143E.

The tap generator 143A sequentially renders the frames of the decoded linear prediction coefficients supplied thereto the frames of interest. The tap generator 143A at step S101 generates the class taps and the prediction taps from the decoded linear prediction coefficients supplied from the filter coefficient decoder 142A. At step S101, the tap generator 143E also generates class taps and prediction taps from the decoded residual signals supplied from the residual codebook storage unit 142E. The class taps generated by the tap generator 143A are supplied to the classification unit 144A, while the prediction taps are sent to the prediction unit 146A. The class taps generated by the tap generator 143E are sent to the classification unit 144E, while the prediction taps are sent to the prediction unit 146E.

At step S102, the classification units 144A, 144E perform classification based on the class taps supplied from the tap generators 143A, 143E and sends the resulting class codes to the coefficient memories 145A, 145E. The program then moves to step S103.

At step S103, the coefficient memories 145A, 145E read out tap coefficients from the addresses for the class codes sent from the classification units 144A, 144E to send the read out coefficients to the prediction units 146A, 146E.

The program then moves to step S104, where the prediction unit 146A acquires the tap coefficients output by the coefficient memory 145A and, using these tap coefficients and the prediction taps from the tap generator 143A, acquires the prediction values of the true linear prediction coefficients of the frame of interest. At step S104, the prediction unit 146E acquires the tap coefficients output by the coefficient memory 145E and, using the tap coefficients and the prediction taps from the tap generator 143E, performs the sum-of-products processing shown by the equation (6) to acquire the true residual signals of the frame of interest, more precisely predicted values thereof.

The residual signals and the linear prediction coefficients, obtained as described above, are sent to the speech synthesis filter 147, which then performs the calculations of the equation (4), using the residual signals and the linear prediction coefficients, to produce the synthesized sound signal of the frame of interest. The synthesized sound signal is sent from the speech synthesis filter 147 through the D/A converter 148 to the loudspeaker 149 which then outputs the synthesized sound corresponding to the synthesized sound signal.

After the linear prediction coefficients and the residual signals have been obtained in the prediction units 146A, 146E, the program moves to step S105 where it is verified whether or not there are any decoded linear prediction coefficients and the decoded residual signals to be processed as the frame of interest. If it is verified at step S105 that there are any decoded linear prediction coefficients and the decoded residual signals to be processed as the frame of interest, the program reverts to step S101 where the frame to be rendered the frame of interest next is rendered the new frame of interest. The similar sequence of operations is then carried out. If it is verified at step S105 that there are no decoded linear prediction coefficients nor decoded residual signals to be processed as the frame of interest, the speech synthesis processing is terminated.

The learning device for carrying out the tap coefficients to be stored in the coefficient memories 145A, 145E shown in FIG. 14 is configured as shown in FIG. 17.

The learning device, shown in FIG. 17, is fed with the digital speech signals for learning, on the frame basis. These digital speech signals for learning are sent to an LPC analysis unit 161A and to a prediction filter 161E.

The LPC analysis unit 161A sequentially renders the frames of the speech signals, supplied thereto, the frames of interest, and LPC-analyzes the speech signals of the frame of interest to find p-dimensional linear prediction coefficients. These linear prediction coefficients are sent to a prediction unit 161E and to a vector quantizer 162A, while being sent to a normal equation addition circuit 166A as teacher data for finding tap coefficients pertinent to the linear prediction coefficients.

The prediction filter 161E performs calculations in accordance with the equation (1), using the speech signals and the linear prediction coefficients, supplied thereto, to find residual signals of the frame of interest, to send the resulting signals to the vector quantizer 162E, as well as to send the residual signals to the normal equation addition circuit 166E as teacher data for finding tap coefficients pertinent to the linear prediction coefficients.

That is, if the Z-transforms of $s_n$ and $e_n$ in the equation (1) are represented by S and E, respectively the equation (1) may be represented by:

$$E=(1+\alpha_1 z^{-1}+\alpha_2 z^{-2}+\ldots+\alpha_p z^{-p})S. \quad (15)$$

From the equation (15), the residual signals e can be found by the sum-of-products processing of the speech signal s and the linear prediction coefficients $\alpha_p$, so that the prediction filter 161E for finding the residual signals e may be formed by an FIR (Finite Impulse Response) digital filter.

Figure 18:
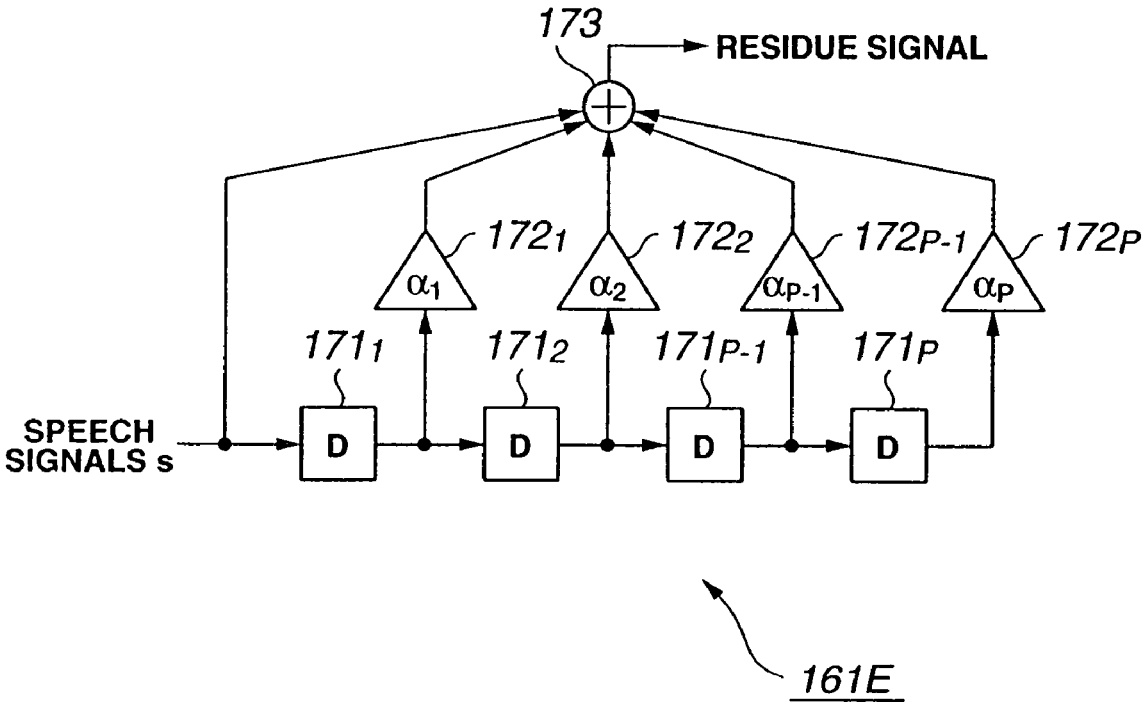
FIG. 18 is a block diagram showing a prediction filter forming the learning device according to the present invention.

FIG. 18 shows an illustrative structure of the prediction filter 161E.

The prediction filter 161E is fed with p-dimensional linear prediction coefficients from the LPC analysis unit 161A. So, the prediction filter 161E is made up of p delay circuits (D) $\mathbf{171}_1$ to $\mathbf{171}_p$, p multipliers $\mathbf{172}_1$ to $\mathbf{172}_p$ and one adder 173.

In the multipliers $\mathbf{172}_1$ to $\mathbf{172}_p$ are set $\alpha_1, \alpha_2, \ldots, \alpha_p$ from among the p-dimensional linear prediction coefficients sent from the LPC analysis unit 161A.

The speech signals s of the frame of interest are sent to a delay circuit $\mathbf{171}_1$ and to an adder 173. The delay circuit $\mathbf{171}_p$ delays the input signal thereto by one sample of the residual signals to output the delayed signal to the downstream side delay circuit $\mathbf{171}_{p+1}$ and to the multiplier $\mathbf{172}_p$. The multiplier $\mathbf{172}_p$ multiplies the output of the delay circuit $\mathbf{171}_p$ with the linear prediction coefficient $\alpha_p$ to send the resulting product to the adder 173.

The adder 173 sums all of the outputs of the multipliers $\mathbf{172}_1$ to $\mathbf{172}_p$ to the speech signals s to output the results of summation as the residual signals e.

Returning to FIG. 17, the vector quantizer 162A holds a codebook which associates the code vectors having the linear prediction coefficients as components with the codes. Based on the codebook, the vector quantizer 162A vector-quantizes the feature vector constituted by linear prediction coefficients of the frame of interest from the LPC analysis unit 161A to route the code A obtained on the vector quantization to a filter coefficient decoder 163A. The vector quantizer 162A holds a codebook, which associates the code vectors, having the sample values of the signal of the vector quantizer 162 as components, with the codes, and vector-quantizes the residual vectors, formed by sample values of the residual signals of the frame of interest from the prediction filter 161E to route the residual code obtained on this vector quantization to a residual codebook storage unit 163E.

The filter coefficient decoder 163A holds the same codebook as that stored by the vector quantizer 162A and, based on this codebook, decodes the A code from the vector quantizer 162A into decoded linear prediction coefficients which then are sent to the tap generator 164A as pupil data used for finding the tap coefficients pertinent to the linear prediction coefficients. The residual codebook storage unit 142E shown in FIG. 14 is configured similarly to the filter coefficient decoder 163A shown in FIG. 17.

The residual codebook storage unit 163E holds the same codebook as that stored by the vector quantizer 162E and, based on this codebook, decodes the residual code from the vector quantizer 162E into decoded residual signals which then are sent to the tap generator 164E as pupil data used for finding the tap coefficients pertinent to the residual signals. The residual codebook storage unit 142E shown in FIG. 14 is configured similarly to the residual codebook storage unit 142E shown in FIG. 17.

Similarly to the tap generator 143A of FIG. 14, the tap generator 164A forms prediction taps and class taps, from the decoded linear prediction coefficients, supplied from the filter coefficient decoder 163A, to send the class taps to a classification unit 165A, while supplying the prediction taps to the normal equation addition circuit 166A. Similarly to the tap generator 143E of FIG. 14, the tap generator 164E forms prediction taps and class taps, from the decoded residual signals supplied from the residual codebook storage unit 163E, to send the class taps and the prediction taps to the classification unit 165E and to the normal equation addition circuit 166E.

Similarly to the classification units 144A and 144E of FIG. 3, the classification units 165A and 165E perform classification based on the class taps supplied thereto to send the resulting class codes to the normal equation addition circuits 166A and 166E.

The normal equation addition circuit 166A executes summation on the linear prediction coefficients of the frame of interest, as teacher data from the LPC analysis unit 161A, and on the decoded linear prediction coefficients, forming prediction taps, as pupil data from the tap generator 164A. The normal equation addition circuit 166E executes summation on the residual signals of the frame of interest, as teacher data from the prediction filter 161E, and on the decoded residual signals, forming prediction taps, as pupil data from the tap generator 164E.

That is, the normal equation addition circuit 166A uses the pupil data, as prediction taps and to perform calculations equivalent to the reciprocal multiplication of the pupil data ($x_{in}x_{im}$), as the components of the matrix A of the above-mentioned equation (13), and to summation (Σ), for each class supplied from the classification unit 165A.

The normal equation addition circuit 166A also uses pupil data, that is linear prediction coefficients of the frame of interest, and teacher data, that is the decoded linear prediction coefficients, forming the prediction taps, and the linear prediction coefficients of the frame of interest, as teacher data, to perform multiplication ($x_{in}y_i$) of the pupil and teacher data, and to summation (Σ), for each class of the class code supplied from the classification unit 165A.

The normal equation addition circuit 166A performs the aforementioned summation, with the totality of the frames of the linear prediction coefficients supplied from the LPC analysis unit 161A as the frames of interest, to establish the normal equation pertinent to the linear prediction coefficients shown in FIG. 13.

The normal equation addition circuit 166E also performs similar summation, with all of the frames of the residual signals sent form the prediction filter 161E as the frame of interest, whereby a normal equation concerning the residual signals as shown in equation (13) is established for each class.

A tap coefficient decision circuit 167A and a tap coefficient decision circuit 167E solve the normal equations, generated in the normal equation addition circuits 166A, 166E, from class to class, to find tap coefficients for the linear prediction coefficients and for the residual signals, which are sent to addresses associated with respective classes of the coefficient memories 168A, 168E.

Depending on the speech signals, provided as speech signals for learning, there are occasions wherein, in a class or classes, a number of the normal equations required to find tap coefficients cannot be produced in the normal equation addition circuit 166A or 166E. For such class(es), the tap coefficient decision circuit 167A or 167E outputs default tap coefficients.

The coefficient memories 168A, 168E memorize the class-based tap coefficients and residual signals, supplied from the tap coefficient decision circuits 167A, 167E.

Figure 19:
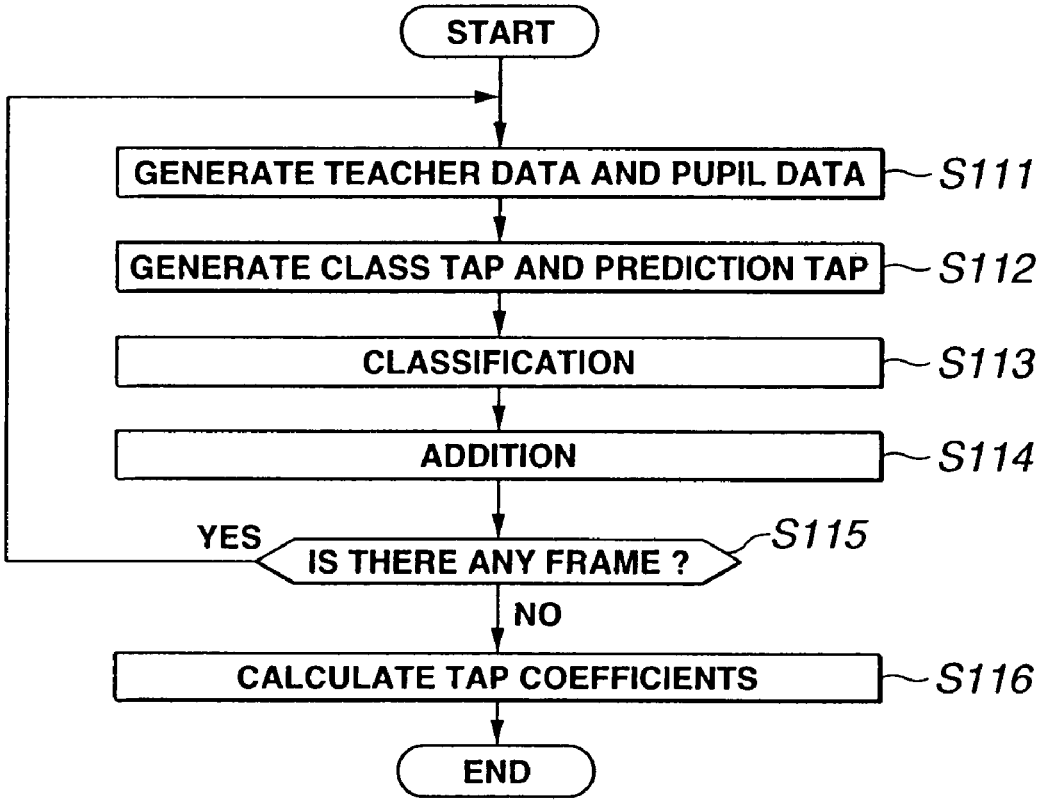
FIG. 19 is a flowchart for illustrating the processing of the learning device shown in FIG. 17.

Referring to the flowchart of FIG. 19, the processing for learning of the learning device of FIG. 17 is explained.

The learning device is supplied with speech signals for learning. At step S111, teacher data and pupil data are generated from the speech signals for learning.

That is, the LPC analysis unit 161A sequentially renders the frames of the speech signals for learning, the frame of interest, and LPC-analyzes the speech signals of the frame of interest to find p-dimensional linear prediction coefficients, which are sent as teacher data to the normal equation addition circuit 166A. These linear prediction coefficients are also sent to the prediction filter 161E and to the vector quantizer 162A. This vector quantizer 162A vector-quantizes the feature vector formed by the linear prediction coefficients of the frame of interest from the LPC analysis unit 161A to send the A code obtained by this vector quantization to the filter coefficient decoder 163A. The filter coefficient decoder 163A decodes the A code from the vector quantizer 162A into decoded linear prediction coefficients which are sent as pupil data to the tap generator 164A.

On the other hand, the prediction filter 161E, which has received the linear prediction coefficients of the frame of interest from the analysis unit 161A, performs the calculations conforming to the aforementioned equation (1), using the linear prediction coefficients and the speech signals for learning of the frame of interest, to find the residual signals of the frame of interest, which are sent to the normal equation addition circuit 166E as teacher data. These residual signals are also sent to the vector quantizer 162E. This vector quantizer 162E vector-quantizes the residual vector, constituted by sample values of the residual signals of the frame of interest from the prediction filter 161E to send the residual code obtained as the result of the vector quantization to the residual codebook storage unit 163E. The residual codebook storage unit 163E decodes the residual code from the vector quantizer 162E to form decoded residual signals, which are sent as pupil data to the tap generator 164E.

The program then moves to step S112 where the tap generator 164A forms prediction taps and class taps pertinent to the linear prediction coefficients, from the decoded linear prediction coefficients sent from the filter coefficient decoder 163A, whilst the tap generator 164E forms prediction taps and class taps pertinent to the residual signals from the decoded residual signals supplied from the residual codebook storage unit 163E. The class taps pertinent to the linear prediction coefficients are sent to the classification unit 165A, whilst the prediction taps are sen to the normal equation addition circuit 166A. The class taps pertinent to the residual signals are sent to the classification unit 165E, whilst the prediction taps are sen to the normal equation addition circuit 166E.

Subsequently, at step S113, the classification unit 165A executes classification based on the class taps pertinent to the linear prediction coefficients, and sends the resulting class codes to the normal equation addition circuit 166A, whilst the classification unit 165E executes classification based on the class taps pertinent to the residual signals, and sends the resulting class code to the normal equation addition circuit 166E.

The program then moves to step S114, where the normal equation addition circuit 166A performs the aforementioned summation of the matrix A and the vector v of the equation (13), for the linear prediction coefficients of the frame of interest as teacher data from the LPC analysis unit 161A and for the decoded linear prediction coefficients forming the prediction taps as pupil data from the tap generator 164A. At step S114, the normal equation addition circuit 166E performs the aforementioned summation of the matrix A and the vector v of the equation (13), for the residual signals of the frame of interest as teacher data from the prediction filter 161E and for the decoded residual signals forming the prediction taps as pupil data from the tap generator 164E. The program then moves to step S115.

At step S115, it is verified whether or not there is any speech signal for learning for the frame to be processed as the frame of interest. If it is verified at step S115 that there is any speech signal for learning of the frame to be processed as the frame of interest, the program reverts to step S111 where the next frame is set as a new frame of interest. The processing similar to that described above then is repeated.

If it is verified at step S105 that there is no speech signal for learning of the frame to be processed as the frame of interest, that is if the normal equation is obtained in each class in the normal equation addition circuits 166A, 166E, the program moves to step S116 where the tap coefficient decision circuit 167A solves the normal equation generated for each class to find the tap coefficients for the linear prediction coefficients for each class. These tap coefficients are sent to the address associated with each class for storage therein. The tap coefficient decision circuit 167E also solves the normal equation generated for each class to find the tap coefficients for the residual signals for each class. These tap coefficients are sent to and stored in the address associated with each class to terminate the processing.

The tap coefficients pertinent to the linear prediction coefficients for each class, thus stored in the coefficient memory 168A, are stored in the coefficient memory 145A of FIG. 14, while the tap coefficients pertinent to the class-based residual signals stored in the coefficient memory 168E are stored in the coefficient memory 145E of FIG. 14.

Consequently, the tap coefficients stored in the coefficient memory 145A of FIG. 14 have been found on learning so that the prediction errors of the prediction value of the true linear prediction coefficients, obtained on carrying out linear predictive calculations, herein square errors, will be statistically minimum, while the tap coefficients stored in the coefficient memory 145E of FIG. 14 have been found on learning so that the prediction errors of the prediction values of the true residual signals, obtained on carrying out linear predictive calculations, herein square errors, will also be statistically minimum. Consequently, the linear prediction coefficients and the residual signals, output by the prediction units 146A, 146E of FIG. 14, are substantially coincident with the true linear prediction coefficients and with the true residual signals, respectively, with the result that the synthesized sound generated by these linear prediction coefficients and residual signals are free of distortion and of high sound quality.

If, in the speech synthesis device, shown in FIG. 14, the class taps and prediction taps for the linear prediction coefficients are to be extracted by the tap generator 143A from both the decoded linear prediction coefficients and the decoded residual signals, it is necessary to cause the tap generator 164A of FIG. 17 to extract the class taps or prediction taps for the linear prediction coefficients from both the decoded linear prediction coefficients and from the decoded residual signals. The same holds for the tap generator 164E.

If, in the speech synthesis device shown in FIG. 14, the tap generators 143A, 143E, classification units 144A, 144E and the coefficient memories 145A, 145E are constructed as respective separate units, the tap generators 164A, 164E, classification units 165A, 165E, normal equation addition circuits 166A, 166E, tap coefficient decision circuits 167A, 167E and the coefficient memories 168A, 168E need to be constructed as respective separate units. In this case, in the normal equation addition circuit in which the normal equation addition circuits 166A, 166E are constructed unitarily, the normal equation is established with both the linear predictive coefficients output by the LPC analysis unit 161A and the residual signals output by the prediction units 161E as teacher data at a time and with both the decoded linear predictive coefficients output by the filter coefficient decoder 163A and the decoded residual signals output by the residual codebook storage unit 163E as pupil data at a time. In the tap coefficient decision circuit where the tap coefficient decision circuits 167A, 167E are constructed unitarily, the normal equation is solved to find the tap coefficients for the linear predictive coefficients and for the residual signals for each class at a time.

An instance of the transmission system embodying the present invention the present invention is now explained with reference to FIG. 20. The system herein means a set of logically arrayed plural devices, while it does not matter whether or not the respective devices are in the same casing.

In this transmission system, the portable telephone sets $\mathbf{181}_1$, $\mathbf{181}_2$ perform radio transmission and receipt with base stations $\mathbf{182}_1$, $\mathbf{182}_2$, respectively, while the base stations $\mathbf{182}_1$, $\mathbf{182}_2$ perform speech transmission and receipt with an exchange station 183 to enable speech transmission and receipt of speech between the portable telephone sets $\mathbf{181}_1$, $\mathbf{181}_2$ with the aid of the base stations $\mathbf{182}_1$, $\mathbf{182}_2$ and the exchange station 183. The base stations $\mathbf{182}_1$, $\mathbf{182}_2$ may be the same as or different from each other.

The portable telephone sets $\mathbf{181}_1$, $\mathbf{181}_2$ are referred to below as a portable telephone set 181, unless there is no particular necessity for making distinctions between the two sets.

Figure 20:
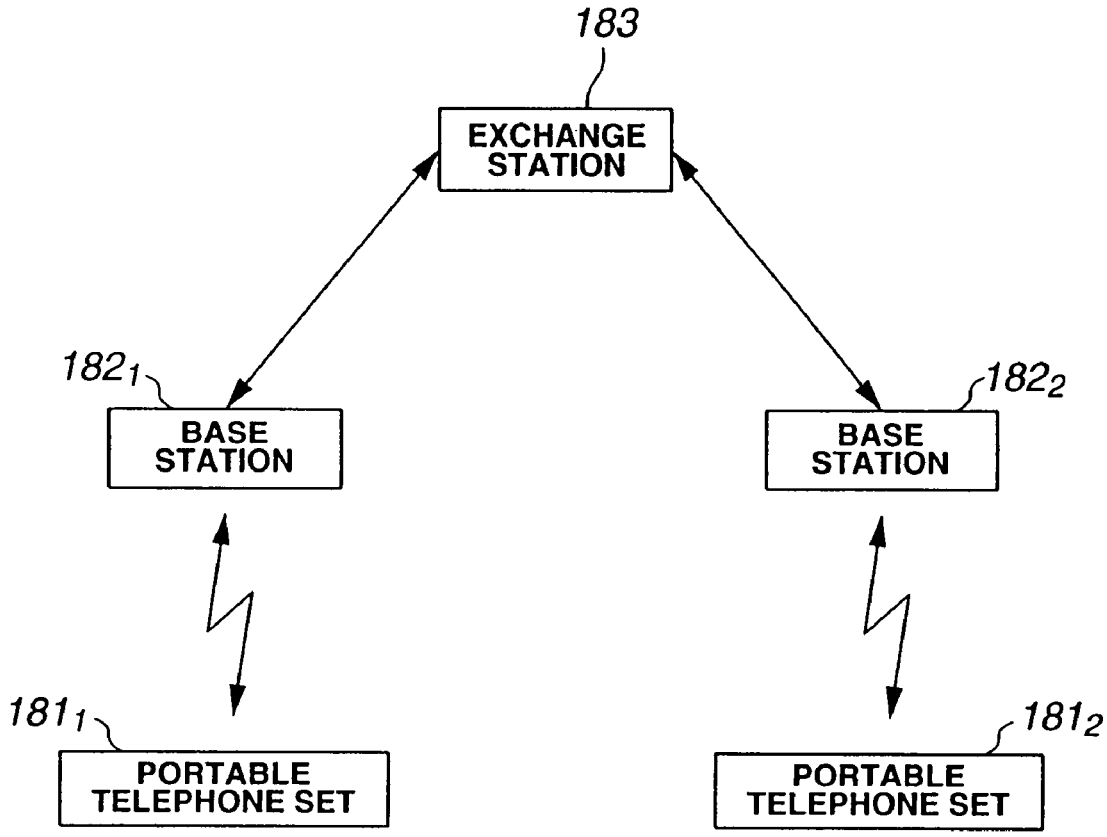
FIG. 20 is a block diagram showing a transmission system embodying the present invention.
Figure 21:
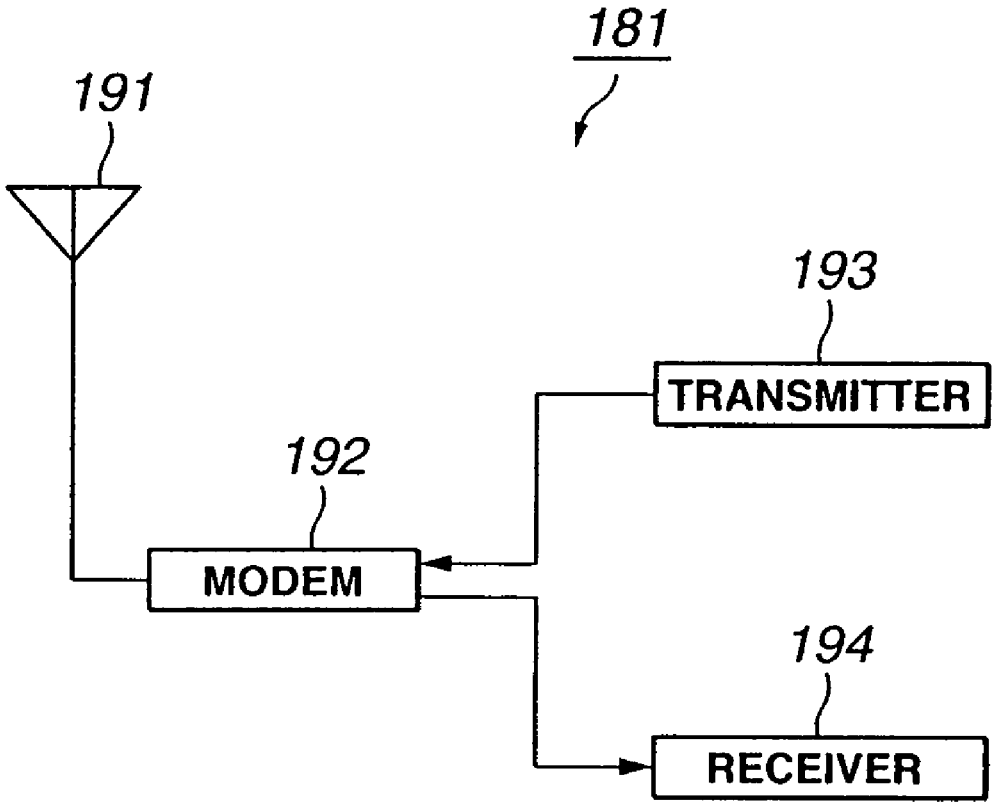
FIG. 21 is a block diagram for illustrating the portable telephone set embodying the present invention.

FIG. 21 shows an illustrative structure of the portable telephone set 181 shown in FIG. 20.

An antenna 191 receives electrical waves from the base stations $\mathbf{182}_1$, $\mathbf{182}_2$ to send the received signals to a modem 192 as well as to send the signals from the modem 192 to the base stations $\mathbf{182}_1$, $\mathbf{182}_2$ as electrical waves. The modem 192 demodulates the signals from the antenna 191 to send the resulting code data explained in FIG. 1 to a receipt unit 194. The modem 192 also is configured for modulating the code data from the transmitter 193 as shown in FIG. 1 and sends the resulting modulated signal to the antenna 191. The transmission unit 193 is configured similarly to the transmission unit shown in FIG. 1 and codes the user's speech input thereto into code data which is sent to the modem 192. The receipt unit 194 receives the code data from the modem 192 to decode and output the speech of high sound quality similar to that obtained in the speech synthesis device of FIG. 14.

Figure 22:
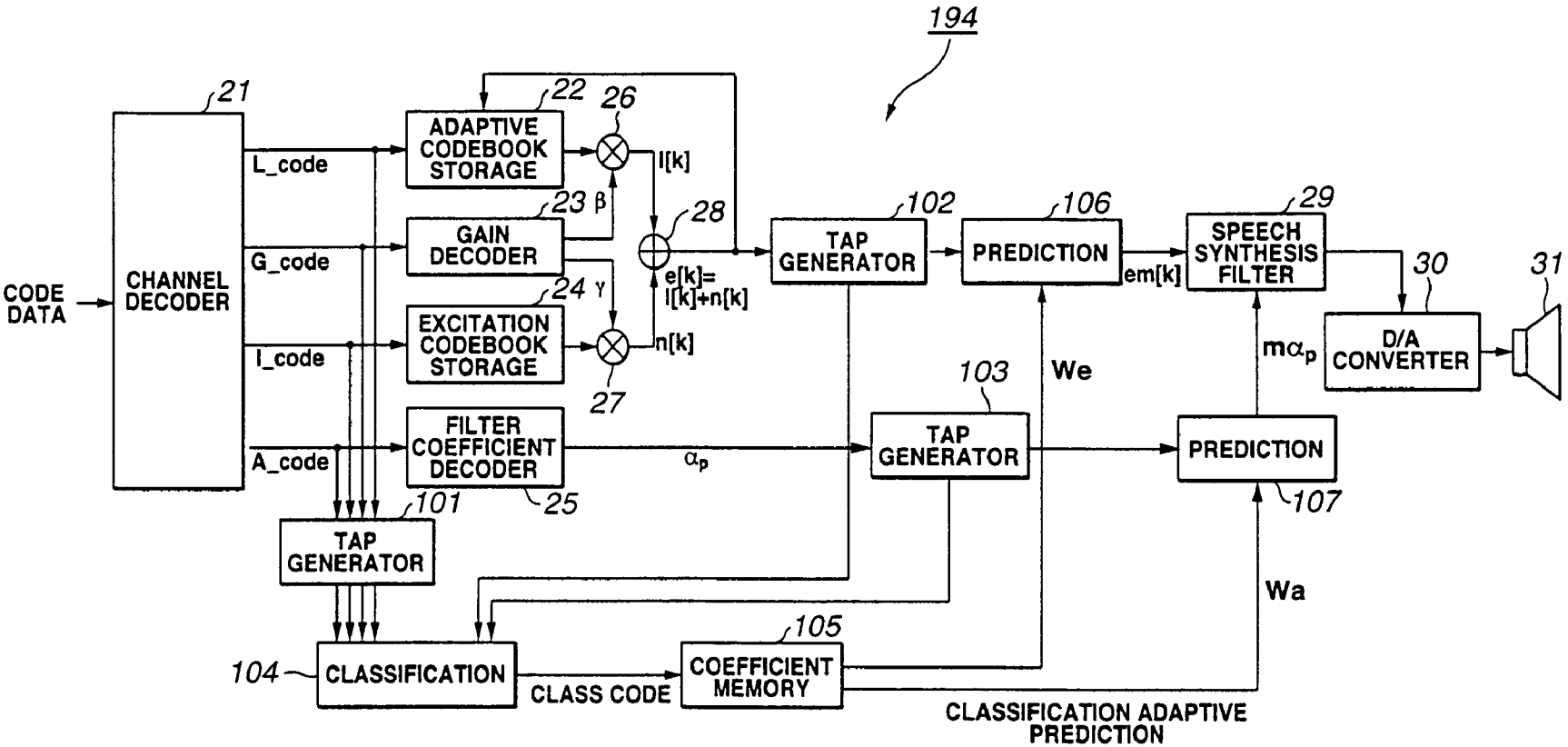
FIG. 22 is a block diagram showing the receiver forming the portable telephone set.

That is, FIG. 22 shows an illustrative structure of the receipt unit 194 of FIG. 21. In the drawing, parts or components corresponding to those shown in FIG. 2 are depicted by the same reference numerals and are not explained specifically.

The tap generator 101 is fed with frame-based or subframe-based L, G and A codes, output by a channel decoder 21. The tap generator 101 generates what are to be class taps, from the L, G, I and A codes, to route the extracted class taps to a classification unit 104. The class taps, constructed by e.g., records, generated by the tap generator 101, are sometimes referred to below as first class taps.

The tap generator 102 is fed with frame-based or subframe-based residual signals e, output by the operating unit 28. The tap generator 102 extracts what are to be class taps (sample points) from the residual signals to route the resulting class taps to the classification unit 104. The tap generator 102 also extracts what are to be prediction taps from the residual signals from the operating unit 28 to route the resulting prediction taps to the classification unit 106. The class taps, constructed by e.g., residual signals, generated by the tap generator 102, are sometimes referred to below as second class taps.

The tap generator 103 is fed with frame-based or subframe-based linear prediction coefficients $\alpha_1$, output by the filter coefficient decoder 25. The tap generator 103 extracts what are to be class taps from the linear prediction coefficients to route the resulting class taps to the classification unit 104. The tap generator 103 also extracts what are to be prediction taps from the linear prediction coefficients from the filter coefficient decoder 25 to route the resulting prediction taps to the prediction unit 107. The class taps, constructed by e.g., the linear prediction coefficients, generated by the tap generator 103, are sometimes referred to below as third class taps.

The classification unit 104 integrates the first to third class taps, supplied from the tap generators 101 to 103, to form ultimate class taps. Based on these ultimate class taps, the classification unit 104 performs the classification to send the class code as being the result of the classification to the coefficient memory 105.

Figure 23:
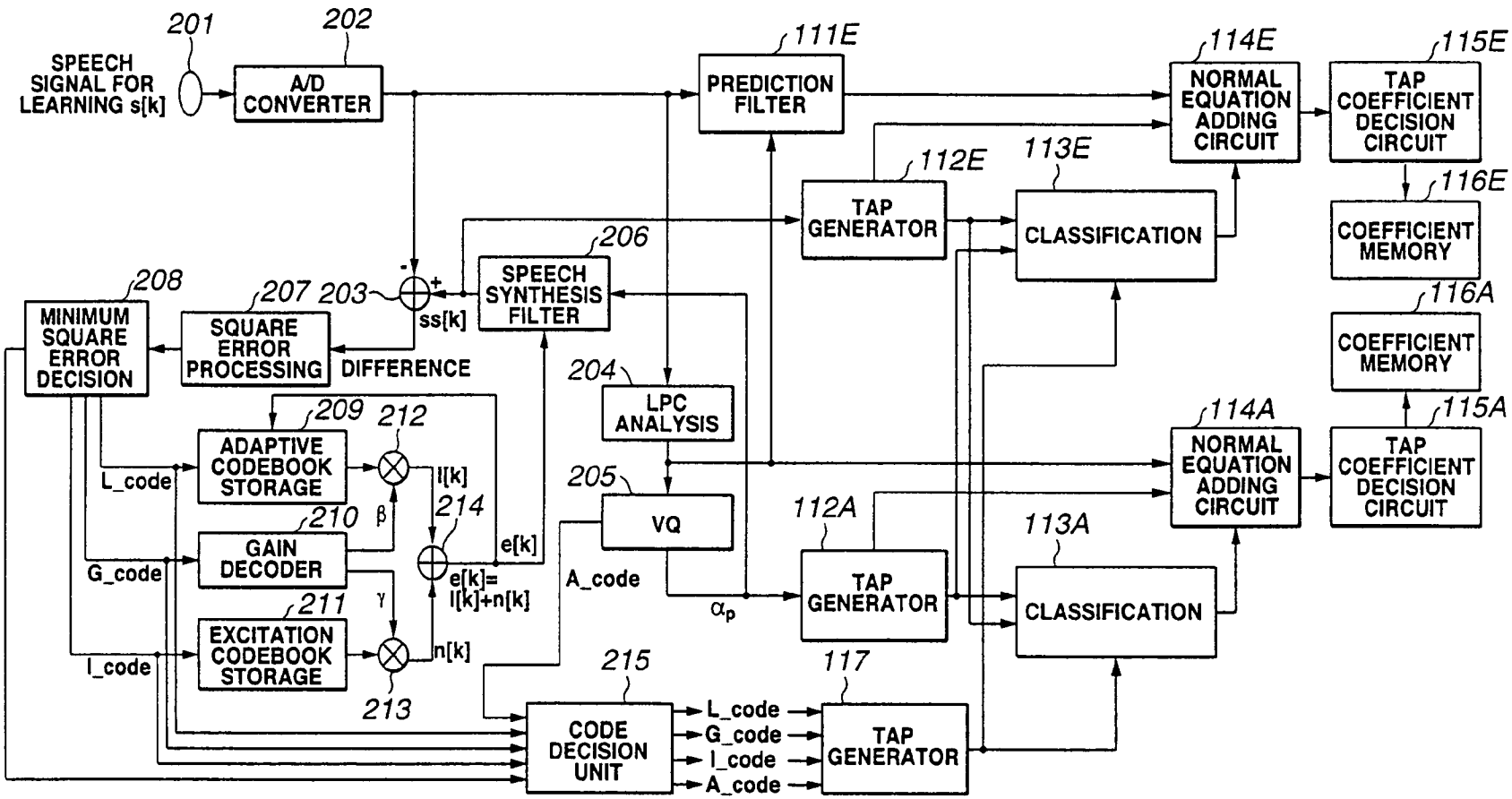
FIG. 23 is a block diagram showing still another modification of the learning device embodying the present invention.

The coefficient memory 105 holds the tap coefficients pertinent to the class-based linear prediction coefficients and the tap coefficients pertinent to the residual signals, as obtained by the learning processing in the learning device of FIG. 23, as will be explained subsequently. The coefficient memory 105 outputs the tap coefficients stored in the address associated with the class code output by the classification unit 104 to the prediction units 106 and 107. Meanwhile, tap coefficients We pertinent to the residual signals are sent from the coefficient memory 105 to the prediction unit 106, while tap coefficients Wa pertinent to the linear prediction coefficients are sent from the coefficient memory 105 to the prediction unit 107.

Similarly to the prediction unit 146E, the prediction unit 106 acquires the prediction taps output by the tap generator 102 and the tap coefficients pertinent to the residual signals, output by the coefficient memory 105, and performs the linear predictive calculations of the equation (6), using the prediction taps and the tap coefficients. In this manner, the prediction unit 106 finds a predicted value em of the residual signals of the frame of interest to send the predicted value em to the speech synthesis unit 29 as an input signal.

Similarly to the prediction unit 146A of FIG. 14, the prediction unit 107 acquires the prediction taps output by the tap generator 103 and tap coefficients pertinent to the linear prediction coefficients output by the coefficient memory and, using the prediction taps and the tap coefficients, executes the linear predictive calculations of the equation (6). So, the prediction unit 107 finds a predicted value $m\alpha_p$ of the linear prediction coefficients of the frame of interest to send the so found out predicted value to the speech synthesis unit 29.

In the receipt unit 194, constructed as described above, the processing which is basically the same as the processing conforming to the flowchart of FIG. 16 is carried out to output the synthesized speech of the high sound quality as being the result of the speech decoding.

That is, the channel decoder 21 separates the L, G, I and A codes, from the code data, supplied thereto, to send the so separated codes to the adaptive codebook storage unit 22, gain decoder 23, excitation codebook storage unit 24 and to the filter coefficient decoder 25, respectively. The L, G, I and A codes are also sent to the tap generator 101.

The adaptive codebook storage unit 22, gain decoder 23, excitation codebook storage unit 24 and the operating units 26 to 28 perform the processing similar to that performed in the adaptive codebook storage unit 9, gain decoder 10, excitation codebook storage unit 11 and in the operating units 12 to 14 of FIG. 1 to decode the L, G and I codes to residual signals e. These residual signals are routed from the operating unit 28 and to the tap generator 102.

As explained with reference to FIG. 1, the filter coefficient decoder 25 decodes the A codes, supplied thereto, into linear prediction coefficients, which are routed to the tap generator 103.

The tap generator 101 renders the frames of the L, G, I and A codes, supplied thereto, the frame of interest. At step S101 (FIG. 16), the tap generator 101 generates first class taps from the L, G, I and A codes from the channel decoder 21 to send the so generated first class taps to the classification unit 104. At step S101, the tap generator 102 generates second class taps from the decoded residual signals from the operating unit 28 to send the so generated second class taps to the classification unit 104, while the tap generator 103 generates the third class taps from the linear prediction coefficients from the filter coefficient decoder 25 to send the so generated third class taps to the classification unit 104. At step S101, the tap generator 102 generates what are to be prediction taps from the residual signals from the operating unit 28 to send the prediction taps to the prediction unit 106, while the tap generator 102 generates prediction taps from the linear prediction coefficients from the filter coefficient decoder 25 to send the so generated prediction taps to the prediction unit 107.

At step S102, the classification unit 104 executes classification based on ultimate class taps which have combined the first to third class taps supplied from the tap generators 101 to 103 and sends the resulting class codes to the coefficient memory 105. The program then moves to step S103.

At step S103, the coefficient memory 105 reads out the tap coefficients concerning the residual signals and the linear prediction coefficients, from the address associated with the class code as supplied from the classification unit 104, and sends the tap coefficients pertinent to the residual signals and the tap coefficients pertinent to the linear prediction coefficients to the prediction units 106, 107, respectively.

At step S104, the prediction unit 106 acquires the tap coefficients concerning the residual signals, output from the coefficient memory 105, and executes the sum-of-products processing of the equation (6), using the so acquired tap coefficients and the prediction taps from the tap generator 102, to acquire predicted values of true residual signals of the frame of interest. At this step S104, the prediction unit 107 also acquires the tap coefficients pertinent to the linear prediction coefficients output by the prediction unit 105 and, using the so acquired tap coefficients and the tap coefficients from the tap generator 103, performs the sum-of-products processing of the equation (6) to acquire predicted values of true linear prediction coefficients of the frame of interest.

The residual signals and the linear prediction coefficients, thus acquired, are routed to the speech synthesis unit 29, which then performs the processing of the equation (4), using the residual signals and the linear prediction coefficients, to generate the synthesized sound signal of the frame of interest. These synthesized sound signals are sent from the speech synthesis unit 29 through the D/A converter 30 to the loudspeaker 31 which then outputs the synthesized sound corresponding to the synthesized sound signals.

After the residual signals and the linear prediction coefficients have been acquired by the prediction units 106, 107, the program moves to step S105 where it is verified whether or not there are yet L, G, I or A codes of the frame to be processed as the frame of interest. If it is found at step S105 that there are as yet the L, G, I or A codes of the frame to be processed as the frame of interest, the program reverts to step S101 to set the frame to be the next frame of interest as the new frame of interest to repeat the processing similar to that described above. If it is found at step S105 that there are no L, G, I or A codes of the frame to be processed as the frame of interest, the processing is terminated.

An instance of a learning device for performing the learning processing of tap coefficients to be stored in the coefficient memory 105 shown in FIG. 22 is now explained with reference to FIG. 23. In the following explanation, parts or components common to those of the learning device shown in FIG. 12 are depicted by corresponding reference numerals.

The components from the microphone 201 to the code decision unit 215 are configured similarly to the components from the microphone 1 to the code decision unit 15. The microphone 201 is fed with speech signals for learning, so that the components from the microphone 201 to the code decision unit 215 perform the processing similar to that shown in FIG. 1.

A prediction filter 111E is fed with speech signals for learning, as digital signals, output by the A/D converter 202, and with the linear prediction coefficients, output by the LPC analysis unit 204. The tap generator 112A is fed with the linear prediction coefficients, output by the vector quantizer 205, that is linear prediction coefficients forming the code vectors (centroid vector) of the codebook used for vector quantization, while the tap generator 112E is fed with residual signals output by the operating unit 214, that is the same residual signals as those sent to the speech synthesis filter 206. The normal equation addition circuit 114A is fed with the linear prediction coefficients output by the LPC analysis unit 204, whilst the tap generator 117 is fed with the L, G, I and A codes output by the code decision unit 215.

The prediction filter 111E sequentially sets the frames of the speech signals for learning, sent from the A/D converter 202, and executes e.g., the processing complying with the equation (1), using the speech signals for the frame of interest and the linear prediction coefficients supplied from the LPC analysis unit 204, to find the residual signals for the frame of interest. These residual signals are sent as teacher data to the normal equation addition circuit 114E.

From the linear prediction coefficients, supplied from the vector quantizer 205, the tap generator 112A forms the same prediction taps as those in the tap generator 103 of FIG. 11, and third class taps, and routes the third class taps to the classification units 113A, 113E, while routing the prediction taps to the normal equation addition circuit 114A.

From the linear prediction coefficients, supplied from the operating unit 214, the tap generator 112E forms the same prediction taps as those in the tap generator 102 of FIG. 22, and second class taps, and routes the second class taps to the classification units 113A, 113E, while routing the prediction taps to the normal equation addition circuit 114E.

The classification units 113A, 113E are fed with the third and second class taps, from the tap generators 112A, 112E, respectively, while being fed with the first class taps from the tap generator 117. Similarly to the classification unit 104 of FIG. 22, the classification units 113A, 113E integrate the first to third class taps, supplied thereto, to form ultimate class taps. Based on these ultimate class taps, the classification units perform the classification to send the class code to the normal equation addition circuits 114A, 114E.

The normal equation addition circuit 114A receives the linear prediction coefficients of the frame of interest from the LPC analysis unit 204, as teacher data, while receiving the prediction taps from the tap generator 112A, as pupil data. The normal equation addition circuit performs the summation, as the normal equation addition circuit 166A of FIG. 17, for the teacher data and the pupil data, from one class code from the classification unit 113A to another, to set the normal equation (13) pertinent to the linear prediction coefficients, from one class to another. The normal equation addition circuit 114E receives the residual signals of the frame of interest from the prediction unit 111E, as teacher data, while receiving the prediction taps from the tap generator 112E, as pupil data. The normal equation addition circuit performs the summation, as the normal equation addition circuit 166E of FIG. 17, for the teacher data and the pupil data, from one class code from the classification unit 113E to another, to set the normal equation (13) pertinent to the residual signals, from one class to another. A tap coefficient decision circuit 115A and a tap coefficient decision circuit 115E solve the normal equation, generated in the normal equation addition circuits 114A, 114E, from class to class, to find tap coefficients pertinent to the linear prediction coefficients and the residual signals for the respective classes. The tap coefficients, thus found, are sent to the addresses of the coefficient memories 116A, 116E associated with the respective classes.

Depending on the speech signals, provided as speech signals for learning, there are occasions wherein, in a class or classes, a number of the normal equations required to find the tap coefficients cannot be produced in the normal equation addition circuits 114A, 114E. For such class(es), the tap coefficient decision circuits 115A, 115E outputs e.g., default tap coefficients.

The coefficient memories 116A, 116E memorize the class-based tap coefficients pertinent to linear prediction coefficients and residual signals, supplied from the tap coefficient decision circuits 115A, 115E, respectively.

From the L, G, I and the A codes, supplied from the code decision unit 215, the tap generator 117 generates the same first class taps as those in the tap generator 101 of FIG. 22, to send the so generated class taps to the classification units 113A, 113E.

The above-described learning device basically performs the same processing as the processing conforming to the flowchart of FIG. 19 to find the tap coefficients necessary to produce the synthesized sound of high sound quality.

The learning device is fed with the speech signals for learning and generates teacher data and pupil data at step S111 from the speech signals for learning.

That is, the speech signals for learning are input to the microphone 201. The components from the microphone 201 to the code decision unit 215 perform the processing similar to that performed by the microphone 1 to the code decision unit 15 of FIG. 1.

The linear prediction coefficients, acquired by the LPC analysis unit 204, are sent as teacher data to the normal equation addition circuit 114A. These linear prediction coefficients are also sent to the prediction filter 111E. The residual signals, obtained in the operating unit 214, are sent as pupil data to the tap generator 112E.

The digital speech signals, output by the A/D converter 202, are sent to the prediction filter 111E, while the linear prediction coefficients, output by the vector quantizer 205, are sent as pupil data to the tap generator 112A. The L, G, I and A codes, output by the code decision unit 215, are sent to the tap generator 117.

The prediction filter 111E sequentially renders the frames of the speech signals for learning, supplied from the A/D converter 202, the frame of interest, and executes the processing conforming to the equation (1), using the speech signals of the frame of interest and the linear prediction coefficients supplied from the LPC analysis unit 204, to find the residual signals of the frame of interest. The residual signals, obtained by this prediction filter 111E, are sent as teacher data to the normal equation addition circuit 114E.

After acquisition of the teacher and pupil data as described above, the program moves to step S112 where the tap generator 112A generates prediction taps pertinent to linear prediction coefficients supplied from the vector quantizer 205, and third class taps, from the linear prediction coefficients, while the tap generator 112E generates the prediction taps pertinent to residual signals supplied from the operating unit 214, and the second class taps, from the residual signals. Further, at step S112, the first class taps are generated by the tap generator 117 from the L, G, I and A codes supplied from the code decision unit 215.

The prediction taps pertinent to the linear prediction coefficients are sent to the normal equation addition circuit 114A, while the prediction taps pertinent to the residual signals are sent to the normal equation addition circuit 114E. The first to third class taps are sent to the classification circuits 113A, 113E.

Subsequently, at step S113, the classification units 113A, 113E perform classification, based on the first to third class taps, to send the resulting class code to the normal equation addition circuits 114A, 114E.

The program then moves to step S114, where the normal equation addition circuit 114A performs the aforementioned summation of the matrix A and the vector v of the equation (13), for the linear prediction coefficients of the frame of interest from the LPC analysis unit 204, as teacher data, and for the prediction taps from the tap generator 112A, as pupil data, for each class code from the classification unit 113A. At step S114, the normal equation addition circuit 114E performs the aforementioned summation of the matrix A and the vector v of the equation (13), for the residual signals of the frame of interest as teacher data from the prediction filter 111E and for the prediction taps as pupil data from the tap generator 112E, for each class code from the classification unit 113E. The program then moves to step S115.

At step S115, it is verified whether or not there is any speech signal for learning for the frame to be processed as the frame of interest. If it is verified at step S115 that there is any speech signal for learning of the frame to be processed as the frame of interest, the program reverts to step S111 where the next frame is set as a new frame of interest. The processing similar to that described above then is repeated.

If it is verified at step S115 that there is no speech signal for learning of the frame to be processed as the frame of interest, that is if the normal equation is obtained in each class in the normal equation addition circuits 114A, 114E, the program moves to step S116 where the tap coefficient decision circuit 115A solves the normal equation generated for each class to find the tap coefficients for the linear prediction coefficients for each class. These tap coefficients are sent to the address associated with each class of the coefficient memory 116A for storage therein. The tap coefficient decision circuit 115E solves the normal equation generated for each class to find the tap coefficients for the residual signals for each class. These tap coefficients are sent to the address associated with each class of the coefficient memory 116E for storage therein. This finishes the processing.

The tap coefficients pertinent to the linear prediction coefficients for each class, thus stored in the coefficient memory 116A, are stored in the coefficient memory 105 of FIG. 22, while the tap coefficients pertinent to the class-based residual signals stored in the coefficient memory 116E are stored in the same coefficient memory.

Consequently, the tap coefficients stored in the coefficient memory 105 of FIG. 22 have been found on learning so that the prediction errors of the prediction values of the true linear prediction coefficients or residual signals, obtained on carrying out linear predictive calculations, herein square errors, will be statistically minimum, and hence the residual signals and the linear prediction coefficients, output by the prediction units 106, 107 of FIG. 22, are substantially coincident with the true residual signals and with the true linear prediction coefficients, respectively, with the result that the synthesized sound generated by these residual signals and the linear prediction coefficients are free of distortion and of high sound quality.

The above-described sequence of operations may be carried out by hardware or by software. If the sequence of operations is carried out by software, the program forming the software is installed on e.g., a general-purpose computer.

The computer on which is installed the program for executing the above-described sequence of operations is configured as shown in FIG. 13 as described above and the operation similar to that performed by the computer shown in FIG. 13 is executed, and hence is not explained specifically for simplicity.

Referring to the drawings, a further modification of the present invention is hereinafter explained.

The speech synthesis device is fed with code data multiplexed from the residual code and the A code encoded e.g., on vector quantization from the residual signals and the linear prediction coefficients applied to a speech synthesis filter 244. From the residual code and the A code, the residual signals and the linear prediction coefficients are decoded and sent to the speech synthesis filter 244 to generate the synthesized sound. The present speech synthesis device is designed to perform predictive processing, using the synthesized sound synthesized by the speech synthesis filter and the tap coefficients as found on learning to find and output the speech of high sound quality (synthesized sound) which is the synthesized sound improved in sound quality.

Figure 24:
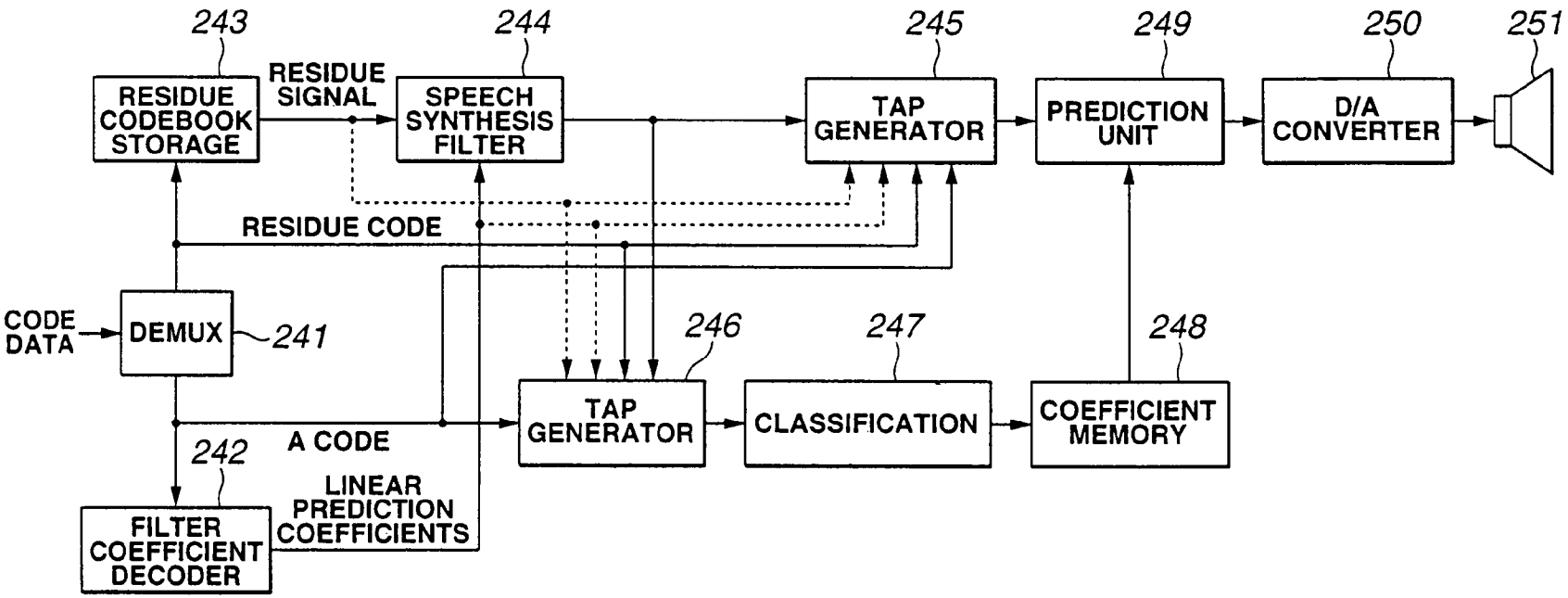
FIG. 24 is a block diagram showing still another typical structure of a speech synthesis device embodying the present invention.

That is, the speech synthesis device, shown in FIG. 24, exploits the classification adaptive processing to decode the synthesized sound into predicted values of the true speech of high sound quality.

The classification adaptive processing is comprised of the classification processing and the adaptive processing. By the classification processing, data are classified according to properties and subjected to adaptive processing from class to class. The adaptive processing is carried out in the manner as described above and hence reference may be made to the previous description to omit the detailed description here for simplicity.

The speech synthesis device, shown in FIG. 24, decodes the decoded linear prediction coefficients to true linear prediction coefficients, more precisely predicted values thereof, by the above-described classification adaptive processing, while decoding the decoded residual signals to true residual signals, more precisely predicted values thereof.

That is, a demultiplexer (DEMUX) 241 is fed with code data and separates the frame-based A code and residual code from the code data supplied thereto. The demultiplexer 241 sends the A code to a filter coefficient decoder 242 and to tap generators 245, 246 to send the residual code to a residual codebook storage unit 243 and to tap generators 245, 246.

It should be noted that the A code and the residual code, contained in the code data of FIG. 24, are obtained on vector quantization of the linear prediction coefficients and the residual signals, both obtained on LPC analyzing the speech, using a preset codebook.

The filter coefficient decoder 242 decodes the frame-based A code, supplied from the demultiplexer 241, into linear prediction coefficients, based on the same codebook as that used in producing the A code, to send the so decoded linear prediction coefficients to the speech synthesis filter 244.

The residual codebook storage unit 243 decodes the frame-based residual code, supplied from the demultiplexer 241, based on the same codebook as that used in obtaining the residual code, to send the resulting residual signals to the speech synthesis filter 244.

Figure 2:
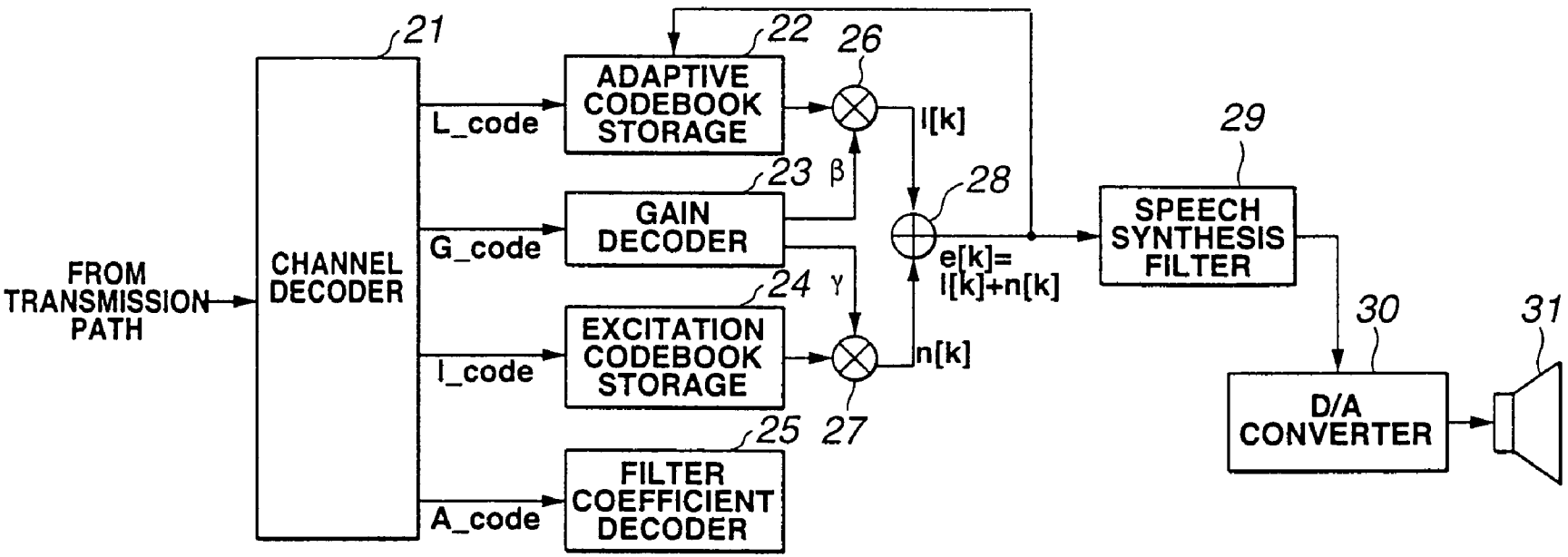
FIG. 2 is a block diagram showing a typical receiver.

Similarly to the speech synthesis filter 29, shown in FIG. 2, the speech synthesis filter 244 is an IIR type digital filter, and filters the residual signals from the residual codebook storage unit 243, as an input signal, with the linear prediction coefficients from the filter coefficient decoder 242 as tap coefficients of the IIR filter, to generate the synthesized sound, which is sent to the tap generators 245, 246.

The tap generator 245 extracts, from the sample values of the synthesized sound sent from the speech synthesis filter 244, and from the residual code and the code A, supplied from the demultiplexer 241, what are to be prediction taps used in predictive calculations in a prediction unit 249 as later explained. That is, the tap generator 245 sets the A code, residual code and the sample values of the synthesized sound of the frame of interest, for which predicted values of the high sound quality speech, for example, are to be found, as the prediction taps. The tap generator 245 routes the prediction taps to the prediction unit 249.

The tap generator 246 extracts what are to be class taps from the sample values of the synthesized sound supplied from the speech synthesis filter 244, and from the frame- or subframe-based A code and the residual code supplied from the demultiplexer 241. Similarly to the tap generator 245, the tap generator 246 sets all of the sample values of the synthesized sound of the frame of interest, the A code and the residual code, as the class taps. The tap generator 246 sends the class taps to a classification unit 247.

The pattern of configuration of the prediction and class taps is not to be limited to the above-mentioned pattern. Although the class and prediction taps are the same in the above case, the class taps and the prediction taps may be different in configuration from each other.

In the tap generator 245 or 246, the class taps and the prediction taps can also be extracted from the linear prediction coefficients, obtained from the A code, output from the filter coefficient decoder 242, or from the residual signals obtained from the residual codes, output from the residual codebook storage unit 243, as indicated by dotted lines in FIG. 24.

Based on the class taps from the tap generator 246, the classification unit 247 classifies the speech sample values of the frame of interest, and outputs the class code, corresponding to the resulting class, to a coefficient memory 248.

It is also possible for the classification unit 247 to output the bit strings per se, forming the sample values of the synthesized sound of the frame of interest, as class taps, the A code and the residual code.

The coefficient memory 248 holds class-based tap coefficients, obtained on learning in the learning device of FIG. 27, as later explained, and outputs to the prediction unit 249 the tap coefficients stored in the address corresponding to the class code output by the classification unit 247.

If N samples of the speech of the high sound quality may be found for each frame, N sets of tap coefficients are needed to obtain N samples of the speech by the predictive calculations of the equation (6) for the frame of interest. Thus, in the present case, n sets of the tap coefficients are stored in the address of the coefficient memory 248 associated with one class code.

The prediction unit 249 acquires the prediction taps output by the tap generator 245 and the tap coefficients output by the coefficient memory 248 and performs linear predictive calculations as indicated by the equation (6) to find predicted values of the speech of the high sound quality of the frame of interest to output the resulting predicted values to a D/A converter 250.

The coefficient memory 248 outputs N sets of tap coefficients for finding each of N samples of the speech of the frame of interest, as described above. The prediction unit 249 executes the sum-of-products processing of the equation (6), using the prediction taps for respective sample values and a set of tap coefficients associated with the respective sample values.

The D/A converter 250 D/A converts the prediction values of the speech from the prediction unit 249 from digital signals into analog signals, which are sent to and output at the loudspeaker 51.

Figure 25:
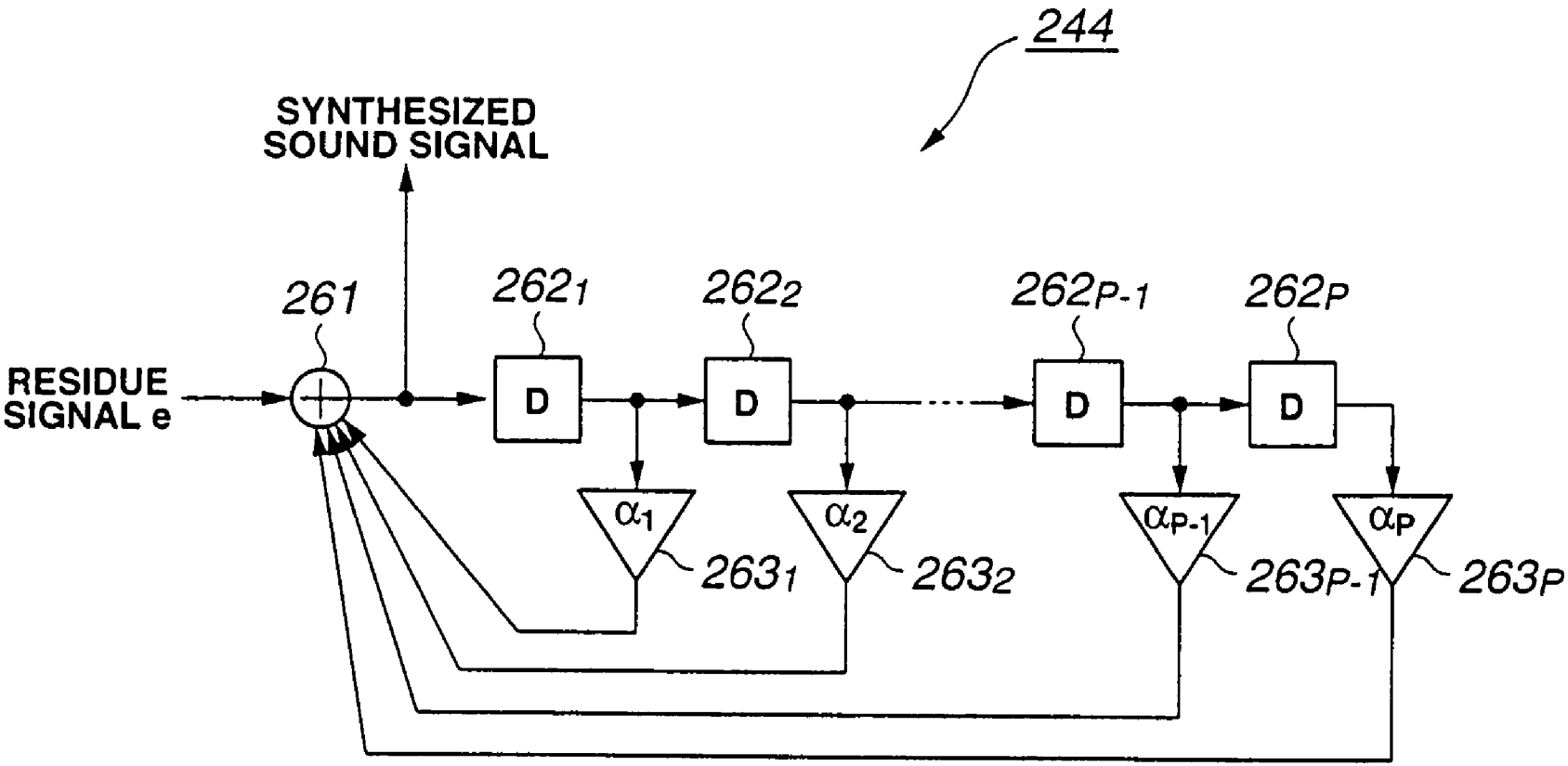
FIG. 25 is a block diagram showing a speech synthesis filter forming the speech synthesis device.

FIG. 25 shows a specified structure of the speech synthesis filter 244 shown in FIG. 24. The speech synthesis filter 244, shown in FIG. 25, uses p-dimensional linear prediction coefficients, and hence is formed by an adder 261, p delay circuits (D) $\mathbf{262}_1$ to $\mathbf{262}_p$ and p multipliers $\mathbf{263}_1$ to $\mathbf{263}_p$.

In the multipliers $\mathbf{263}_1$ to $\mathbf{263}_p$ are set p-dimensional linear prediction coefficients $\alpha_1, \alpha_2, \ldots, \alpha_p$, supplied from the filter coefficient decoder 242, so that the speech synthesis filter 244 performs the calculations conforming to the equation (4) to generate the synthesized sound.

That is, the residual signals e, output by the residual codebook storage unit 243, are sent through an adder 261 to a delay circuit $\mathbf{262}_1$. The delay circuit $\mathbf{262}_p$ delays the input signal thereto by one sample of the residual signals to output the resulting delayed signal to a downstream side delay circuit $\mathbf{262}_{p+1}$ and to an operating unit $\mathbf{263}_p$. The multiplier $\mathbf{263}_p$ multiplies an output of the delay circuit $\mathbf{262}_p$ with the linear prediction coefficient $\alpha_p$ set thereat to output the product value to the adder 261.

The adder 261 sums all outputs of the multipliers $\mathbf{263}_1$ to $\mathbf{263}_p$ and the residual signals e to send the resulting sum to a delay circuit $\mathbf{262}_1$ as well as to output the result of speech synthesis (synthesized sound).

Figure 26:
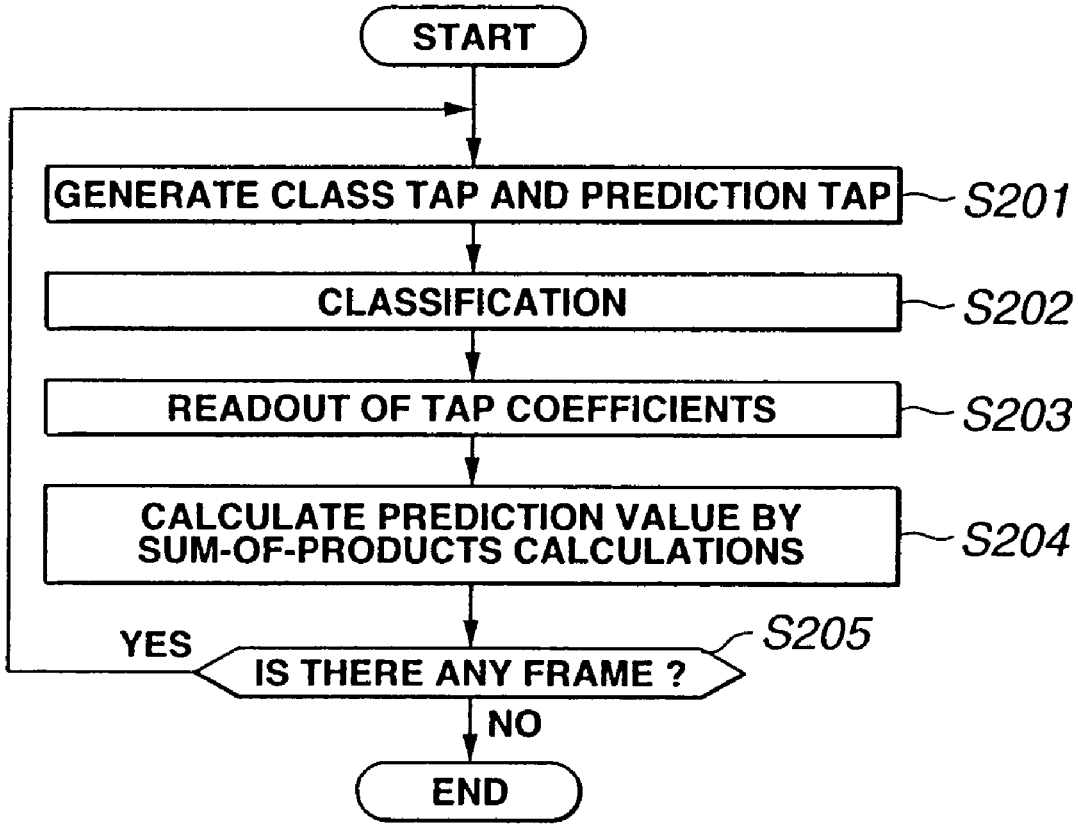
FIG. 26 is a flowchart for illustrating the processing of the speech synthesis device shown in FIG. 24.

Referring to the flowchart of FIG. 26, the speech synthesis processing of the speech synthesis device of FIG. 24 is explained.

The demultiplexer 241 sequentially separates the A code and the residual code, from the code data supplied thereto, on the frame basis, to send the respective codes to the filter coefficient decoder 242 and to the residual codebook storage unit 243. The demultiplexer 241 also sends the A code and the residual code to the tap generators 245, 246.

The filter coefficient decoder 242 sequentially decodes the frame-based A code, supplied from the demultiplexer 241, into linear prediction coefficients, which are then sent to the speech synthesis filter 244. The residual codebook storage unit 243 sequentially decodes the frame-based residual code, supplied from the demultiplexer 241, into residual signals, which are then sent to the speech synthesis filter 244.

The speech synthesis filter 244 then performs the calculations of the equation (4), using the residual signals and the linear prediction coefficients, supplied thereto, to generate the synthesized sound of the frame of interest. This synthesized sound is sent to the tap generators 245, 246.

The tap generator 245 sequentially renders the frame of the synthesized sound, supplied thereto, the frame of interest. At step S201, the tap generator 245 generates prediction taps, from the sample values of the synthesized sound supplied from the speech synthesis filter 244 and from the A code and the residual code, supplied from the demultiplexer 241, to output the so generated prediction taps to the prediction unit 249. At step S201, the tap generator 246 generates class taps, from the synthesized sound sent from the speech synthesis filter 244 and from the A code and the residual code, supplied from the demultiplexer 241, to route the so generated class taps to the classification unit 247.

At step S202, the classification unit 247 executes the classification, based on the class taps supplied from the tap generator 246, to send the resulting class code to the coefficient memory 248. The program then moves to step S203.

At step S203, the coefficient memory 248 reads out the tap coefficients from the address associated with the class code sent from the classification unit 247 to send the so read out tap coefficients to the prediction unit 249.

At step S204, the prediction unit 249 acquires the tap coefficients output by the coefficient memory 248 and, using the tap coefficients and the prediction taps from the tap generator 245, executes the sum-of-products processing of the equation (6) to acquire predicted values of the speech of high sound quality of the frame of interest. The speech of the high sound quality is sent to and output at the loudspeaker 251 from the prediction unit 249 through the D/A converter 250.

After the speech of the high sound quality is obtained at the prediction unit 249, the program moves to step S205 where it is verified whether or not there is any frame to be processed as the frame of interest. If it is verified at step S205 that there is any frame to be processed as the frame of interest, the program reverts to step S201 where a frame which is to become the next frame of interest is set as a new frame of interest. The similar processing is then repeated. If it is verified at step S205 that there is no frame to be processed, the speech synthesis processing is terminated.

Figure 27:
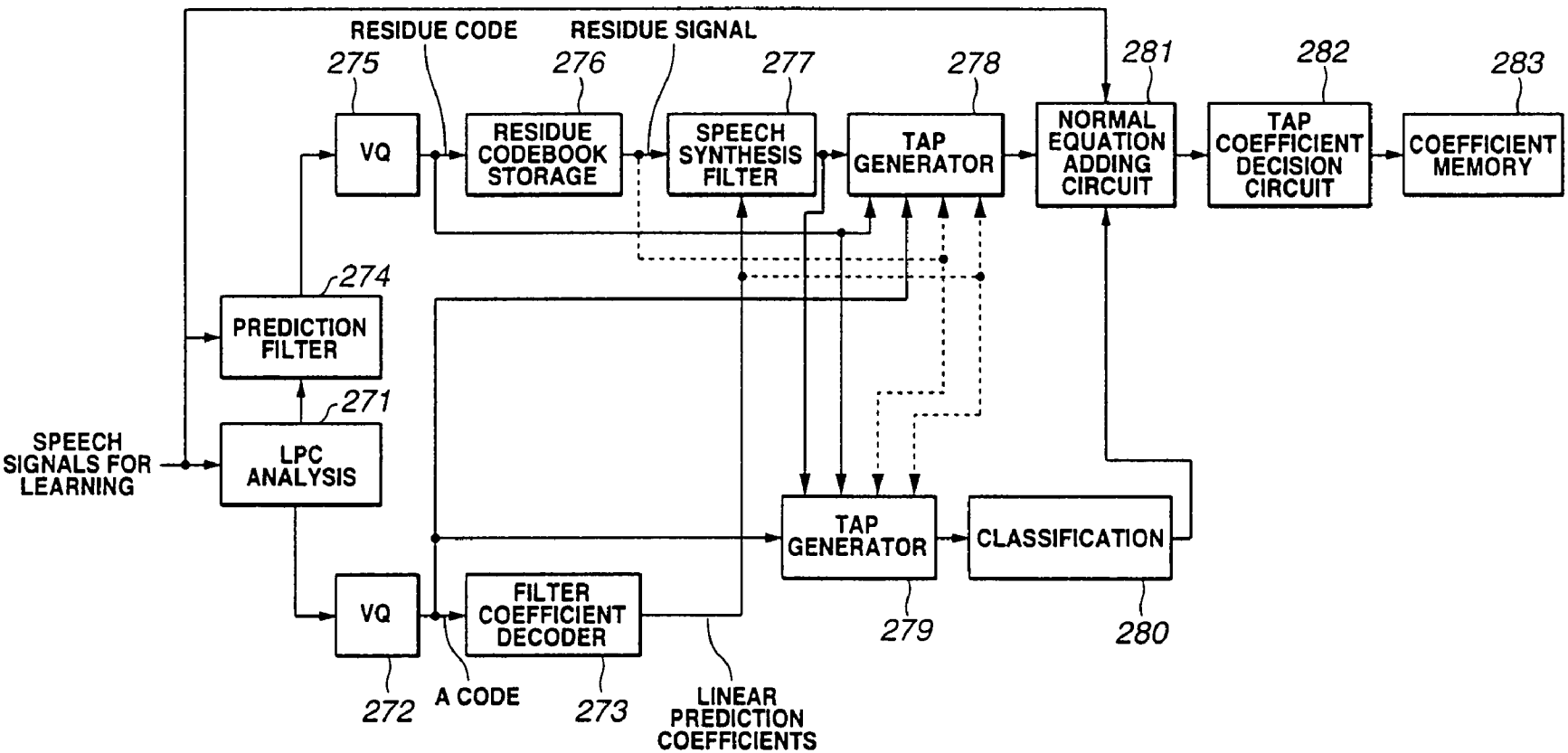
FIG. 27 is a block diagram showing a further modification of the learning device embodying the present invention.

FIG. 27 is a block diagram showing an instance of a learning device adapted for performing the learning of the tap coefficients to be stored in the coefficient memory 248 shown in FIG. 24.

The learning device shown in FIG. 27 is fed with digital speech signals for learning of high sound quality, in terms of a preset frame as a unit. The digital speech signals for learning are sent to an LPC analysis unit 271 and to a prediction filter 274. The digital speech signals for learning are also sent as teacher data to a normal equation addition circuit 281.

The LPC analysis unit 271 sequentially renders the frames of the speech signals, sent thereto, the frame of interest, and LPC-analyzes the speech signals of the frame of interest to find p-dimensional linear prediction coefficients, which then are sent to a vector quantizer 272 and to the prediction unit 274.

The vector quantizer 272 holds a codebook which associates code vectors having the linear prediction coefficients as the code vectors with the codes and, based on this codebook, vector-quantizes the feature vector formed by linear prediction coefficients of the frame of interest from the LPC analysis unit 271 to send the A code resulting from the vector quantization to the filter coefficient decoder 273 and to tap generators 278, 279.

The filter coefficient decoder 273 holds the same codebook as that stored in a vector quantizer 272 and, based on this codebook, decodes the A code from the vector quantizer 272 into linear prediction coefficients, which are sent to a speech synthesis filter 277. It should be noted that the filter coefficient decoder 242 of FIG. 24 is of the same structure as the filter coefficient decoder 273 of FIG. 27.

The prediction filter 274 performs the calculations conforming to the equation (1), using the speech signals of the frame of interest, supplied thereto, and the linear prediction coefficients from the LPC analysis unit 271, to find the residual signals of the frame of interest, which are routed to a vector quantizer 275.

That is, if the Z-transforms of $s_n$ and $e_n$ in the equation (1) are represented by S and E, respectively the equation (1) may be represented by:

$$E=(1+\alpha_1 z^{-1}+\alpha_2 z^{-2}+\ldots+\alpha_p z^{-p})S. \quad (16)$$

From the equation (14), the prediction filter 274 for finding the residual signals e may be designed as an FIR (Finite Impulse Response) digital filter.

Figure 28:
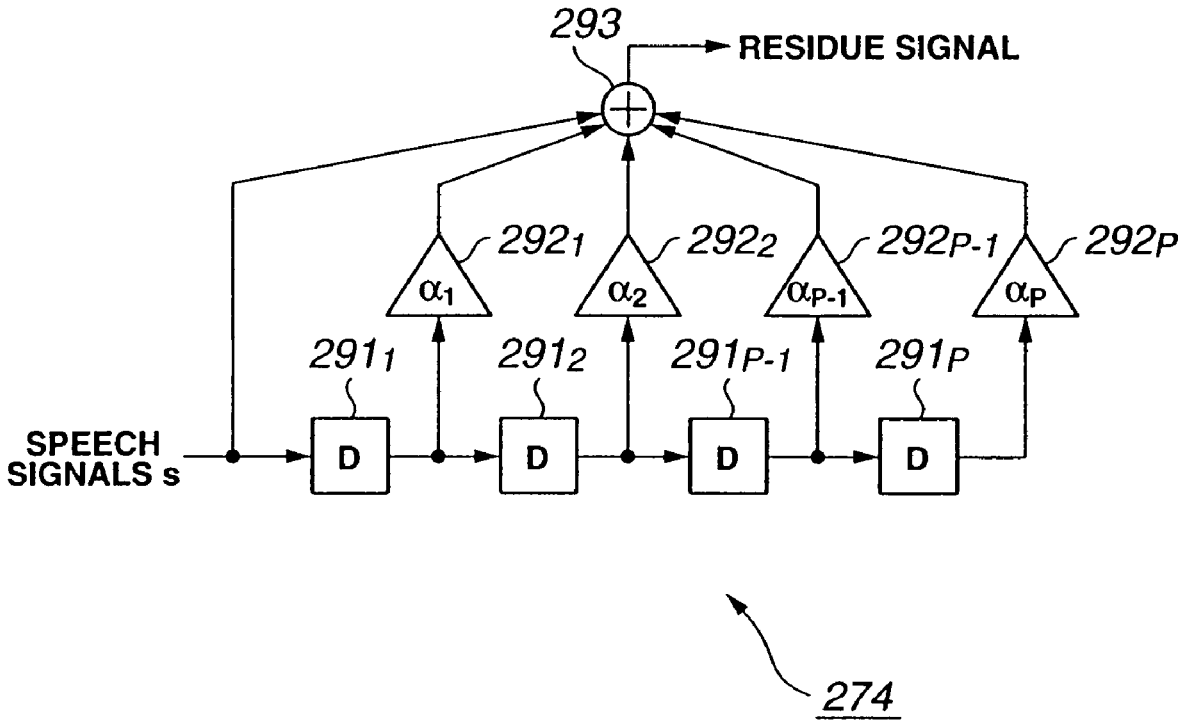
FIG. 28 is a block diagram showing a prediction filter forming the learning device according to the present invention.

FIG. 28 shows an illustrative structure of the prediction filter 274.

The prediction filter 274 is fed with p-dimensional linear prediction coefficients from the LPC analysis unit 271. So, the prediction filter 274 is made up of p delay circuits (D) $\mathbf{291}_1$ to $\mathbf{291}_p$, p multipliers $\mathbf{292}_1$ to $\mathbf{292}_p$ and a sole adder 293.

In the multipliers $\mathbf{292}_1$ to $\mathbf{292}_p$, there are set p-dimensional linear prediction coefficients $\alpha_1, \alpha_2, \ldots, \alpha_p$ supplied from the LPC analysis unit 271.

On the other hand, the speech signals s of the frame of interest are sent to a delay circuit $\mathbf{291}_1$ and to an adder 293. The delay circuit $\mathbf{291}_p$ delays the input signal thereat by one sample of the residual signals to output the delayed signal to a downstream side delay circuit $\mathbf{291}_{p+1}$ and to an operating unit $\mathbf{292}_p$. The multiplier $\mathbf{292}_p$ multiplies the output of the delay circuit $\mathbf{291}_p$ with the linear prediction coefficient $\alpha_p$ set thereat to send the result of addition as the residual signals e to the adder 293.

The adder 293 sums all outputs of the multipliers $\mathbf{292}_1$ to $\mathbf{292}_p$ and the speech signals s to send the results of addition as the residual signals e.

Referring to FIG. 27, the vector quantizer 275 holds a codebook which associates code vectors with sample values of the residual signals as components and, based on this codebook, vector-quantizes the residual vector, constituted by sample values of the residual signals e of the frame of interest from the prediction filter 274 to send the residual code resulting from the vector quantization to the residual codebook storage unit 276 and to the tap generators 278, 279.

The residual codebook storage unit 276 holds the same codebook as that stored in the vector quantizer 275 and, based on this codebook, decodes the residual code from the vector quantizer 275 into residual signals which are sent to the speech synthesis filter 277. It should be noted that the stored contents of the residual codebook storage unit 243 of FIG. 24 are the same as the stored contents of the residual codebook storage unit 276 of FIG. 27.

The speech synthesis filter 277 is an IIR type digital filter, constructed similarly to the speech synthesis filter 244 of FIG. 24 and filters the residual signals from the filter residual codebook storage unit 276, as an input signal, with the linear prediction coefficients from the filter coefficient decoder 273 as tap coefficients of the IIR filter, to generate the synthesized sound, which is sent to the tap generators 278, 279.

Similarly to the tap generator 245 of FIG. 24, the tap generator 278 forms prediction taps from the synthesized sound from the speech synthesis filter 277, the A code supplied from the vector quantizer 272 and from the residual code supplied from the vector quantizer 275 to send the so formed prediction taps to the normal equation addition circuit 281. Also, the tap generator 279, similarly to the tap generator 246 in FIG. 24, forms class taps from the synthesized sound from the speech synthesis filter 277, the A code supplied from the vector quantizer 272 and from the residual code supplied from the vector quantizer 275 to send the so formed class taps to the normal equation addition circuit 280.

Similarly to the classification unit 247 of FIG. 24, the classification unit 280 performs classification based on the class taps, supplied thereto, to send the resulting class code to the normal equation addition circuit 281.

The normal equation addition circuit 281 executes summation of the speech for learning, which is the speech of high sound quality of the frame of interest, as teacher data, and prediction taps from the tap generator 78, as pupil data.

That is, the normal equation addition circuit 281 performs calculations corresponding to reciprocal multiplication ($x_{in}x_{im}$) and summation ($\Sigma$) of pupil data, as respective components in the aforementioned matrix A of the equation (13), using the prediction taps (pupil data), from one class corresponding to the class code supplied from the classification unit 280 to another.

Moreover, the normal equation addition circuit 281 performs calculations corresponding to reciprocal multiplication ($x_{in}y_i$) and summation ($\Sigma$) of pupil data and teacher data, as respective components in the vector v of the equation (13), using the pupil data and the teacher data, from one class corresponding to the class code supplied from the classification unit 280 to another.

The aforementioned summation by the normal equation addition circuit 281 is carried out with the totality of the speech frames for learning, supplied thereto, to set a normal equation (13) for each class.

A tap coefficient decision circuit 281 solves the normal equation, generated in the normal equation addition circuit 281, from class to class, to find tap coefficients pertinent to the linear prediction coefficients and the residual signals for the respective classes. The tap coefficients, thus found, are sent to the addresses of the coefficient memory 283 associated with the respective classes.

Depending on the speech signals, provided as speech signals for learning, there are occasions wherein, in a certain class or classes, a number of the normal equations required to find the tap coefficients cannot be produced in the normal equation addition circuit 281. For such class(es), the tap coefficient decision circuit outputs e.g., default tap coefficients.

The coefficient memory 283 memorizes the class-based tap coefficients supplied from the tap coefficient decision circuit 281 in an address associated with the class.

Figure 29:
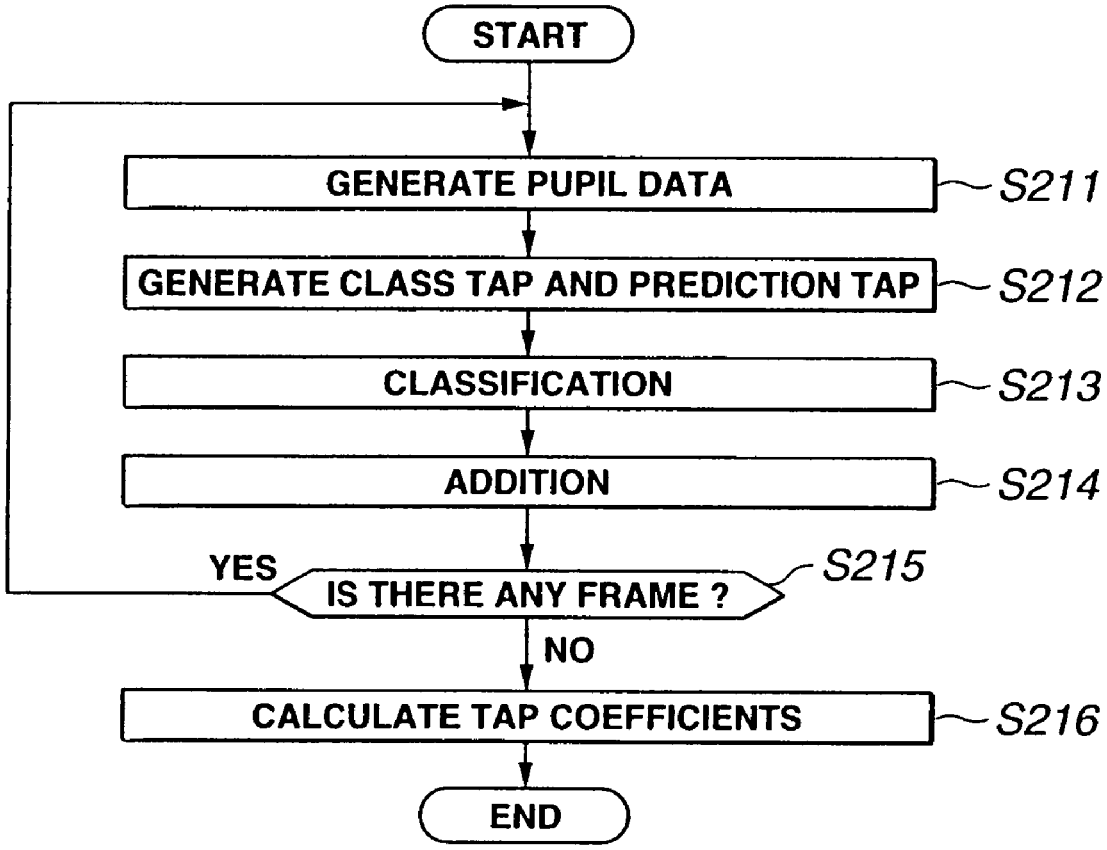
FIG. 29 is a flowchart for illustrating the processing of the learning device shown in FIG. 27.

Referring to the flowchart of FIG. 29, the learning processing of the learning device of FIG. 27 is explained.

The learning device is fed with speech signals for learning. The speech signals for learning are sent to the LPC analysis unit 271 and to the prediction filter 274, while being sent as teacher data to the normal equation addition circuit 281. At step S211, pupil data are generated from the speech signals for learning, as teacher data.

Specifically, the LPC analysis unit 271 sequentially sets the frames of the speech signals for learning as the frame of interest and LPC-analyzes the speech signals of the frame of interest to find p-dimensional linear prediction coefficients which are sent to the vector quantizer 272. The vector quantizer 272 vector-quantizes the feature vector formed by linear prediction coefficients of the frame of interest from the LPC analysis unit 271 to send the A code obtained on such vector quantization as pupil data to the filter coefficient decoder 273 and to the tap generators 278, 279. The filter coefficient decoder 273 decodes the A code from the vector quantizer 272 into linear prediction coefficients, which then are routed to the speech synthesis filter 277.

On receipt of the linear prediction coefficients of the frame of interest from the LPC analysis unit 271, the prediction filter 274 executes the calculations of the equation (1), using the linear prediction coefficients and the speech signals for learning of the frame of interest, to find the residual signals of the frame of interest, which are then routed to the vector quantizer 275. The vector quantizer 275 vector-quantizes the residual vector, formed by sample values of the residual signals of the frame of interest from the prediction filter 274, and routes the residual code obtained on vector quantization as pupil data to the residual codebook storage unit 276 and to the tap generators 278, 279. The residual codebook storage unit 276 decodes the residual code from the vector quantizer 275 into residual signals which are supplied to the speech synthesis filter 277.

Thus, on receipt of the linear prediction coefficients and the residual signals, the speech synthesis filter 277 synthesizes the speech, using the linear prediction coefficients and the residual signals, and sends the resulting synthesized sound as pupil data to the tap generators 278, 279.

The program then moves to step S212 where the tap generator 278 generates prediction taps and class taps from the synthesized sound supplied from the speech synthesis filter 277, A code supplied from the vector quantizer 272 and from the residual code supplied from the vector quantizer 275. The prediction taps and the class taps are sent to the normal equation addition circuit 281 and to the classification unit 280, respectively.

Subsequently, at step S213, the classification unit 280 performs classification, based on the class taps from the tap generator 279, to send the resulting class code to the normal equation addition circuit 281.

The program then moves to step S214, where the normal equation addition circuit 281 performs the aforementioned summation of the matrix A and the vector v of the equation (13), for the sample values of the speech of high sound quality of the frame of interest, supplied thereto, as teacher data, and for the prediction taps from the tap generator 278, as pupil data, for each class code from the classification unit 280. The program then moves to step S215.

At step S215, it is verified whether or not there is any speech signal for learning for the frame processed as the frame of interest. If it is verified at step S215 that there is any speech signal for learning of the frame processed as the frame of interest, the program reverts to step S211 where the next frame is set as a new frame of interest. The processing similar to that described above then is repeated.

If it is verified at step S215 that there is no speech signal for learning of the frame to be processed as the frame of interest, that is if the normal equation is obtained in each class in the normal equation addition circuit 281, the program moves to step S216 where the tap coefficient decision circuit 281 solves the normal equation generated for each class to find the tap coefficients for each class. These tap coefficients are sent to the address associated with each class of the coefficient memory 283 for storage therein. This finishes the processing.

The class-based tap coefficients, thus stored in the coefficient memory 283, are stored in the coefficient memory 248 of FIG. 24.

Consequently, the tap coefficients stored in the coefficient memory 248 of FIG. 3 have been found on learning so that the prediction errors of the prediction values of the true speech of high sound quality, obtained on carrying out linear predictive calculations, herein square errors, will be statistically minimum, so that the residual signals and the linear prediction coefficients, output by the prediction unit 249 of FIG. 24, are free of distortion proper to the synthesized sound produced in the speech synthesis filter 244 and hence of high sound quality.

If, in the tap generator 246 in the speech synthesis device, shown in FIG. 24, the class taps are to be extracted from the linear prediction coefficients and the residual signals, it is necessary for the tap generator 278 of FIG. 27 to extract similar class taps from the linear prediction coefficients generated by the filter coefficient decoder 273 or from the residual signals output by the residual codebook storage unit 276, as shown with dotted lines. The same holds for the prediction taps generated by the tap generator 245 of FIG. 24 or by the tap generator 278 of FIG. 27.

For simplifying the explanation in the above case, the classification is carried out as the bit string forming the class tap is directly used as the class code. In this case, however, the number of the classes may be of an exorbitant value. Thus, in the classification, the class taps may be compressed by e.g., vector quantization to use the bit string resulting from the compression as the class code.

An instance of the transmission system embodying the present invention is now explained with reference to FIG. 30. The system herein means a set of logically arrayed plural devices, while it does not matter whether or not the respective devices are in the same casing.

In this transmission system, the portable telephone sets $\mathbf{401}_1$, $\mathbf{401}_2$ perform radio transmission and receipt with base stations $\mathbf{402}_1$, $\mathbf{402}_2$, respectively, while the base stations $\mathbf{402}_1$, $\mathbf{402}_2$ perform speech transmission and receipt with an exchange station 403 to enable speech transmission and receipt between the portable telephone sets $\mathbf{401}_1$, $\mathbf{401}_2$ with the aid of the base stations $\mathbf{402}_1$, $\mathbf{402}_2$ and the exchange station 403. The base stations $\mathbf{402}_1$, $\mathbf{402}_2$ may be the same as or different from each other.

The portable telephone sets $\mathbf{401}_1$, $\mathbf{401}_2$ are referred to below as a portable telephone set 401, unless there is no particular necessity for making distinctions between the two sets.

Figure 30:
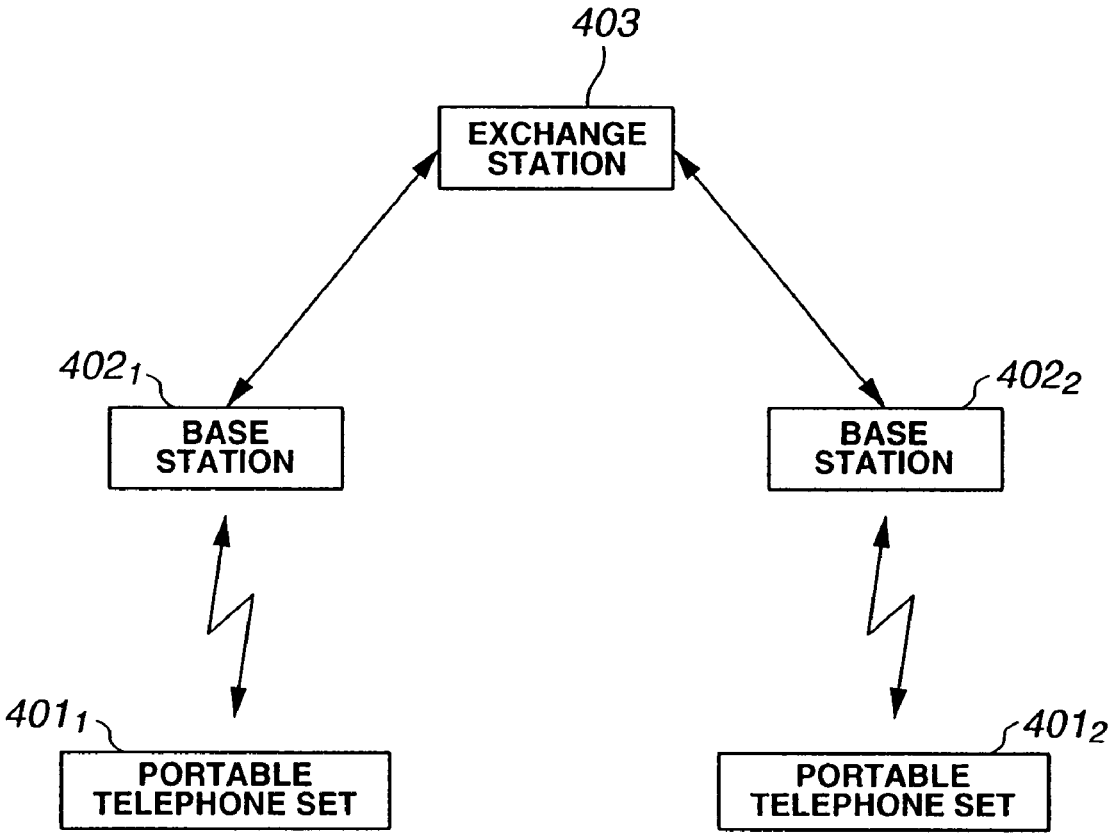
FIG. 30 is a block diagram showing a transmission system embodying the present invention.
Figure 31:
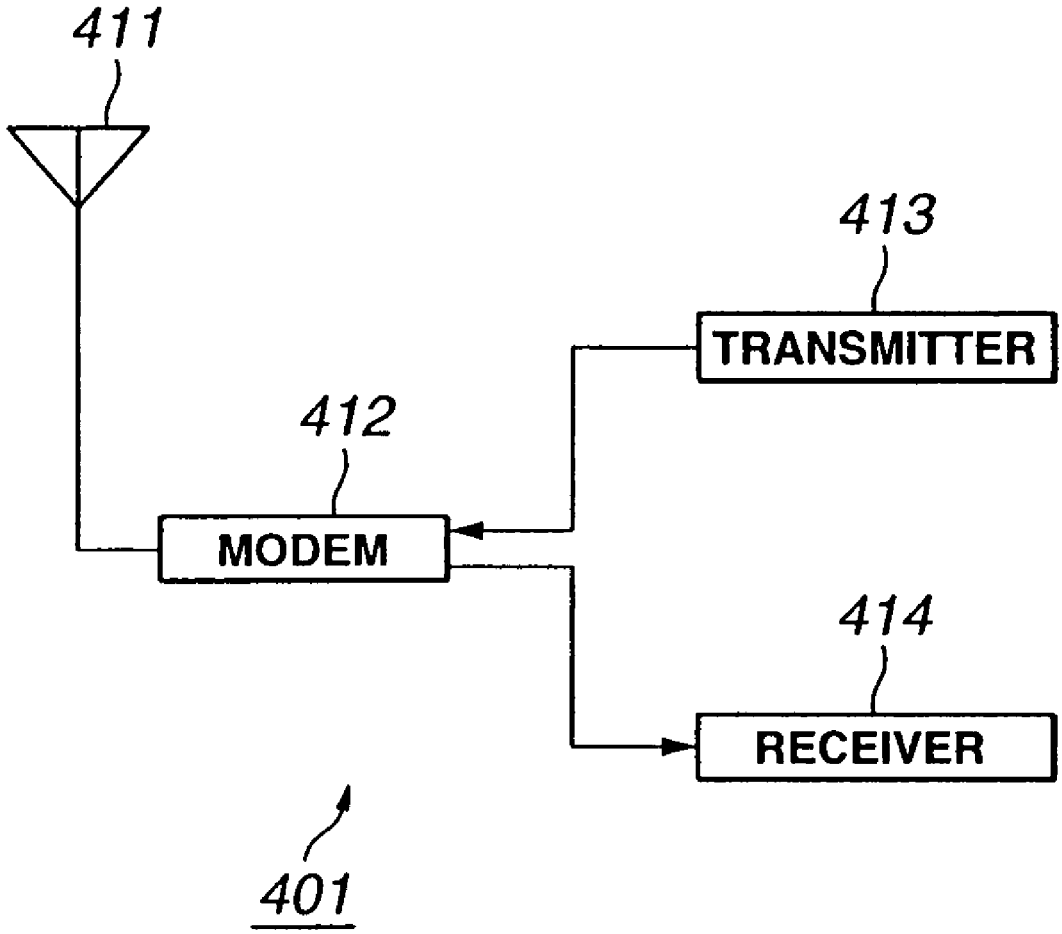
FIG. 31 is a block diagram showing a portable telephone set embodying the present invention.

FIG. 31 shows an illustrative structure of the portable telephone set 401 shown in FIG. 30.

An antenna 411 receives electrical waves from the base stations $\mathbf{402}_1$, $\mathbf{402}_2$ to send the received signals to a modem 412 as well as to send the signals from the modem 412 to the base stations $\mathbf{402}_1$, $\mathbf{402}_2$ as electrical waves. The modem 412 demodulates the signals from the antenna 411 to send the resulting code data explained in FIG. 1 to a receipt unit 414. The modem 412 also is configured for modulating the code data from the transmitter 413 as shown in FIG. 1 and sends the resulting modulated signal to the antenna 411. The transmission unit 413 is configured similarly to the transmission unit shown in FIG. 1 and codes the user's speech input thereto into code data which is sent to the modem 412. The receipt unit 414 receives the code data from the modem 412 to decode and output the speech of high sound quality similar to that obtained in the speech synthesis device of FIG. 24.

Figure 32:
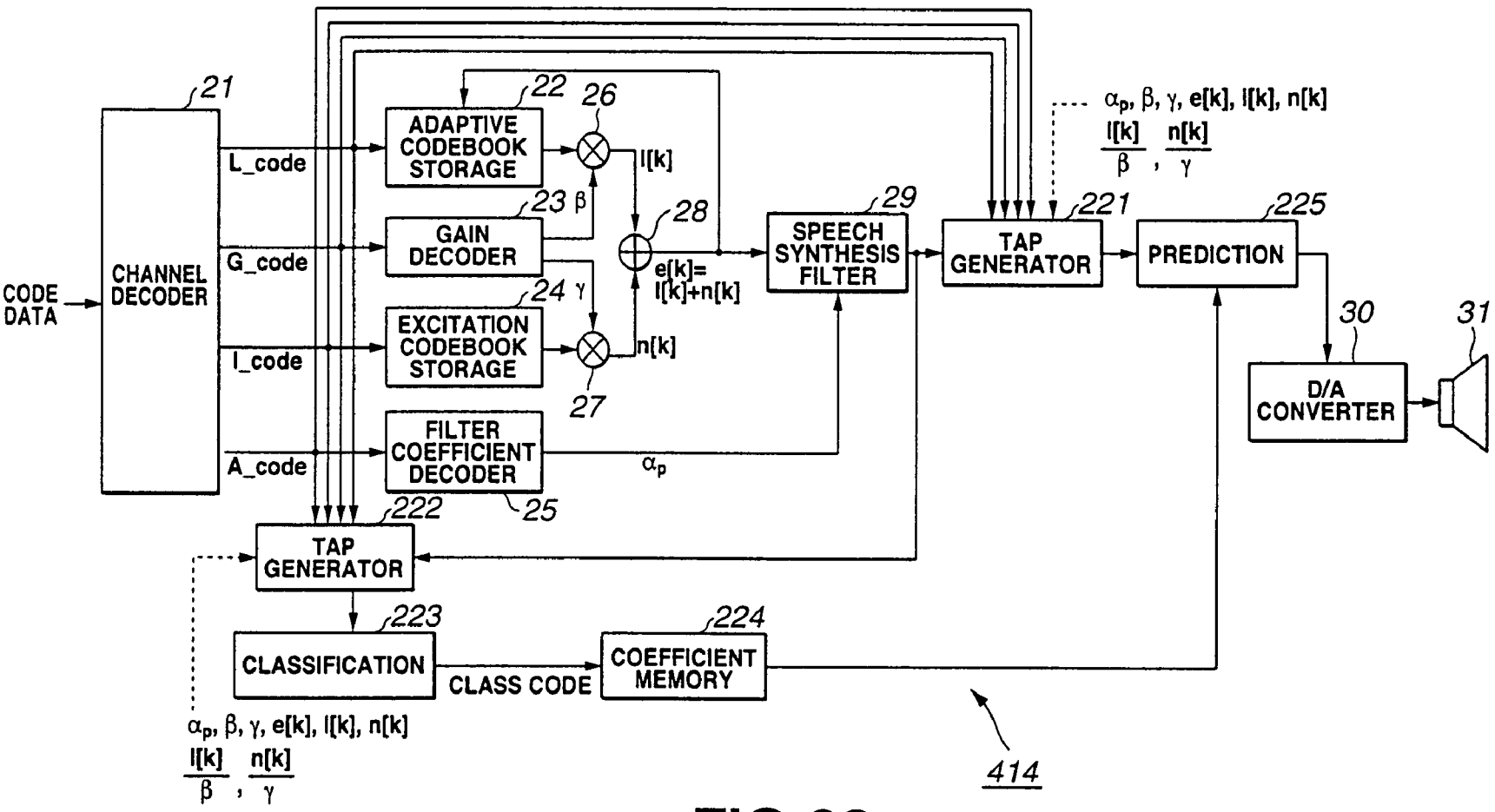
FIG. 32 is a block diagram showing a receiver forming the portable telephone set.

That is, FIG. 32 shows an illustrative structure of the receipt unit 114 of the portable telephone set 401 shown in FIG. 31. In the drawing, parts or components corresponding to those shown in FIG. 2 are depicted by the same reference numerals and are not explained specifically.

The frame-based synthesized sound, output by the speech synthesis unit 29, and the frame-based or subframe-based L, G, I and A codes, output by a channel decoder 21 are sent to tap generators 221, 222. The tap generators 221, 222 extract what are to be the prediction taps and what are to be class taps from the synthesized sound, L code, G code, I code and the A code, supplied thereto. The prediction taps are sent to a prediction unit 225, while the class taps are sent to the classification unit 223.

The classification unit 223 performs classification based on the class taps supplied from the tap generator 122 to route the class codes resulting from the classification to a coefficient memory 224.

The coefficient memory 224 holds the class-based tap coefficients, obtained on learning by the learning device of FIG. 33, which will be explained subsequently. The coefficient memory sends the tap coefficients stored in the address associated with the class code output by the classification unit 223 to the prediction unit 225.

Similarly to the prediction unit 249 of FIG. 24, the prediction unit 225 acquires the prediction taps output by the tap generator 221 and the tap coefficients output by the coefficient memory 224 and, using the prediction and class taps, performs the linear predictive calculations shown in equation (6). In this manner, the prediction unit 225 finds the predicted values of the speech of high sound quality of the frame of interest to route the so found out predicted values to the D/A converter 30.

The receipt unit 414, constructed as described above, performs the processing which is basically in meeting with the flowchart of FIG. 26 to provide an output synthesized sound of high sound quality as being the result of speech decoding.

That is, the channel decoder 21 separates the L, G, I and A codes, from the code data, supplied thereto, to send the so separated codes to the adaptive codebook storage unit 22, gain decoder 23, excitation codebook storage unit 24 and to the filter coefficient decoder 25, respectively. The L, G, I and A codes are also sent to the tap generators 221, 222.

The adaptive codebook storage unit 22, gain decoder 23, excitation codebook storage unit 24 and the operating units 26 to 28 perform the processing similar to that performed in the adaptive codebook storage unit 9, gain decoder 10, excitation codebook storage unit 11 and in the operating units 12 to 14 of FIG. 1 to decode the L, G and I codes to residual signals e. These residual signals are routed to the speech synthesis unit 29.

As explained with reference to FIG. 1, the filter coefficient decoder 25 decodes the A codes, supplied thereto, into linear prediction coefficients, which are routed to speech synthesis unit 29. The speech synthesis unit 29 performs speech synthesis, using the linear prediction coefficients from the filter coefficient decoder 25, to send the resulting synthesized sound to the tap generators 221, 222.

The tap generator 221 renders the frames of the synthesized sound output from the speech synthesis unit 29 a frame of interest. At step S201, the tap generator generates prediction taps from the synthesized sound of the frame of interest, and from the L, G, I and A codes, to route the so generated prediction taps to the prediction unit 225. At step S201, the tap generator 222 generates class taps from the synthesized sound of the frame of interest and from the L, G, I and A codes to send the so generated class taps to the classification unit 223.

At step S202, the classification unit 223 executes classification based on the class taps supplied from the tap generator 222 to send the resulting class code to the coefficient memory 224. The program then moves to step S203.

At step S203, the coefficient memory 224 reads out tap coefficients from the address associated with the class code supplied from the classification unit 223 to send the read-out tap coefficients to the prediction unit 225.

At step S204, the prediction unit 225 acquires the tap coefficients output by the coefficient memory 224 and, using the tap coefficients and the prediction taps from the tap generator 221, executes the sum-of-products processing shown in equation (6) to acquire the predicted value of the speech of high sound quality of the frame of interest.

The speech of the high sound quality, obtained as described above, is sent from the prediction unit 225 through the D/A converter 30 to the loudspeaker 31 which then outputs the speech of high sound quality.

After the processing of step S204, the program moves to step S205 where it is verified whether or not there is any frame to be processed as a frame of interest. If it is found that there is such frame, the program reverts to step S201 where the frame which is to be the next frame of interest is set as the new frame of interest and subsequently the similar sequence of operations is repeated. If it is found at step S205 that there is no frame to be processed as the frame of interest, the processing is terminated.

Figure 33:
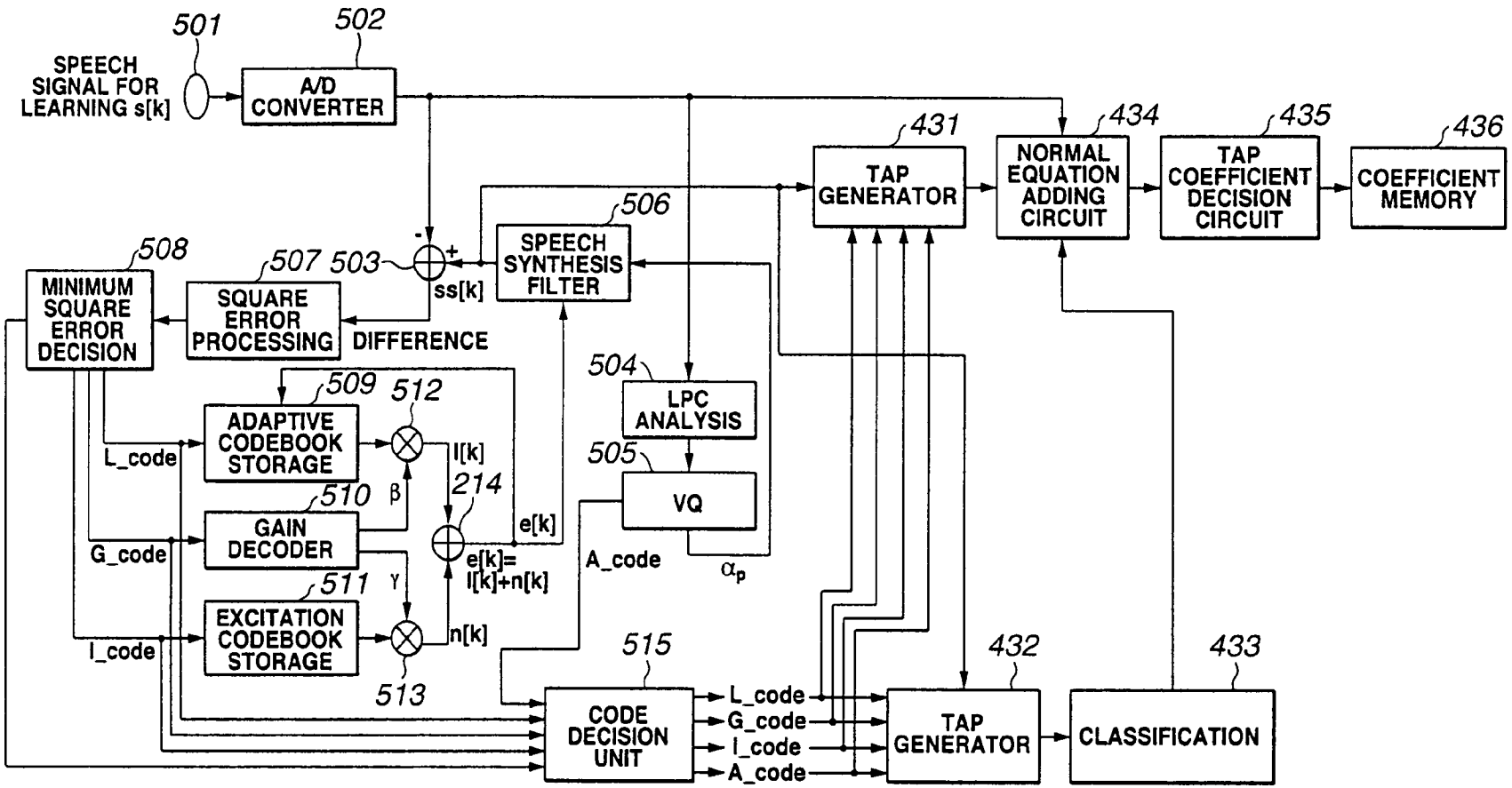
FIG. 33 is a block diagram showing a further modification of the learning device embodying the present invention.

Referring to FIG. 33, an instance of a learning device for learning the tap coefficients to be stored in the coefficient memory 224 of FIG. 32 is explained.

The components from a microphone 501 to a code decision unit 515 are configured similarly to the microphone 1 to the code decision unit 15 of FIG. 1. The microphone 501 is fed with speech signals for learning so that the components microphone 501 to the code decision unit 515 process the speech signals for learning as in the case of FIG. 1.

The synthesized sound output by a speech synthesis filter 506 when the square error is verified to be the smallest in a minimum square error decision unit 508*i* sent to tap generators 431, 432. The tap generators 431, 432 are also fed with the L, G, I and A codes output when the code decision unit 515 has received the definite signal from the minimum square error decision unit 508. The speech output by an A/D converter 202 is fed as teacher data to a normal equation addition circuit 434.

A tap generator 431 forms the same prediction tap as that of the tap generator 221 of FIG. 32, based on the synthesized sound output by the speech synthesis filter 506 and the L, G, I and A codes output by the code decision unit 515, to send the so formed prediction taps as pupil data to the normal equation addition circuit 234.

A tap generator 232 also forms the same class taps as those of the tap generator 222 of FIG. 32, from the synthesized sound output by a speech synthesis filter 506 and the L, G, I and A codes output by the code decision unit 515, and routes the so formed class taps to a classification unit 433.

Based on the class taps from the tap generator 432, the classification unit 433 performs classification in the same way as the classification unit 223 of FIG. 32 to send the resulting class code to the normal equation addition circuit 434.

The normal equation addition circuit 434 receives the speech from an A/D converter 502 as teacher data and prediction taps from the tap generator 131. The normal equation addition circuit then performs summation as in the normal equation addition circuit 281 of FIG. 27 to set a normal equation shown in the equation (13) for each class from the classification unit 433.

A tap coefficient decision circuit 435 solves the normal equation, generated on the class basis, by the normal equation addition circuit 434, to find tap coefficients from class to class, to send the so found tap coefficients to the address associated with each class of the coefficient memory 436.

Depending on the speech signals, provided as speech signals for learning, there are occasions wherein, in a certain class or classes, a number of the normal equations required to find the tap coefficients cannot be produced in the normal equation addition circuit 434. For such class(es), the tap coefficient decision circuit 435 outputs e.g., default tap coefficients.

The coefficient memory 436 memorizes the class-based tap coefficients, pertinent to linear prediction coefficients and residual signals, supplied from the tap coefficient decision circuit 435.

In the above-described learning device, the processing similar to the processing conforming to the flowchart shown in FIG. 29 is performed to find tap coefficients for obtaining the synthesized sound of high sound quality.

That is, the learning device is fed with speech signals for learning and, at step S211, teacher data and pupil data are generated from these speech signals for learning.

That is, the speech signals for learning are input to the microphone 501. The components from the microphone 501 to the code decision unit 515 perform the processing similar to that performed by the microphone 1 to the code decision unit 15 of FIG. 1.

The result is that the speech of digital signals, obtained in the A/D converter 502, is sent as teacher data to the normal equation addition circuit 434. The synthesized sound, output by the speech synthesis filter 506 when the minimum square error decision unit 508 has verified that the square error has become smallest, is sent as pupil data to the tap generators 431, 432. The L, G, I and A codes, output by the code decision unit 515 when the minimum square error decision unit 508 has verified that the square error has become smallest, are also sent as pupil data to the tap generators 431, 432.

The program then moves to step S212 where the tap generator 431 generates prediction taps, with the frame of the synthesized sound sent as pupil data from the speech synthesis filter 506 as the frame of interest, from the L, G, I and A codes and the synthesized sound of the frame of interest, to route the so produced prediction taps to the normal equation addition circuit 434. At step S212, the tap generator 432 also generates class taps from the L, G, I and A codes and the synthesized sound of the frame of interest, to send the so generated class taps to the classification unit 433.

After processing at step S212, the program moves to step S213, where the classification unit 433 performs classification based on the class taps from the tap generator 432 to send the resulting class codes to the normal equation addition circuit 434.

The program then moves to step S214, where the normal equation addition circuit 434 performs the aforementioned summation of the matrix A and the vector v of the equation (13), for the speech of high sound quality of the frame of interest from the A/D converter 502, as teacher data, and for the prediction taps from the tap generator 432, as pupil data, for each class code from the classification unit 433. The program then moves to step S215.

At step S215, it is verified whether or not there is any speech signal for learning for the frame to be processed as the frame of interest. If it is verified at step S215 that there is any speech signal for learning of the frame to be processed as the frame of interest, the program reverts to step S211 where the next frame is set as a new frame of interest. The processing similar to that described above then is repeated.

If it is verified at step S215 that there is no speech signal for learning of the frame to be processed as the frame of interest, that is if the normal equation is obtained in each class in the normal equation addition circuit 434, the program moves to step S216 where the tap coefficient decision circuit 435 solves the normal equation generated for each class to find the tap coefficients for each class. These tap coefficients are sent to and stored in the address in the coefficient memory 436 associated with each class to terminate the processing.

The class-based tap coefficients, are stored in the coefficient memory 436, are stored in the coefficient memory 224 of FIG. 32.

Consequently, the tap coefficients stored in the coefficient memory 224 of FIG. 32 have been found on learning so that the prediction errors of the prediction values of the true speech of high sound quality, obtained on carrying out linear predictive calculations, herein square errors, will be statistically minimum, so that the speech output by the prediction unit 225 of FIG. 32 is of high sound quality.

In the instances shown in FIGS. 32 and 33, the class taps are generated from the synthesized sound output by the speech synthesis filter 506 and the L, G, I and A codes. Alternatively, the class taps may also be generated from one or more of and the L, G, I and A codes and from the synthesized sound output by the speech synthesis filter 506. The class taps may also be formed from linear prediction coefficients $\alpha_p$ obtained from the A code, the information obtained from the L, G, I or A code, inclusive of the gain values β, γ obtained from the G code, such as residual signals e, or 1, n for producing the residual signals e or with 1/β or n/γ, as shown with dotted lines in FIG. 32. The class taps may also be produced from the synthesized sound output by the speech synthesis filter 506 or the above-mentioned information derive from the L, G, I or A code. In cases where software interpolation bits or the frame energy are contained in the code data in the CELP system, the class taps may be formed using the soft interpolation bits or the frame energy. The same may be said of the prediction taps.

Figure 34:
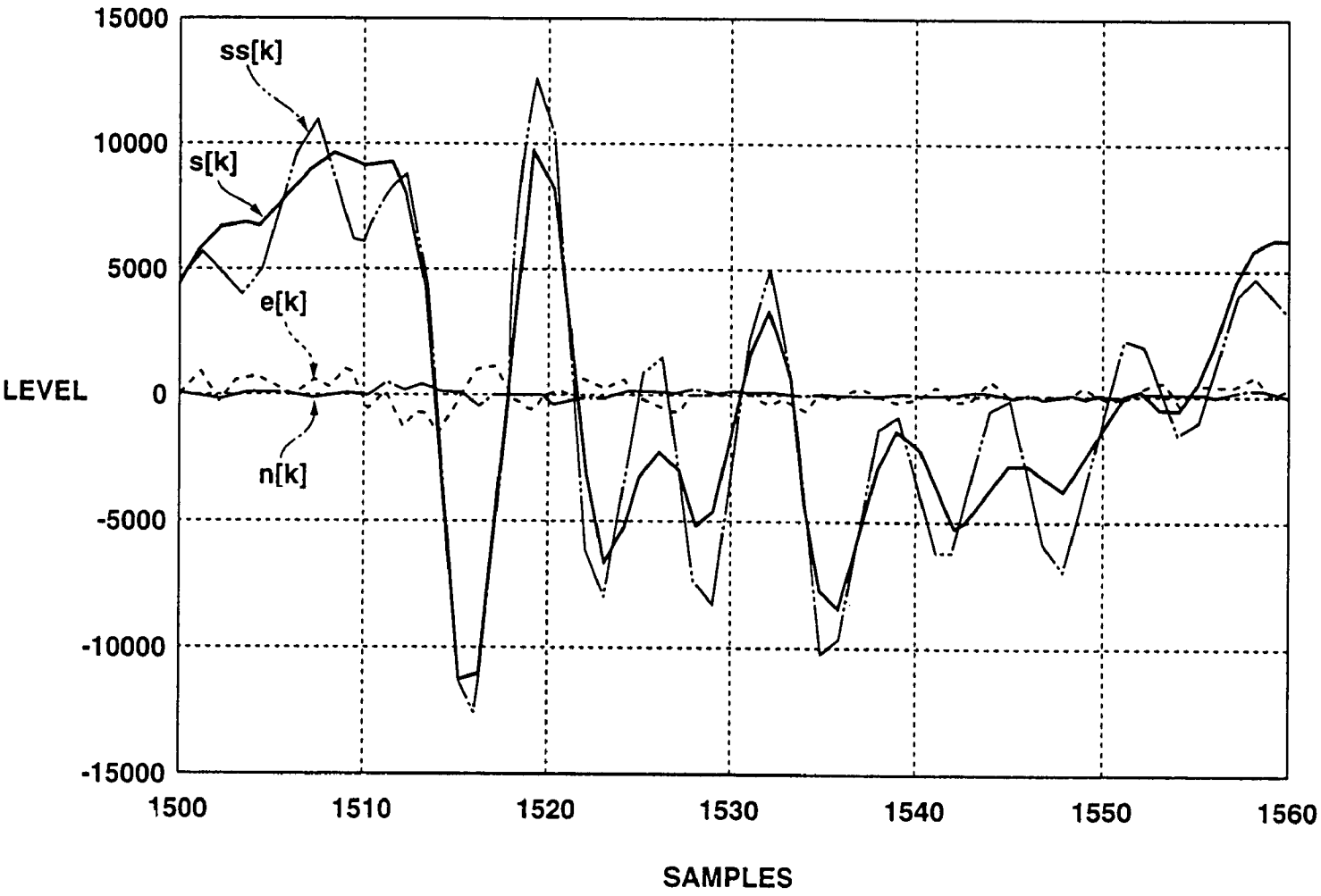
FIG. 34 shows teacher and pupil data.

FIG. 34 shows speech signals s, used as teacher data, data ss of the synthesized sound used as pupil data, residual signals e and n, 1 used for finding the residual signals e in the learning device of FIG. 33.

The above-described sequence of operations may be carried out by software or by hardware. If the sequence of operations is carried out by software, the program forming the software is installed on e.g., a general-purpose computer.

The above-described sequence of operations may be carried out by software or by hardware. If the sequence of operations is carried out by software, the program forming the software is installed on e.g., a general-purpose computer.

The computer on which is installed the program for executing the above-described sequence of operations is configured as shown in FIG. 13, as described above, and the operation similar to that performed by the computer shown in FIG. 13 is executed, and hence is not explained specifically for simplicity.

In the present invention, the processing step for stating the program for executing the various processing operations by a computer need not be carried out chronologically in the order stated in the flowchart, but may be processed in parallel or batch-wise, such as parallel processing or object-based processing.

The program may be processed by a sole computer or by plural computers in a distributed fashion. Moreover, the program may be transmitted to a remotely located computer for execution.

Although no particular reference has been made in the present invention as to which sort of the speech signals for learning is to be used, the speech signals for learning may not only be the speech uttered by a speaker but may also be a musical number (music). If, in the above-described learning, the speech uttered by a speaker is used as the speech signals for learning, such tap coefficients which will improve the sound quality of the speech may be obtained, whereas, if the speech signals for learning are music numbers are used, such tap coefficients may be obtained which will improve the sound quality of the musical number.

The present invention may be broadly applied in generating the synthesized sound from the code obtained on encoding by the CELP system, such as VSELP (Vector Sum Excited Linear Prediction), PSI-CELP (Pitch Synchronous Innovation CELP), CS-ACELP (Conjugate Structure Algebraic CELP).

The present invention also is broadly applicable not only to such a case where the synthesized sound is generated from the code obtained on encoding by CELP system but also to such a case where residual signals and linear prediction coefficients are obtained from a given code to generate the synthesized sound.

In the above-described embodiment, the prediction values of residual signals and linear prediction coefficients are found by one-dimensional linear predictive calculations. Alternatively, these prediction values may be found by two-or higher dimensional predictive calculations.

In the above explanation, the classification is carried out by vector quantizing the class taps. Alternatively, the classification may also be carried out by exploiting e.g., the ADRC processing.

In the classification employing the ADRC, the elements making up the class tap, that is sampled values of the synthesized sound, or L, G, I and A codes, are processed with ADRC, and the class is determined in accordance with the resulting ADRC code.

In the K-bit ADRC, the maximum value MAX and the minimum value MIN of the elements, forming the class tap, are detected, DR=MAX−MIN is set as the local dynamic range of the set, and the elements forming the class taps are re-quantized into K bits. That is, the minimum value MIN is subtracted from the respective elements forming the class tap, and the resulting difference value is divided by DR/2K. The values of the K bits of the respective elements, forming the class tap, obtained as described above, are arrayed in a preset sequence into a bit string, which is output as an ADRC code.

INDUSTRIAL APPLICABILITY

According to the present invention, described above, the prediction taps used for predicting the speech of high sound quality, as target speech, the prediction values of which are to be found, are extracted from the synthesized sound or from the code or the information derived from the code, whilst the class taps used for sorting the target speech to one of plural classes are extracted from the synthesized sound, code or the information derived from the code. The class of the target speech is found based on the class taps. Using the prediction taps and the tap coefficients corresponding to the class of the target speech, the prediction values of the target speech are found to generate the synthesized sound of high sound quality.

The invention claimed is:

1. A data processing device for generating, from a preset code, filter data to be afforded to a speech synthesis filter adapted for synthesizing the speech based on linear prediction coefficients and a preset input signal, comprising:

code decoding means for decoding said code produced by encoding original filter data, to output decoded filter data;

acquisition means for acquiring preset tap coefficients as found by carrying out learning, wherein said tap coefficients are used to predict the original filter data from said decoded filter data; and prediction means for carrying out preset predictive calculations, using said tap coefficients and the decoded filter data, to find prediction values of said filter data, to send the so found prediction values to said speech synthesis filter for use as linear prediction coefficients in said speech syntheses filter.

2. The data processing device according to claim 1 wherein said prediction means carries out one-dimensional linear predictive calculations to find prediction values of said filter data.

3. The data processing device according to claim 1 wherein said acquisition means acquires said tap coefficients from storage means holding said tap coefficients.

4. The data processing device according to claim 1 further comprising:

prediction tap extraction means for extracting prediction taps from said decoded filter data, said prediction taps being usable along with said tap coefficients for predicting said filter data, the prediction values of which are to be found, said prediction means carrying out predictive calculations using said prediction taps and tap coefficients.

5. The data processing device according to claim 4 further comprising:

class tap extraction means for extracting class taps from said decoded filter data, said class taps being used for sorting said decoded filter data to one of a plurality of classes, by way of classification, and classification means for finding the class for said decoded filter data, based on said class taps;

said prediction means carrying out predictive calculations using said prediction taps and said tap coefficients associated with the class of said filter data.

6. The data processing device according to claim 4 further comprising:

class tap extraction means for extracting class taps from said code, said class taps being used for sorting said decoded filter data to one of a plurality of classes, by way of classification, and classification means for finding the class for said decoded filter data, based on said class tap;

said prediction means carrying out predictive calculations using said prediction taps and said tap coefficients associated with the class of said decoded filter data.

7. The data processing device according to claim 6 wherein said class tap extraction means extracts said class taps from both said code and said decoded filter data.

8. The data processing device according to claim 1 wherein said tap coefficients have been obtained on carrying out learning so that prediction errors of predicted values of said filter data obtained on carrying out preset predictive calculations employing said tap coefficients and said decoded filter data will be statistically minimum.

9. The data processing device according to claim 1 wherein said filter data is at least one or both of said preset input signal and said linear prediction coefficients.

10. The data processing device according to claim 1 further comprising:

said speech synthesis filter.

11. The data processing according to claim 1 wherein said code is obtained on encoding speech in accordance with a CELP (Code Excited Linear Prediction Coding) system.

12. A data processing method for generating, from a preset code, filter data to be afforded to a speech synthesis filter adapted for synthesizing the speech based on linear prediction coefficients and on a preset input signal, comprising:

a code decoding step of decoding said code to output decoded filter data;

an acquisition step of acquiring preset tap coefficients as found by carrying out learning, wherein said preset tap coefficients are used to predict the original filter data from said decoded filter data; and a prediction step of carrying out preset predictive calculations, using said tap coefficients and the decoded filter data, to find prediction values of said filter data, to send the so found prediction values to said speech synthesis filter for use as linear prediction coefficients in said speech syntheses filter.

13. A non-transitory computer-readable record medium storing a program that when executed on a computer causes controlling a processor to implement a method for generating, from a preset code, filter data to be afforded to a speech synthesis filter adapted for synthesizing the speech based on linear prediction coefficients and a preset input signal, said program comprising:

a code decoding step of decoding said code to output decoded filter data;

an acquisition step of acquiring preset tap coefficients as found by carrying out learning, wherein said preset tap coefficients are used to predict the original filter data from said decoded filter data; and a prediction step of carrying out preset predictive calculations, using said tap coefficients and the decoded filter data, to find prediction values of said filter data, to send the so found prediction values to said speech synthesis filter for use as linear prediction coefficients in said speech syntheses filter.

14. A learning device for learning preset tap coefficients usable for finding, by predictive calculations from a code associated with filter data to be applied to a speech synthesis filter which synthesizes the speech based on linear prediction coefficients and a preset input signal, prediction values of said filter data, comprising:

code decoding means for decoding the code corresponding to filter data to output decoded filter data; and learning means for carrying out learning so that prediction errors of prediction values of said filter data obtained on carrying out predictive calculations using said tap coefficients and decoded filter data will be statistically smallest to find said tap coefficients, wherein said tap coefficients are used to predict the original filter data from said decoded filter data.

15. The learning device according to claim 14 wherein said learning means performs the learning so that the prediction errors of the prediction values of said filter data obtained on carrying out one-dimensional linear predictive calculations using said tap coefficients and the decoded filter data will be statistically smallest.

16. The learning device according to claim 14 further comprising:

predictive tap extraction means for extracting from said decoded filter data prediction taps used along with said tap coefficients for predicting said filter data;

said learning means effecting learning so that the prediction errors of prediction values of said filter data obtained on carrying out predictive calculations using said prediction taps and tap coefficients will be statistically smallest.

17. The learning device according to claim 16 further comprising:

class tap extraction means for extracting a class tap from said decoded filter data, said class tap being used for sorting said filter data to one of a plurality of classes, by way of classification, and classification means for finding the class for said filter data based on said class tap;

said learning means performing learning so that the prediction errors of prediction values of said filter data obtained on carrying out predictive calculations using said prediction taps and said tap coefficients associated with the class of said filter data will be statistically smallest.

18. The learning device according to claim 16 further comprising:

class tap extraction means for extracting a class tap from said code, said class tap being used for sorting said filter data to one of a plurality of classes, by way of classification, and classification means for finding the class for said filter data based on said class tap;

said learning means performing learning so that the prediction errors of prediction values of said filter data obtained on carrying out predictive calculations using said prediction taps and tap coefficients will be statistically smallest.

19. The learning device according to claim 18 wherein said class tap extraction means extracts said class tap from both said code and said decoded filter data.

20. The learning device according to claim 14 wherein said filter data is at least one or both of said preset input signal and said linear prediction coefficients.

21. The learning device according to claim 14 wherein said code is obtained on encoding speech in accordance with a CELP (Code Excited Linear Prediction Coding) system.

22. A learning method for learning preset tap coefficients usable for finding, by predictive calculations from a code associated with filter data to be applied to a speech synthesis filter which synthesizes the speech based on linear prediction coefficients and a preset input signal, prediction values of said filter data, comprising:

a code decoding step of decoding the code corresponding to filter data to output decoded filter data; and a learning step of carrying out learning so that prediction errors of prediction values of said filter data obtained on carrying out predictive calculations using said tap coefficients and decoded filter data will be statistically smallest to find said tap coefficients, wherein said tap coefficients are used to predict the original filter data from said decoded filter data.

23. A non-transitory computer-readable record medium storing a program that when executed on a computer causes controlling a processor to implement a method for having a computer execute learning processing of learning preset tap coefficients usable for finding, by predictive calculations from a code associated with filter data to be applied to a speech synthesis filter which synthesizes the speech based on linear prediction coefficients and a preset input signal, prediction values of said filter data, said program comprising:

a code decoding step of decoding the code corresponding to filter data to output decoded filter data; and a learning step of carrying out learning so that prediction errors of prediction values of said filter data obtained on carrying out predictive calculations using said tap coefficients and decoded filter data will be statistically smallest to find said tap coefficients, wherein said tap coefficients are used to predict the original filter data from said decoded filter data.

24. A data processing device for generating, from a preset code, filter data to be afforded to a speech synthesis filter adapted for synthesizing the speech based on linear prediction coefficients and a preset input signal, comprising:

a decoder configured to decode said code produced by encoding original filter data, to output decoded filter data;

an acquisition unit configured to acquire preset tap coefficients as found by carrying out learning, wherein said preset tap coefficients are used to predict the original filter data from said decoded filter data; and a predictor configured to carry out preset predictive calculations, using said tap coefficients and the decoded filter data, to find prediction values of said filter data, to send the so found prediction values to said speech synthesis filter for use as linear prediction coefficients in said speech syntheses filter.

25. The data processing device according to claim 24 wherein said predictor carries out one-dimensional linear predictive calculations to find prediction values of said filter data.

26. The data processing device according to claim 24 wherein said acquisition unit acquires said tap coefficients from a store holding said tap coefficients.

27. The data processing device according to claim 24 further comprising:

a prediction tap extractor configured to extract prediction taps from said decoded filter data, said prediction taps being usable along with said tap coefficients for predicting said filter data, the prediction values of which are to be found, said predictor carrying out predictive calculations using said prediction taps and tap coefficients.

28. The data processing device according to claim 27 further comprising:

a class tap extractor configured to extract class taps from said decoded filter data, said class taps being used for sorting said decoded filter data to one of a plurality of classes, by way of classification, and a classifier configured to find the class for said decoded filter data, based on said class taps;

said predictor carrying out predictive calculations using said prediction taps and said tap coefficients associated with the class of said filter data.

29. The data processing device according to claim 27 further comprising:

a class tap extractor configured to extract class taps from said code, said class taps being used for sorting said decoded filter data to one of a plurality of classes, by way of classification, and a classifier for finding the class for said decoded filter data, based on said class tap;

said predictor carrying out predictive calculations using said prediction taps and said tap coefficients associated with the class of said decoded filter data.

30. The data processing device according to claim 29 wherein said class tap extractor extracts said class taps from both said code and said decoded filter data.

31. The data processing device according to claim 24 wherein said tap coefficients have been obtained on carrying out learning so that prediction errors of predicted values of said filter data obtained on carrying out preset predictive calculations employing said tap coefficients and said decoded filter data will be statistically minimum.

32. The data processing device according to claim 24 wherein said filter data is at least one or both of said preset input signal and said linear prediction coefficients.

33. The data processing device according to claim 24 further comprising:

a speech synthesis filter.

34. The data processing according to claim 24 wherein said code is obtained on encoding speech in accordance with a CELP (Code Excited Linear Prediction Coding) system.

* * * * *